United States Patent [19]

Ogawa et al.

[11] Patent Number: 4,636,450

[45] Date of Patent: Jan. 13, 1987

[54] PHOTOCONDUCTIVE MEMBER HAVING AMORPHOUS SILICON MATRIX WITH OXYGEN AND IMPURITY CONTAINING REGIONS

[75] Inventors: Kyosuke Ogawa, Tokyo; Shigeru Shirai, Yamato; Junichiro Kanbe, Yokohama; Keishi Saitoh, Tokyo; Yoichi Osato, Yokohama; Teruo Misumi, Kawasaki, all of Japan

[73] Assignee: Canon Kabushiki Kaisha, Tokyo, Japan

[21] Appl. No.: 830,483

[22] Filed: Feb. 18, 1986

Related U.S. Application Data

[63] Continuation of Ser. No. 706,891, Feb. 27, 1985, abandoned, which is a continuation of Ser. No. 460,919, Jan. 25, 1983, abandoned.

[30] Foreign Application Priority Data

| | | | |
|---|---|---|---|
| Feb. 1, 1982 | [JP] | Japan | 57-14551 |
| Feb. 1, 1982 | [JP] | Japan | 57-14552 |
| Feb. 3, 1982 | [JP] | Japan | 57-16173 |
| Feb. 3, 1982 | [JP] | Japan | 57-16174 |
| Feb. 8, 1982 | [JP] | Japan | 57-18420 |
| Feb. 9, 1982 | [JP] | Japan | 57-20239 |
| Feb. 10, 1982 | [JP] | Japan | 57-20990 |
| Feb. 10, 1982 | [JP] | Japan | 57-20991 |
| Mar. 2, 1982 | [JP] | Japan | 57-33504 |
| Mar. 3, 1982 | [JP] | Japan | 57-33291 |
| Mar. 3, 1982 | [JP] | Japan | 57-33292 |
| Mar. 3, 1982 | [JP] | Japan | 57-33293 |
| Mar. 3, 1982 | [JP] | Japan | 57-33294 |
| Mar. 4, 1982 | [JP] | Japan | 57-34207 |
| Mar. 4, 1982 | [JP] | Japan | 57-34208 |
| Mar. 4, 1982 | [JP] | Japan | 57-34209 |

[51] Int. Cl.[4] ..... G03G 5/082

[52] U.S. Cl. ..... 430/84; 430/95

[58] Field of Search ..... 430/84, 60, 63, 65, 430/95

[56] References Cited

U.S. PATENT DOCUMENTS

| | | | |
|---|---|---|---|
| 3,210,184 | 10/1965 | Uhlig | 430/65 |
| 4,217,374 | 8/1980 | Ovshinsky et al. | 430/84 X |
| 4,226,898 | 10/1980 | Ovshinsky et al. | 430/84 X |
| 4,251,289 | 2/1981 | Moustakas et al. | 204/192 |
| 4,253,882 | 3/1981 | Dalal | 427/74 X |
| 4,265,991 | 5/1981 | Hirai et al. | 430/65 X |
| 4,289,822 | 9/1981 | Shimada et al. | 427/74 X |
| 4,317,844 | 3/1982 | Carlson | 427/39 |
| 4,328,258 | 5/1982 | Coleman | 427/39 |
| 4,359,514 | 11/1982 | Shimizu et al. | 430/65 |
| 4,409,308 | 10/1983 | Shimizu | 430/84 |

*Primary Examiner*—John L. Goodrow

*Attorney, Agent, or Firm*—Fitzpatrick, Cella, Harper & Scinto

[57] ABSTRACT

A photoconductive member comprises a support for a photoconductive member and an amorphous layer exhibiting photoconductivity and comprising an amorphous material comprising silicon atoms as a matrix and at least one member selected from the group consisting of hydrogen atoms and halogen atoms as a constituting atom, characterized in that the amorphous layer has a first layer region containing oxygen atoms and a second layer region containing an atom of Group III or an atom of Group V of the Periodic Table and existing interiorly at the support side, and the first layer region and the second layer region share in common at least a portion of said mutual region, and there is the relation:

$$t_B/(T+t_B) \leqq 0.4$$

where $t_B$ is the thickness of the second layer region and T is a difference between the thickness of the amorphous layer and the thickness of the second layer region $t_B$.

37 Claims, 8 Drawing Figures

PHOTOCONDUCTIVE MEMBER HAVING AMORPHOUS SILICON MATRIX WITH OXYGEN AND IMPURITY CONTAINING REGIONS

This application is a continuation of application Ser. No. 706,891 filed Feb. 27, 1985, now abandoned, which, in turn is a continuation of Ser. No. 460,919 filed Jan. 25, 1983, now abandoned.

BACKGROUND OF THE INVENTION

1. Field of the Invention

This invention relates to a photoconductive member having sensitivity to electromagnetic waves such as light (herein used in a broad sense, including ultraviolet rays, visible light, infrared rays, X-rays and gamma-rays and the like).

2. Description of the Prior Art

Photoconductive materials constituting photoconductive layers for solid state image pick-up devices, electrophotographic image forming members in the field of image formation, or manuscript reading devices are required to have a high sensitivity, a high SN ratio (Photocurrent (Ip)/Dark Current (Id)), absorption spectral characteristics matching to the spectral characteristics of irradiating electromagnetic waves, a good response to light, a desired dark resistance value as well as being safe to human bodies during usage. Further, in a solid state image pick-up device, it is also required that the residual image should be easily treated within a predetermined time. In particular, in case of an image forming member for electrophotography to be assembled in an electrophotographic device to be used in an office as office apparatus, the aforesaid safety characteristic is very important.

From the standpoint as mentioned above, amorphous silicon (hereinafter referred to as "a-Si") has recently attracted attention as a photoconductive material. For example, German Laid-Open Patent Publication Nos. 2746967 and 2855718 disclose applications of a-Si for use in image forming members for electrophotography, and German Laid-Open Patent Publication No. 2933411 discloses application of a-Si for use in a photoelectric converting reading device.

However, under the present situation, although the photoconductive members having photoconductive layers constituted of a-Si of the prior art have been attempted to be improved with respect to individual characteristics, including various electrical, optical and photoconductive characteristics such as dark resistance value, photosensitivity and response to light, environmental characteristics in use, and further stability with lapse of time and durability, there exists room for further improvement in their overall characteristics.

For instance, when the a-Si photoconductor is applied to an image forming member for an electrophotographic device, residual potential is frequently observed to remain during use thereon especially if increases in both photosensitivity and dark resistance are contemplated.

When such a photoconductive member is repeatedly used for a long time, there will be caused various problems such as accumulation of residual charge by repeated uses or so-called ghost phenomenon wherein residual images are formed.

Further, a-Si materials may contain as constituent atoms hydrogen atoms or halogen atoms such as fluorine atoms, chlorine atoms, etc. for improving their electrical, photoconductive characteristics, and boron atoms, phosphorus atoms, etc. for controlling the electroconductivity type, and further other atoms for improving other characteristics. Depending on the manner in which these constituent atoms are contained, there may sometimes be caused problems with respect to electrical, or photoconductive characteristics, or dielectric strength of the layer formed.

For example, there are such problems as shown hereafter. The life of photocarriers produced in the photoconductive layer by irradiation is not long enough. Injection of electric charge from the support side can not be prevented sufficiently. Images transferred to a receiving paper often suffer from defective images, so-called "blank areas", caused by a local discharge breakdown. When a blade is used for cleaning, another defective image, so-called "white lines", are produced which seem to be produced due to rubbing with the blade. Further, when the photoconductive layer is used in a highly humid atmosphere or is used directly after standing in a highly humid atmosphere for a long time, there are often produced disadvantageous so-called "unfocused images".

Further, when the layer thickness becomes ten microns or thicker and then, the member is taken out of a vacuum deposition chamber and exposed to air, the layer is liable to peel off from the support or crack with the lapse of time. These undesirable phenomena occur, in particular, where the support is a drum-like support used in electrophotographic techniques. Accordingly, there still exists problems as to stability with lapse of time.

Thus, it is required in designing a photoconductive material to make efforts to overcome all of such problems as mentioned above along with the improvement of a-Si materials per se.

In view of the above points, the present invention contemplates the discoveries made as a result of extensive studies comprehensively made from the standpoints of applicability and utility of a-Si as a photoconductive member for image forming members for electrophotography, solid state pick-up devices and reading devices etc. It has now been found that a photoconductive member having a photoconductive layer comprising a-Si, in particular, an amorphous material constituted of at least one of hydrogen atom (H) and halogen atom (X) in a matrix of silicon (hereinafter referred to comprehensively as a-Si (H, X)), (for example, so-called hydrogenated amorphous silicon, halogenated amorphous silicon or halogen-containing hydrogenated amorphous silicon), exhibits not only practical and extremely good characteristics, but also surpasses conventional photoconductive members in substantially all aspects, provided that the photoconductive member is constituted to have a specific layer structure as explained in the following. The photoconductive member has markedly excellent characteristics for electrophotography.

The present invention is based on the above mentioned discovery.

SUMMARY OF THE INVENTION

An object of the present invention is to provide a photoconductive member having substantially constantly stable electrical, optical and photoconductive characteristics, suffering from substantially no influence from the use environment, and being markedly excellent in light fatigue resistance, excellent in durability and humidity resistance without causing any deterioration phenomenon after repeated uses and entirely or substantially free from residual potentials.

Another object of the present invention is to provide a photoconductive member having a high adhesion between the support and a layer laminated thereto or between the layers, having a dense and stable structural arrangement, and having a high layer quality.

Still another object of the present invention is to provide a photoconductive member, which is sufficiently capable of bearing charges at the time of charging treatment for formation of electrostatic charges to the extent that a conventional electrophotographic method can be very effectively applied when it is provided for use as an image forming member for electrophotography.

Still another object of the present invention is to provide a photoconductive member for electrophotography capable of providing easily a high quality image which is free from defective images and unfocused images and is high in density, clear in half-tone and high in resolution even when used for a long time.

A further object of the present invention is to provide a photoconductive member having high photosensitivity, high SN ratio characteristic and high dielectric strength.

According to the present invention, there is provided a photoconductive member comprising a support for a photoconductive member and an amorphous layer exhibiting photoconductivity and comprising an amorphous material comprising silicon atoms as a matrix and at least one member selected from the group consisting of hydrogen atoms and halogen atoms as a constituting atom, characterized in that the amorphous layer has a first layer region containing oxygen atoms and a second layer region containing an atom of Group III or an atom of Group V of the Periodic Table and existing interiorly at the support side, and the first layer region and the second layer region share in common at least a portion of said mutual region, and there is the relation:

$$t_B/(T+t_B) \leqq 0.4$$

where $t_B$ is the thickness of the second layer region and T is a difference between the thickness of the amorphous layer and the thickness of the second layer region $t_B$.

DESCRIPTION OF THE PREFERRED EMBODIMENTS

Figure 1:
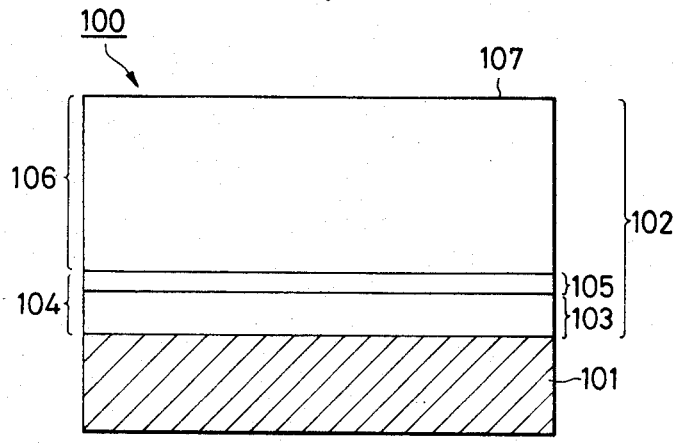
FIG. 1–FIG. 6 schematically show layer structures of preferable embodiments of photoconductive member of the present invention.

The photoconductive members of the present invention will be explained referring to the drawing in the following.

In FIG. 1, a photoconductive member 100 has a support for a photoconductive member 101 and an amorphous layer 102 comprising a-Si (H, X) and exhibiting photoconductivity overlying the support.

Amorphous layer 102 is constituted of a first layer region (O) 103, a second layer region (III, V) 104 containing an atom of Group III of the Periodic Table (Group III atom) or an atom of Group V of the Periodic Table (Group V atom), and a surface layer region 106 containing no oxygen atom and overlying the second layer region (III, V) 104.

In a layer region 105 disposed between the first layer region (O) 103 and the surface layer region 106 there is contained a Group III atom or a Group V atom, but not oxygen.

In the embodiment in FIG. 1, when the second layer region (III, V) 104 contains a Group III atom, the surface layer region 106 contains neither Group III atom nor Group V atom, but when the second layer region (III, V) 104 contains a Group V atom, the surface layer region 106 preferably contains a Group III atom as a conductivity controlling material in an amount such that the Group III atom imparts electric and photoconductive characteristics required for the layer region 106.

Oxygen atoms in the first layer region (O) 103, or Group III atoms or Group V atoms in the second layer region (III, V) 104 are contained in each layer region preferably such that the atoms are continuously and uniformly distributed in the direction of the layer thickness and are continuously and substantially uniformly distributed in a plane substantially parallel to the surface of support 101.

In the photoconductive layer of the present invention in FIG. 1, the surface portion of amorphous layer 102 has a layer region not containing oxygen atoms (corresponding to the surface layer region 106 in FIG. 1). However, a layer region containing a Group III atom or a Group V atom, but not containing oxygen atoms (corresponding to a layer region 105 in FIG. 1) is not always necessary.

For example, in FIG. 1, the first layer region 103 (O) may be the same region as the second layer region (III, V) 104, and further the second layer region (III, V) 104 is entirely included in the first layer region (O) 103.

According to the present invention, employing oxygen atoms in the first layer region (O) results in high resistance of the first layer region (O) and improvement in the adhesion to the support on which the amorphous layer is directly mounted. According to a more preferable embodiment, the surface layer region does not contain oxygen atoms so that the humidity resistance and corona ion resistance are more improved and the sensitivity is enhanced.

In particular, a better result is obtained where the photoconductive member has the structure of photoconductive member 100 as shown in FIG. 1 in which an amorphous layer 102 has a first layer region (O) 103 containing oxygen, a second layer region (III, V) 104 containing a Group III atom or Group V atom, a layer region not containing oxygen atoms 105 and a surface layer region 106, and the first layer region (O) 103 and the second layer region (III, V) 104 commonly occupy a layer region.

According to the present invention, the photoconductive member is provided with the first layer region (O) containing oxygen and constituting a part of the amorphous layer for the purpose of improving the adhesion between the amorphous layer and the support, and is also provided with the second layer region (III, V) containing a Group III atom or Group V atom and constituting a part of the amorphous layer for the purpose of preventing electric charges from being injected into the amorphous layer from the support when the free surface of the amorphous layer is subjected to an electric charging. And the first layer region (O) and the second layer region (III, V) constitute a part of the amorphous layer, occupy a layer region where the support and the amorphous layer are connected, and share in common at least a portion of said mutual region.

When the improvement in the adhesion between the second layer region (III, V) and the support or between the second layer region (III, V) and a layer overlying said second layer region (III, V) is to be attained effectively, it is preferable that the first layer region (O) is provided such that the first layer region (O) includes the second layer region (III, V) starting from the interface with the support, that is, the first layer region (O) is provided in the amorphous layer such that the first layer region (O) extends from the interface with the support to a portion above the second layer region.

The Group III atoms in the second layer region (III, V) are B (boron), Al (aluminum), Ga (gallium), In (indium), Tl (thallium) and the like, preferred with B and Ga.

The Group V atoms in the second layer region (III, V) are P (phosphorus), As (arsenic), Sb (antimony), Bi (bismuth) and the like, preferred with P and As.

The content of the Group III atom or the Group V atom contained in the second layer (III, V) may be optionally selected for attaining the purpose of the present invention effectively, and is preferably $30-5\times10^4$ atomic ppm, more preferably $50-1\times10^4$ atomic ppm, most preferably $100-5\times10^3$ atomic ppm.

The content of oxygen contained in the first layer region (O) may be appropriately selected depending upon the required characteristics of the photoconductive member to be produced, and is preferably 0.001–50 atomic %, more preferably 0.002–40 atomic %, most preferably 0.003–30 atomic %.

According to the present invention, the thickness of the second layer region (III, V), $t_B$ (the thickness of layer region 104 in FIG. 1) and the thickness of a layer region (B), T (the thickness of layer region 106 in FIG. 1), the layer region (B) being disposed on the layer region (III, V) and corresponding to a portion of the amorphous layer excluding the layer region (III, V), should satisfy the relation as mentioned previously. The value of the formula is preferably 0.35 or less, more preferably 0.3 or less.

The value of $t_B$ is preferably 30 Å–5μ, more preferably 40 Å–4μ, most preferably 50 Å–3μ.

The sum of layer thickness T and layer thickness $t_B$, $(T+t_B)$, is preferably 1–100 μ, more preferably 1–80μ, most preferably 2–50μ.

The thickness of the layer region (O) containing oxygen atoms ($t_o$) is preferably determined by taking into consideration the thickness ($t_B$) of the layer region (III, V) which shares with the layer region (O) in common at least a portion of said mutual region.

For the purpose of enhancing the adhesion with the support directly contacting the layer region (III, V), it is necessary only that the layer region (O) is present at the region contacting the support in the layer region (III, V), and therefore, it is sufficient that the thickness of the layer region (O), $t_o$, is at most $t_B$, the thickness of the layer region (III, V).

For the purpose of enhancing the adhesion between the layer region (III, V) and the layer region directly mounted on the layer region (III, V) (corresponding to the layer region 106 in FIG. 1), it is necessary only that the layer region (O) is present at the end region of the layer region (III, V) opposite to the end region thereof connected to the support. Therefore, it is sufficient that the thickness of the layer region (O), $t_o$, is at most $t_B$, the thickness of the layer region (III, V).

For the purpose of satisfying the above two points simultaneously, $t_o$ should be at least the value of $t_B$, and in this case, the layer region (III, V) is included in the layer region (O).

For the purpose of more effectively enhancing the adhesion between the layer region (III, V) and the layer region directly mounted on the layer region (III, V), it is preferable to extend the layer region (O) up to the portion above the layer region (III, V) (to the direction opposite to the support side).

The layer thickness $t_o$ may be optionally determined as desired, and is preferably 10 Å–10μ, more preferably 20 Å–8μ, most preferably 30 Å–5μ.

When the layer region (III, V) contains a Group V atom, it is preferable that the layer region (B) mounted on the layer region (III, V) and not containing a Group V atom (corresponding to layer region 106 in FIG. 1) preferably contains a Group III atom as a material capable of controlling electroconductivity type so as to control the electroconductivity type of the layer region (B) optionally as desired.

The content of the material controlling the electroconductivity type contained in the layer region (B) may be appropriately selected depending upon the required electroconductivity of the layer region (B), characteristics of other layer regions directly contacting the layer region (B), characteristics of interfaces between the other layer region and the layer region (B), and the like.

The content of the material controlling electroconductivity type contained in the layer region (B) is preferably 0.001–1000 atomic ppm, more preferably 0.05–500 atomic ppm, most preferably 0.1–200 atomic ppm.

One of the preferred embodiments of the present invention is that the layer region (O) is localized at a support side in the amorphous layer, but the present invention is not limited to such embodiment, that is, the layer region (O) may occupy the whole amorphous layer region.

In this case, the amorphous layer should be prepared to exhibit photoconductivity, and therefore, the upper limit of oxygen atoms contained in the layer region (O) is preferably 30 atomic %, more preferably 10 atomic %, most preferably 5 atomic %. The lower limit is as mentioned above.

The support used for the photoconductive member in the present invention may be either electroconductive or insulating. As the electroconductive support, there may be mentioned metals such as NiCr, stainless steel, Al, Cr, Mo, Au, Nb, Ta, V, Ti, Pt, Pd, etc. or alloys thereof.

As insulating supports, there may conventionally be used films or sheets of synthetic resins, including polyester, polyethylene, polycarbonate, cellulose acetate, polypropylene, polyvinyl chloride, polyvinylidene chloride, polystyrene, polyamide, etc., glasses, ceramics, papers and the like. These insulating supports may suitably have at least one surface subjected to an electroconductivizing treatment, and it is desirable to provide other layers on the side to which asid electroconductivizing treatment has been applied.

For example, electroconductivizing treatment of a glass can be effected by providing a thin film of NiCr, Al, Cr, Mo, Au, Ir, Nb, Ta, V, Ti, Pt, Pd, $In_2O_3$, $SnO_2$, ITO($In_2O_3+SnO_2$) etc. thereon. Alternatively, a synthetic resin film such as polyester film can be subjected to the electroconductivizing treatment on its surface by vacuum vapor deposition, electron-beam deposition or sputtering of a metal such as NiCr, Al, Ag, Pd, Zn, Ni, Au, Cr, Mo, Ir, Nb, Ta, V, Ti, Pt, etc. or by laminating treatment with said metal, thereby imparting electroconductivity to the surface. The support may be shaped in any form such as cylinders, belts, plates or others, and its form may be determined as desired. For example, when the photoconductive memeber 100 in FIG. 1 is to be used as an image forming member for electrophotography, it may desirably be formed into an endless belt or a cylinder for use in continuous high speed copying. The support may have a thickness which is conveniently determined so that a photoconductive member as desired may be formed. When the photoconductive member is required to have a flexibility, the support is made as thin as possible, so far as the function of a support can be sufficiently exhibited. However, in such a case, the thickness is generally about 10$\mu$ or more from the points of fabrication and handling of the support as well as its mechanical strength.

In the present invention, formation of an amorphous layer fundamentally constituted of a-Si (H, X) as a main component may be conducted according to the vacuum deposition method utilizing discharging phenomenon, such as glow discharge method, sputtering method or ion-plating method. For example, for formation of the amorphous layer constituted of a-Si (H, X) according to the glow discharge method, the basic procedure comprises introducing a starting gas for introduction of hydrogen atoms (H) and/or halogen atoms (X) together with a starting gas for supplying silicon atoms (Si) into the deposition chamber which can be internally brought to reduced pressure, wherein glow discharge is generated thereby to form a layer of a-Si (H, X) on the surface of a support placed at a predetermined position in the chamber. When it is to be formed according to the sputtering method, a starting gas for introduction of hydrogen atoms (H) and/or halogen atoms (X) may be introduced into the chamber for sputtering when effecting sputtering using the target formed of silicon (Si) in an atomosphere of an inert gas such as Ar, He or a gas mixture based on these gases.

As the halogen atoms (X) contained in the amorphous layer if desired, there may be mentioned fluorine, chlorine, bromine and iodine, preferred with fluorine and chlorine.

The starting gas for supplying Si to be used in the present invention may include gaseous or gasifiable silicon hydrides (silanes) such as $SiH_4$, $Si_2H_6$, $Si_3H_8$, $Si_4H_{10}$ and others as effective materials. In particular, $SiH_4$ and $Si_2H_6$ are preferred with respect to easy handling during layer formation and efficiency for supplying Si.

As the effective starting gas for incorporation of halogen atoms to be used in the present invention, there may be mentioned a number of halogen compounds such as halogen gases, halides, interhalogen compounds and silane derivatives substituted with halogens which are gaseous or gasifiable.

Alternatively, it is also effective in the present invention to use a gaseous or gasifiable silicon compound containing halogen atoms which is constituted of both silicon atom and halogen atom.

Typical examples of halogen compounds preferably used in the present invention may include halogen gases such as fluorine, chlorine, bromine or iodine and interhalogen compounds such as BrF, ClF, $ClF_3$, $BrF_5$, $BrF_3$, $IF_3$, $IF_7$, ICl, IBr, and the like.

As the silicon compound containing halogen atom, that is, a silane derivative substituted by a halogen atom, silicon halides such as $SiF_4$, $Si_2F_6$, $SiCl_4$, $SiBr_4$, or the like are preferred.

When the specific photoconductive member of this invention is formed according to the glow discharge method by use of such a silicon compound containing halogen atom, it is possible to form a photoconductive layer constituted of a-Si containing halogen atoms as a constituent on a given support without use of a silicon hydride gas as the starting gas capable of supplying Si.

In forming the amorphous lay containing halogen atom according to the glow discharge method, the basic procedure comprises feeding a starting gas for supplying Si, namely a gas of silicon halide and a gas such as Ar, $H_2$, He, etc. at a predetermined component ratio and a gas flow rate into the deposition chamber for formation of the amorphous layer, followed by excitation of glow discharge to form a plasma atmosphere of these gases, thereby forming the amorphous layer on a support. It is also possible to form a layer by mixing a gas of a silicon compound containing hydrogen atoms at a suitable ratio with these gases in order to incorporate hydrogen atoms therein.

Each of the gases for introduction of respective atoms may be either a single species or a mixture of plural species at a predetermined ratio.

For formation of an amorphous layer of a-Si (H, X) by the reactive sputtering method or the ion-plating method, for example, a target of Si or mainly composed of Si is used and sputtering is effected in a suitable gas plasma atmosphere in case of the sputtering method. Alternatively, in case of ion-plating method, a polycrystalline or single crystalline silicon or a material containing one of them as a main component is placed as a vaporization source in a vaporization boat, and the silicon vaporization source is vaporized by heating by resistance heating method or electron beam method (EB method) thereby to permit vaporized flying substances to pass through a suitable gas plasma atmosphere.

During this procedure, in either of the sputtering method or the ion-plating method, for introduction of halogen atoms into the layer formed, a gas of a halogen compound as mentioned above or a silicon compound containing halogen as mentioned above may be introduced into the deposition chamber to form a plasma atmosphere of said gas therein.

When hydrogen atoms are to be introduced, a starting gas for introduction of hydrogen atoms such as $H_2$ and a gas such as silanes as mentioned above may be introduced into the deposition chamber for sputtering, followed by formation of a plasma atmosphere of said gases.

In the present invention, as the starting gas for introduction of halogen atoms, the halogen compounds or silicon compounds containing halogens as mentioned above can be effectively used. In addition, it is also possible to use a gaseous or gasifiable halide containing hydrogen atom as one of the constituents such as hydrogen halide, including HF, HCl, HBr, HI and the like or halo-substituted silicon hydride, including $SiH_2F_2$, $SiH_2I_2$, $SiH_2Cl_2$, $SiHCl_3$, $SiH_2Br_2$, $SiHBr_3$ and the like as an effective starting material for formation of the amorphous layer.

These halides containing hydrogen atom can introduce hydrogen atoms which is very effective for controlling electrical or photoelectric characteristics into the layer during formation of the amorphous layer simultaneously with introduction of halogen atoms. Therefore, these halides containing hydrogen atom can be preferably used as the starting material for introduction of halogen atoms.

For incorporation of hydrogen atoms structurally into the amorphous layer, alternatively, $H_2$ or a gas of silicon hydride, including $SiH_4$, $Si_2H_6$, $Si_3H_8$, $Si_4H_{10}$ and so on may be permitted to be co-present with a silicon compound for supplying Si in a deposition chamber, wherein discharging is excited.

For example, in case of the reactive sputtering method, a Si target is used and a gas for introduction of halogen atoms and $H_2$ gas are introduced together with, if necessary, an inert gas such as He, Ar, etc. into a deposition chamber, wherein a plasma atmosphere is formed to effect sputtering with said Si target, thereby forming an amorphous layer of a-Si (H, X) on a desired support.

The amount of hydrogen atoms (H) or halogen atoms (X) contained in the amorphous layer of a photoconductive member or total amount of both of these atoms (H+X) when hydrogen atoms and halogen atoms are contained, may be preferably 1 to 40 atomic %, more preferably 5 to 30 atomic %.

For controlling the amounts of hydrogen atoms (H) and/or halogen atoms (X) in the amorphous layer, the support temperature and/or the amounts of the starting materials for incorporation of hydrogen atoms (H) or halogen atoms (X) to be introduced into the deposition device system, or the discharging power may be controlled.

For forming a layer region (III, V) containing a Group III atom or a Group V atom and a layer region (O) containing oxygen atom in an amorphous layer, upon forming the amorphous layer by a glow discharge method or reactive sputtering method, a starting material for introducing a Group III atom, a starting material introducing a Group V atom, and a starting material for introducing oxygen atom are used together with the above-mentioned starting materials for forming the amorphous layer upon forming the respective layer regions to incorporate each of them in a controlled amount.

When a glow discharge method is employed for producing the layer region (O) and the layer region (III, V), respectively, the starting materials as starting gases for producing each layer region may be composed of a member selected from the above mentioned starting materials for producing the amouphous layer as desired and a starting material for introducing oxygen atom and/or Group III atom or Group V atom.

As the starting material for introducing oxygen atom, Group III atom or Group V atom, there may be employed most of gaseous or gasified gasifiable substances containing oxygen or Group III atom or Group V atom.

For example, for formation of the layer region (O), it is possible to use a mixture of a starting gas having silicon atoms (Si) as constituent atoms, a starting gas having oxygen atoms (O) as constituent atoms and, if necessary, a gas having hydrogen atoms (H) and/or halogen atoms (X) as constituent atoms at a desired mixing ratio. Alternatively, a mixture of a starting gas having silicon atoms (Si) as constituent atoms and a starting gas having oxygen atoms (O) and hydrogen atoms (H) as constituent atoms at a desired mixing ratio can also be used. Further, it is also possible to use a mixture of a starting gas having silicon atoms (Si) as constituent atoms and a starting gas having the three atoms of silicon atoms (Si), oxyten atoms (O) and hydrogen atoms (H) as constituent atoms.

As another method, it is also possible to use a mixture of a starting gas having silicon atoms (Si) and hydrogen atoms (H) as constituent atoms and a starting gas having oxygen atoms (O) as constituent atoms.

As typical examples of starting materials for introduction of oxygen atoms, there may be mentioned oxygen ($O_2$), ozone ($O_3$), nitrogen monoxide (NO), nitrogen dioxide ($NO_2$), dinitrogen oxide ($N_2O$), dinitrogen trioxide ($N_2O_3$), dinitrogen tetraoxide ($N_2O_4$), dinitrogen pentoxide ($N_2O_5$), nitrogen trioxide ($NO_3$), lower siloxanes containing Si, O and H as constituent atoms such as disiloxane ($H_3SiOSiH_3$), trisiloxane ($H_3SiOSiH_2OSiH_3$), and so on.

As the starting material for introduction of the group III atoms when forming the layer region (III, V) by using the glow discharge method, there may be effectively employed, for introduction of boron atoms, boron hydrides such as $B_2H_6$, $B_4H_{10}$, $B_5H_9$, $B_5H_{11}$, $B_6H_{10}$, $B_6H_{12}$, $B_6H_{14}$, etc. and boron halides such as $BF_3$, $BCl_3$, $BBr_3$, etc. In addition, there may also be included $AlCl_3$, $CaCl_3$, $Ga(CH_3)_3$, $InCl_3$, $TlCl_3$, and so on.

As a starting material for introducing a Group V atom effectively used in the present invention, there may be mentioned phosphorus hydrides such as $PH_3$, $P_2H_4$ and the like, and phosphorus halides such as $PH_4I$, $PF_3$, $PF_5$, $PCl_3$, $PCl_5$, $PBr_3$, $PBr_5$, $PI_3$ and the like, for introducing phosphorus. Other than above, there may be mentioned $AsH_3$, $AsF_3$, $AsCl_3$, $AsBr_3$, $AsF_5$, $SbH_3$, $SbF_3$, $SbF_5$, $SbCl_3$, $SbCl_5$, $BiH_3$, $BiCl_3$, $BiBr_3$ and the like.

The content of the Group III atom or Group V atom to be introduced into the layer region (III, V) may be controlled freely by controlling the gas flow rate and the gas flow rate ratio of the starting materials for introduction of the Group III atom or Group V atom, the discharging power, the support temperature and the pressure within the deposition chamber.

For formation of a layer region (O) containing oxygen atoms by the sputtering method, a single crystalline or polycrystalline Si wafer or $SiO_2$ wafer, or a wafer containing Si and $SiO_2$ mixed therein is used as target and sputtering is effected in an atmosphere of various gases.

For example, when Si wafer is used as target, a starting gas for introduction of oxygen atoms and, if necessary, hydrogen atoms and/or halogen atoms, which may be diluted with a diluting gas, if desired, is introduced into a deposition chamber for sputter to form a gas plasma therein and effect sputtering of said Si wafer.

Alternatively, Si and $SiO_2$ as separate targets or one sheet target of a mixture of Si and $SiO_2$ can be used and sputtering is effected in a diluting gas atmosphere as a gas for sputtering, or in a gas atmosphere containing at least hydrogen atoms (H) and/or halogen atoms (X) as constituent elements. As the starting gas for introduction of oxygen atoms, there may be employed those as mentioned in the glow discharge as described above as effective gases also in case of sputtering.

In the present invention, as the diluting gas to be employed in forming the amorphous layer according to the glow discharge method or as the gas for the sputtering method, there may be included so called rare gases such as He, Ne, Ar and the like as suitable ones.

Figure 2:
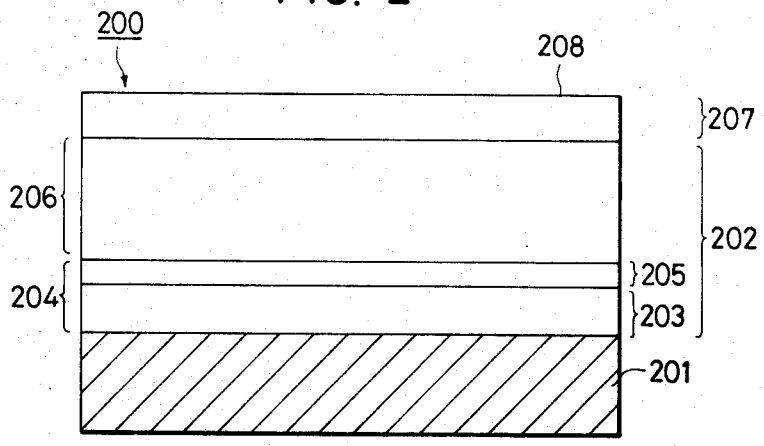

FIG. 2 shows a second embodiment of the photoconductive member according to the present invention.

In FIG. 2, a photoconductive member 200 is constituted of a support 201 for a photoconductive member, a first amorphous layer (I) 202 exhibiting photoconductivity and overlying the support 201, and a second amorphous layer 207 overlying the first amorphous layer (I) 202. The second amorphous layer 207 is mainly composed of an amorphous material composed of silicon atom, carbon atom, and if desired, at least one of hydrogen atom and halogen atom as constituting atoms (hereinafter referred to as "a-SiC(H,X)").

The first amorphous layer 202 in FIG. 2 is the same as the amorphous layer 102 in FIG. 1. That is, the photoconductive member 200 in FIG. 2 in the same as the photoconductive member 100 in FIG. 1 except that the second amorphous layer 207 composed of a-SiC(H,X) overlies the first amorphous layer 202.

The second amorphous layer (II) 207 disposed on the first amorphous layer (I) 202 has a free surface 208 and is provided for the purpose of attaining the purpose of the present invention, that is, improving mainly humidity resistance, repeating use characteristics, dielectric strength, use environmental characteristics, and durability.

Since the first amorphous layer (I) 202 and the second amorphous layer (III) 207 contain a common amorphous material, i.e. silicon atom, chemical and electrical stability can be sufficiently assured at the laminating interface.

As the a-SiC(H,X) constituting the second amorphous layer (II), there may be preferably mentioned an amorphous material composed of silicon atom and carbon atom (a-$Si_aC_{1-a}$, $0<a<1$), an amorphous material composed of silicon atom, carbon atom, and hydrogen atom (a-$(Si_bC_{1-b})_cH_{1-c}$, $0<a$, $b<1$), and an amorphous material composed of silicon atom, carbon atom, halogen atom (X), and if desired, hydrogen atom (a-$(Si_dC_{1-d})_e(X,H)_{1-e}$, $0<d$, $e<1$).

The second amorphous layer (II) composed of a-SiC(H,X) may be produced by glow discharging method, sputtering method, ion implantation method, ion plating method, electron beam method or the like.

These methods are appropriately selected depending upon the production conditions, capital investment, scale of production, desired characteristics of the photoconductive member to be produced and the like.

Glow discharging method and sputtering method are preferably employed since the production conditions for obtaining desired characteristics of the photoconductive members can be easily controlled and it is easy to introduce carbon atom, hydrogen atom and halogen atom together with silicon atom into the second layer region (II).

Further, the second amorphous layer (II) may be produced by carrying out both glow discharging method and sputtering method in a single apparatus.

When the second layer region (II) is produced by using a glow discharge method, a starting gas for producing a-SiC(H,X), if desired, mixed with a diluting gas at a predetermined ratio is introduced into a deposition chamber where a support is placed, and the gas thus introduced is subjected to glow discharge to form a gas plasma, and a-SiC(H,X) is deposited on the first layer region (I) already formed on the support.

As the gases for forming a-SiC(H,X), there may be used most of gaseous or gasifiable materials which can supply Si, C, H and X.

Combinations of the materials are, for example, as shown below.

A starting gas containing Si as a constituting atom, a starting gas containing C as a constituting atom and a starting gas containing H or X as a constituting atom are mixed at a desired ratio and used.

Alternatively, a starting gas containing Si as a constituting atom and a starting gas containing C and H or X as constituting atoms are mixed at a desired ratio and used.

Further alternatively, a starting gas ciontaining Si as a constituting atom and a gas containing Si, C and H, or Si, C and X as constituting atoms are mixed at a desired ratio and used.

Still further alternatively, a starting gas containing Si and H or X as constituting atoms and a starting gas containing C as a constituting atom are mixed at a desired ratio and used.

Starting gases used for forming effectively the second amorphous layer (II) include a silicon hydride gas containing Si and H as constituting atoms, for example, silanes such as $SiH_4$, $Si_2H_6$, $Si_3H_8$, $Si_4H_{10}$ and the like, and compounds containing C and H as constituting atoms, for example, saturated hydrocarbons of $C_{1-5}$, ethylenic hydrocarbons of $C_{2-5}$, acetylenic hydrocarbons of $C_{2-4}$ and the like.

More particularly, as saturated hydrocarbons, there may be mentioned methane, ethane, propane, n-butane, pentane, and the like. As ethylenic hydrocarbons, there may be mentioned ethylene, propylene, butene-1, butene-2, isobutylene, pentene and the like. As acetylenic hydrocarbons, there may be mentioned acetylene, methylacetylene, butyne and the like.

As starting gases containing Si, C and H as constituting atoms, there may be mentioned alkyl silanes such as $Si(CH_3)_4$, $Si(C_2H_5)_4$ and the like. Other than the above-mentioned starting gases, as a starting gas for introducing H, there may be naturally used $H_2$.

As halogen atoms (X) incorporated in the second layer region (II), F, Cl, Br and I may be used, and F and Cl are preferable.

When hydrogen atom is incorporated in the second layer region (II), a part of the starting gases can be commonly used upon producing continuously the first layer region (I) and the second layer region (II), and therefore, the production cost can be lowered.

Starting gases for introducing halogen atom (X) effectively used for producing the second layer region (II) may be gaseous materials at ambient temperature and atmospheric pressure or easily gasifiable materials.

Such materials which can be starting gases for introducing halogen atom (X) are: halogen, hydrogen halides, interhalogen compounds, silicon halides, halogen-substituted silicon hydrides and the like. As the above-mentioned halogen series materials, there may be particularly mentioned:

halogen gases such as fluorine, chlorine, bromine and iodine;

hydrogen halides such as HF, HI, HCl, and HBr;

interhalogen compounds such as BrF, ClF, $ClF_3$, $ClF_5$, $BrF_5$, $BrF_3$, $IF_7$, $IF_5$, ICl, IBr, and the like;

silicon halides such as $SiF_4$, $Si_2F_6$, $SiCl_4$, $SiCl_3Br$, $SiCl_2Br_2$, $SiClBr_3$, $SiCl_3I$, $SiBr_4$ and the like; and halogen-substituted silicon hydrides such as $SiH_2F_2$, $SiH_2Cl_2$, $SiHCl_3$, $SiH_3Cl$, $SiH_3Br$, $SiH_2Br_2$, $SiHBr_3$ and the like.

In addition, the halogen series materials include halogen substituted paraffin hydrocarbons such as $CCl_4$, $CHF_3$, $CH_2F_2$, $CH_3F$, $CH_3Cl$, $CH_3Br$, $CH_3I$, $C_2H_5Cl$ and the like; sulfur fluorides such as $SF_4$, $SF_6$ and the like; and silane derivatives, for example, halogen containing alkyl silanes such as $SiCl(CH_3)_3$, $SiCl_2(CH_3)_2$, $SiCl_3CH_3$ and the like.

When the second amorphous layer (II) is formed by a sputtering method, a single crystalline or polycrystalline Si wafer and a C wafer, or a wafer containing both Si and C, is used as a target, and sputtering is effected in various gas atmospheres.

For example, when an Si wafer is used as a target, starting gases for introducing at least C may be diluted by a diluting gas, if desired, and introduced into a deposition chamber for sputtering to produce gas plasma of said gases and then sputtering is effected.

Alternatively, Si and C are made into separate targets or into one single target composed of a mixture of Si and C, and these targets are used in a gas atmosphere containing at least hydrogen atoms or halogen atoms to conduct sputtering.

As starting gases for introducing C or H or X, the above-mentioned starting gases for glow discharge may be also used effectively for sputtering.

As the diluting gas used upon forming the second amorphous layer (II) by glow discharge or sputtering method, there may be mentioned preferably a rare gase such as He, Ne, Ar and the like.

The second amorphous layer (II) is formed carefully so as to impart desired characteristics thereto. That is, since the materials composed of Si and C, if desired, H and/or halogen as constituting atoms have a structure ranging from crystal to amorphous and exhibit electric properties ranging from electroconductivity to semiconductive property, and further to insulating property and also ranging from photoconductivity to non-photoconductivity depending upon the conditions for formation of the materials, it is preferable to select the conditions strictly so as to obtain the desired properties of a-SiC(H,X) achieving the object of the invention.

For example, in case that the second amorphous layer (II) is provided for improving mainly the dielectric strength, the a-SiC(H,X) formed should be remarkably electrically insulating under the use environment.

Further, in case that the second amorphous layer (II) is provided for improving mainly the continuous repeating use characteristics and the use environment characteristics, the degree of electrical insulating property as mentioned above may be somewhat low, and it is sufficient for the purpose that the a-SiC(H,X) formed has a sensitivity to an irradiating light to some extent.

Upon forming a second amorphous layer (II) composed of the a-SiC(H,X) on a first amorphous layer (I), the support temperature during forming the layer is an important factor affecting the constitution and characteristics of the resulting layer. Therefore, it is preferable to control strictly the support temperature so as to impart desired characteristics to the a-SiC(H,X).

The support temperature is appropriately selected depending upon the type of process for forming the second amorphous layer (II).

When the second amorphous layer (II) is formed with a-$Si_aC_{1-a}$, the support temperature is preferably 20°-300° C., more preferably 20°-250° C.

When the second amorphous layer (II) is formed with a-$(Si_bC_{1-b})_cH_{1-c}$ or a-$(Si_dC_{1-d})_e(X,H)_{1-e}$, the support temperature is preferably 50°-350° C., more preferably 100°-250° C.

In the case of forming the second amorphous layer (II), glow discharge method and sputtering method are preferably employed since controlling delicately the atomic composition ratio of the atoms constituting the layer and controlling the layer thickness are easier than other methods. And the discharge power, gas pressure upon layer formation as well as the support temperature are important factors affecting the characteristics of a-SiC(H,X) formed.

For the purpose of producing effectively the a-$Si_aC_{1-a}$ having the desirable characteristics at a good productivity, the discharge power is preferably 50-250 W, more preferably 80-150 W. In the case of a-$(Si_bC_{1-b})_cH_{1-c}$ and a-$(Si_dC_{1-d})_e(H,X)_{1-e}$, it is preferably 10-300 W, more preferably 20-200 W.

The gas pressure in the deposition chamber is preferably 0.01-5 torr, more preferably 0.01-1 torr, and most preferably 0.1-0.5 torr.

Preferable ranges of support temperature and discharge power for producing the second amorphous layer (II) are as mentioned above.

It is not preferable to select those values separately or independently, but it is preferable to select the values mutually dependently with an intimate relation between them so as to produce the second amorphous layer (II) composed of a-SiC(H,X) having desirable characteristics.

The contents of carbon atom and hydrogen atom contained in the second amorphous layer (II) as well as the forming conditions of the second amorphous layer (II) are also important factors to obtain the amorphous layer (II) having desirable characteristics to attain the second object of the present invention.

When the second amorphous layer (II) is formed with a-$SiC_aC_{1-a}$, the amount of carbon atoms contained in the second amorphous layer (II) is preferably $1\times10^{-3}$-90 atomic %, more preferably 1-80 atomic %, most preferably 10-75 atomic %.

In the case of a-$Si_aC_{1-a}$, the value of a is preferably 0.1-0.99999, more preferably 0.2-0.99, most preferably 0.25-0.9.

When the second amorphous layer (II) is formed with a-$(Si_bC_{1-b})_cH_{1-c}$, the amount of carbon atoms contained in the second amorphous layer (II) is preferably $1\times10^{-3}$-90 atomic %, more preferably 1-90 atomic %, most preferably 10-80 atomic %. The content of hydrogen atoms is preferably 1-40 atomic %, more preferably 2-35 atomic %, most preferably 5-30 atomic %. When the hydrogen content is within the abovementioned range, the resulting photoconductive member is very good for practical uses.

In terms of a-$(Si_bC_{1-b})_cH_{1-c}$, the value of b is preferably 0.1-0.99999, more preferably 0.1-0.99, most preferably 0.15-0.9, and the value of c is preferably 0.6-0.99, more preferably 0.65-0.98, most preferably 0.7-0.95.

When the second amorphous layer (II) is formed with a-$(Si_dC_{1-d})_e(X,H)_{1-e}$, the amount of carbon atoms contained in the second amorphous layer (II) is preferably $1\times10^{-3}$-90 atomic %, more preferably 1-90 atomic %, most preferably 10-80 atomic %.

The amount of halogen atoms is preferably 1-20 atomic %, more preferably 1-18 atomic %, most preferably 2-15 atomic %. Where the halogen content is within the above-mentioned range, the resulting photoconductive member is very good for practical uses. The amount of hydrogen atoms which are contained if desired is preferably 19 atomic % or less, more preferably 13 atomic % or less.

In terms of a-$(Si_dC_{1-d})_e(X,H)_{1-e}$, the value of d is preferably 0.1–0.99999, more preferably 0.1–0.99, most preferably 0.15–0.9, and the value of e is preferably 0.8–0.99, more preferably 0.82–0.99, most preferably 0.85–0.98.

The range of layer thickness in the present invention is a very important factor to achieve the object of the present invention.

The thickness of the second amorphous layer (II) may be appropriately selected so as to achieve the purpose of the present invention effectively.

The thickness of the second amorphous layer (II) may be appropriately determined depending upon the carbon atom content, hydrogen atom content and halogen atom content in the second amorphous layer (II) and the relation with the thickness of the first amorphous layer (I). In addition, economical conditions such as productivity, mass production and the like are preferably taken into consideration.

The thickness of the second amorphous layer (II) is preferably 0.003–30$\mu$, more preferably 0.004–20$\mu$, most preferably 0.005–10$\mu$.

Figure 3:
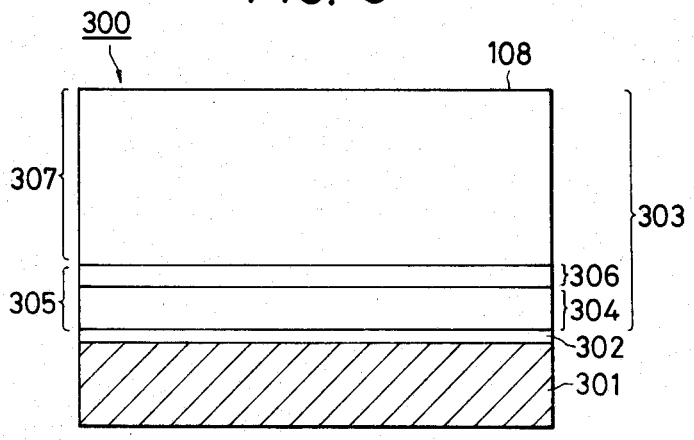
Figure 4:
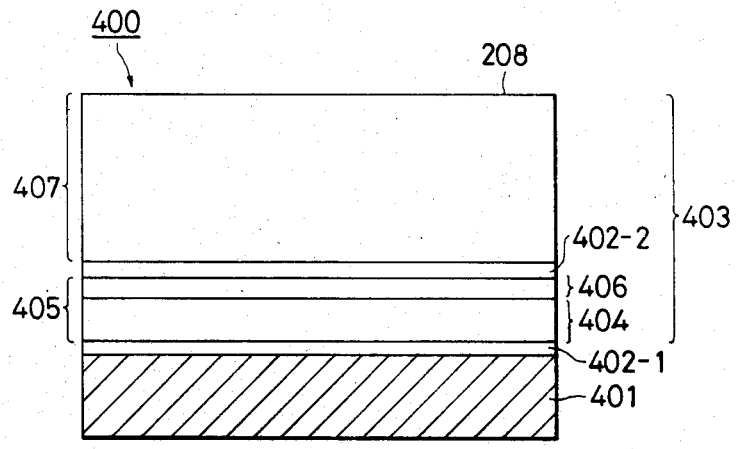

FIG. 3 and FIG. 4 show the third and the fourth embodiments.

Referring to FIG. 3, a photoconductive member 300 has the same layer structure as the photoconductive member 100 in FIG. 1 except that an interface layer 302 is provided in FIG. 3.

Referring to FIG. 4, a photoconductive member 400 has the same layer structure as the photoconductive member 100 in FIG. 1 except that a lower interface layer 402-1 and an upper interface layer 402-2 are provided in FIG. 4.

Referring to FIG. 3, photoconductive member 300 has a support 301, an interface layer 302 overlying the support 301, and an amorphous layer 303 composed of a-Si(H,X) and exhibiting photoconductivity.

Interface layer 302 is provided mainly for the purpose of improving the adhesion between support 301 and amorphous layer 303, and the material of interface layer 302 is selected such that the material has affinity to both support 301 and amorphous layer 303 and has characteristics as shown later.

Amorphous layer 303 is constituted of a first layer region (O) 304 containing oxygen atom as a constituting atom, a second layer region (III, V) 305 containing a Group III atom or a Group V atom, and a surface layer region 307 preferably not containing oxygen atom on the second layer region (III, V) 305.

Referring to FIG. 4, a photoconductive member 400 is different from photoconductive member 300 in FIG. 3 in a point that an amorphous layer 403 has an upper interface layer 402-2 which functions in a manner similar to a lower interface layer 402-1.

Photoconductive member 400 has a support 401, a lower interface layer 402-1 and an amorphous layer 403. The amorphous layer 403 has a first layer region (O) 404 containing oxygen atom, a second layer region (III, V) 405 containing a Group III atom or a Group V atom, and an upper interface layer 402-2 between a layer region 406 and a layer region 407.

Upper interface layer 402-2 serves to enhance the adhesion between layer region (III, V) 405 and layer region 407, make the electric contact at the contact interface between these two uniform, and simultaneously strenghten the layer quality of layer region (III, V) 405 by mounting directly on layer region (III, V) 405.

The interface layer is formed of an amorphous material composed of silicon atom as a matrix, nitrogen atom (N), if desired, hydrogen atom (H) and/or halogen atom (X) (hereinafter referred to as "a-SiN(H,X)").

As the a-SiN(H,X), there may be mentioned an amorphous material comprising silicon (Si) as a matrix and nitrogen atom (N) as a constituting atom (hereinafter referred to as "a-$Si_aN_{1-a}$"), an amorphous material coprising silicon (Si) as a matrix and nitrogen atom (N) and hydrogen atom (H) as constituting atoms (hereinafter referred to as "a-$(Si_bN_{1-b})H_{1-c}$"), and an amorphous material comprising silicon atom as a matrix and nitrogen atom (N), halogen atom (X), and if desired, hydrogen atom (H) as constituting atoms (hereinafter referred to as "a-$(Si_dN_{1-d})_e(H,X)_{1-c}$").

Halogen atom (X) which is contained, if desired, in the interface layer may be fluorine, chlorine, bromine and iodine, preferred with fluorine and chlorine.

For producing the interface layer with the above mentioned amorphous material, there can be employed various layer forming methods such as glow discharging method, sputtering method, ion implantation method, ion plating method, electron beam method and the like.

Among these layer forming methods, a glow discharging method or a sputtering method is preferably employed since controlling the conditions for producing an interface layer having desired characteristics is relatively easy and the introduction of silicon atom together with nitrogen atom, and if desired, hydrogen atom and halogen atom into an interface layer is easy.

Further, the glow discharging method and the sputtering method may be carried out in a single apparatus to produce an interface.

For the production of an interface layer composed of a-SiN(H,X) by a glow discharging method, a starting gas for supplying silicon atom (Si), a starting gas for supplying nitrogen atom (N), if desired, a starting gas for supplying hydrogen atom (H) and/or a starting gas for supplying halogen atom (X) are introduced into a deposition chamber capable of being brought to a reduced pressure and a glow discharge is generated in the deposition chamber to form an interface layer composed of a-SiN(H,X) on the surface of a support placed at a predetermined position in the chamber.

For producing an interface layer by a sputtering method, firstly, for example, sputtering is carried out with a target composed of Si in an inert gas such as Ar, He and the like or an atmosphere of a mixture based on such inert gas and at this time a starting gas for supplying nitrogen atom (N), and if desired, a starting gas for supplying hydrogen atom (H) and/or a starting gas for supplying halogen atom (X) is introduced into the vacuum deposition chamber for effecting sputtering.

Secondly, nitrogen atom (N) can be introduced into the interface layer by employing target(s) such as a target of $Si_3N_4$, an Si target together with an $Si_3N_4$ target, and a target composed of both Si and $Si_3N_4$, at this time, if the starting gas for supplying nitrogen atom (N) is also employed, the content of nitrogen atom (N) introduced into the interface layer can be easily optionally controlled by adjusting the flow rate.

The amount of nitrogen atom (N) introduced into the interface layer may be optionally controlled by controlling the flow rate of the starting gas for supplying nitrogen atom (N) introduced into the deposition chamber, or by controlling the amount of nitrogen atom (N) in a target for introducing nitrogen atom upon preparing said target, or by conducting the above mentioned two controlling procedures.

As the starting gases for producing the interface layer except the starting material for the starting gas supplying nitrogen atom, there may be used various materials optionally selected from the previously mentioned starting materials used for forming amorphous layers exhibiting photoconductivity and amorphous layers containing carbon atom.

As the starting materials for forming starting gases for the introduction of nitrogen atom (N) used upon forming an interface layer, there may be mentioned gaseous or gasifiable nitrogen compounds such as nitrogen, nitrides, azides and the like, for example, nitrogen ($N_2$), ammonia ($NH_3$), hydrazine ($H_2NNH_2$), hydrogen azide ($HN_3$), ammonium azide ($NH_4N_3$) and the like.

Other than above, there may be mentioned nitrogen halide compounds such as nitrogen trifluoride ($F_3N$), nitrogen tetrafluoride ($F_4N_2$) and the like which can advantageously introduce halogen atom (X) as well as nitrogen atom (N).

Since the function of the interface layer is to strengthen the adhesion between the support and the amorphous layer and, moreover, make the electric contact therebetween uniform, it is preferable that the amorphous material, a-SiN(H,X) constituting the interface layer is carefully produced under strictly selected preparation conditions so as to impart the required characteristics to the interface layer.

One of the important conditions for forming the interface layer composed of a-SiN(H,X) is the support temperature upon the layer formation. That is, the support temperature upon forming the interface layer on the support is an important factor affecting the layer structure and the characteristics.

Therefore, it is preferable to strictly control the support temperature. The support temperature is appropriately selected depending on the process for forming interface layer. It is preferably 50°-350° C., more preferably 100° C.-250° C.

Upon forming the interface layer, it is possible to produce continuously the interface layer and then the amorphous layer, and further, if desired, other layers to be formed above the amorphous layer in a single preparation system.

Since the delicate control of the ratio of atoms constituting each layer and the control of the layer thickness are relatively easier than those by other methods, a glow discharge method and a sputtering method are advantageously employed.

When the interface layer is prepared by these methods, the discharge power, gas pressure as well as the abovementioned support temperature are important factors affecting the characteristics of the interface layer formed.

The discharge power condition for forming the interface layer effectively with a good productivity is preferably 1-300 W, more preferably 2-150 W, and the gas pressure in the deposition chamber is preferably $3\times10^{-3}$-5 torr, more preferably $8\times10^{-3}$-0.5 torr.

The content of notrogen atom and the content of hydrogen atom and halogen atom contained, if desired, in the interface layer of the photoconductive member are important factors affecting the characteristics of the interface layer in the same way as the conditions for preparing the interface layer.

The content of nitrogen atom (N), that of hydrogen atom (H) and that of halogen atom (X) may be appropriately determined so as to attain the objects of the present invention effectively taking the above mentioned layer forming conditions into consideration.

When the interface layer is constituted of a-$Si_aN_{1-a}$, the content of nitrogen atom in the interface layer is preferably $1\times10^{-3}$-60 atomic %, more preferably 1-50 atomic %, and in terms of a, a is preferably 0.4-0.99999, more preferably 0.5-0.99.

When the interface layer is constituted of a-$(Si_bN_{1-b})_cH_{1-c}$, the content of nitrogen atom (N) is preferably $1\times10^{-3}$-55 atomic %, more preferably 1-55 atomic %, and the content of hydrogen atom is preferably 2-35 atomic %, more preferably 5-30 atomic %, and in terms of b and c, b is preferably 0.43-0.99999, more preferably 0.43-0.99 and c is preferably 0.65-0.98, more preferably 0.7-0.95.

When the interface layer is constituted of a-$(Si_dN_{1-d})_e(H,X)_{1-e}$, the content of nitrogen atom is preferably $1\times10^{-3}$-60 atomic %, more preferably 1-60 atomic %, and content of halogen atom or the sum of content of halogen atom and content of hydrogen atom is preferably 1-20 atomic %, more preferably 2-15 atomic %, and in this case, the content of hydrogen atom is preferably 19 atomic % or less, more preferably 13 atomic % or less, and in terms of d and e, d is preferably 0.43-0.99999, more preferably 0.43-0.99, and c is preferably 0.8-0.99, more preferably 0.85-0.98.

The thickness of the interface layer may be appropriately determined depending upon the thickness of the amorphous layer mounted on the interface layer and the characteristics of the amorphous layer.

The thickness of the interface layer is preferably 30 Å-2μ, more preferably 40 Å-1.5μ and most preferably 50 Å-1.5μ.

Figure 5:
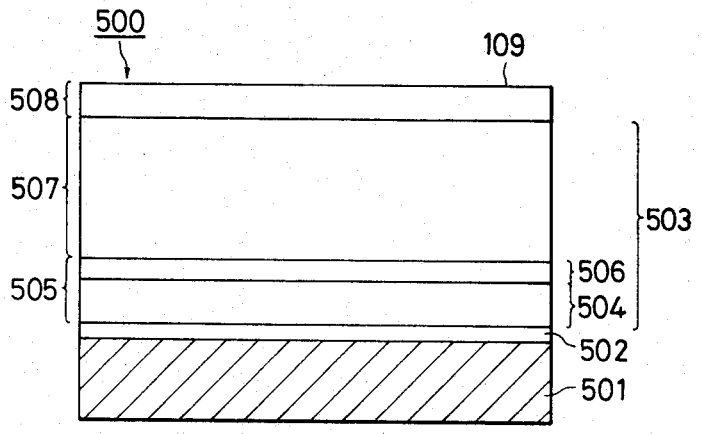

FIG. 5 shows the layer structure of a photoconductive member 500, a fifth embodiment of the present invention.

Photoconductive member 500 has the same layer structure as the photoconductive member 300 in FIG. 3 except that a second amorphous layer 508 similar to a second amorphous layer 207 in FIG. 2 overlies a first amorphous layer 503 exhibiting the same photoconductivity as the amorphous layer 303 in FIG. 3.

That is, photoconductive member 500 in FIG. 5 has a support 501 for a photoconductive member, an interface layer 502, a first amorphous layer (I) 503 exhibiting photoconductivity and a second amorphous layer (II) 508.

The first amorphous layer (I) 503 is constituted of a first layer region (O) 504 containing oxygen atom as a constituting atom, a second layer region (III, V) 505 containing a Group III atom or a Group V atom, and a layer region 507 not containing oxygen atom. A layer region 506 disposed between the first layer region (O) 504 and the layer region 507 does not contain oxygen atom, but a Group III atom or a Group V atom.

Figure 6:
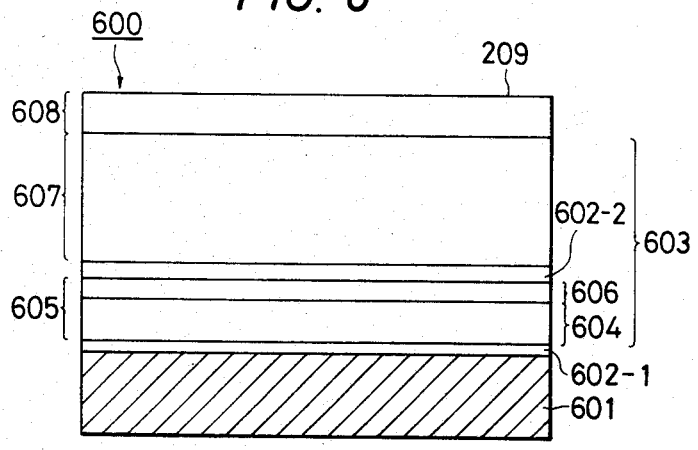

FIG. 6 shows a photoconductive member 600, a sixth embodiment of the present invention.

Photoconductive member 600 has the same layer structure as the photoconductive member 400 in FIG. 4 except that a second amorphous layer 608 similar to the second amorphous layer 207 in FIG. 2 is disposed on a first amorphous layer 603 exhibiting photoconductivity similar to the amorphous layer 403 in FIG. 4.

That is, photoconductive member 600 has a support 601, a lower interface layer 602-1, a first amorphous layer (I) 603 and a second amorphous layer (II) 608 as laminated in the mentioned order. The first amorphous layer (I) 603 has a first layer region (O) 604 containing oxygen atom, a second layer region (III, V) 605 containing a Group III atom or a Group V atom, and an upper interface layer 602-2 between a layer region 606 and a layer region 607.

The lower interface layer and the upper interface layer in the photoconductive member as illustrated in FIG. 4 and FIG. 6 may be produced in the same way as the interface layer in the photoconductive member in FIG. 3, that is, the amorphous material as in FIG. 3 may be used and the same layer formation conditions as in FIG. 3 may be employed to obtain the same characteristics as in FIG. 3.

The photoconductive member having the above mentioned layer structure according to the present invention can solve the above mentioned various problems and exhibits excellent electric, optical, photoconductive characteristics, dielectric strength and use environmental characteristics.

In particular, when the photoconductive member is used as an image forming member for electrophotography, the photoconductive member is free from residual potentials upon image formation, and has stable electric characteristics, high sensitivity, high SN ratio, excellent light fatigue resistance, and excellent repeated use characteristics. And it is possible to produce stably and repeatedly an image of high density, sharp and clear half-tone, high resolution and high quality.

In addition, the amorphous layer formed on the support of the photoconductive member of the present invention is strong and has a high adhesion with the support, and therefore, the photoconductive member can be continuously repeatedly used at a high speed for a long time.

Figure 7:
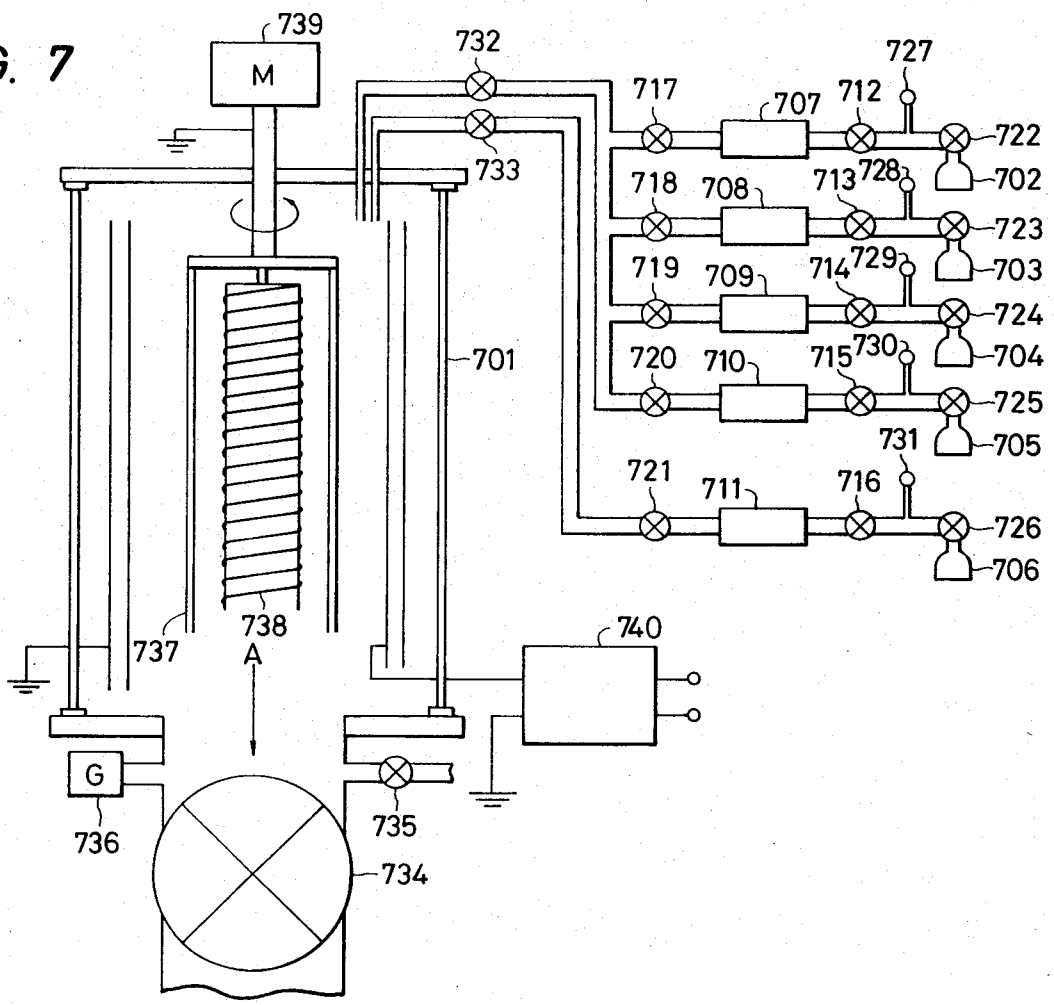
FIG. 7 and FIG. 8 schematically show apparatus which may be used for producing the photoconductive member of the present invention.
Figure 8:
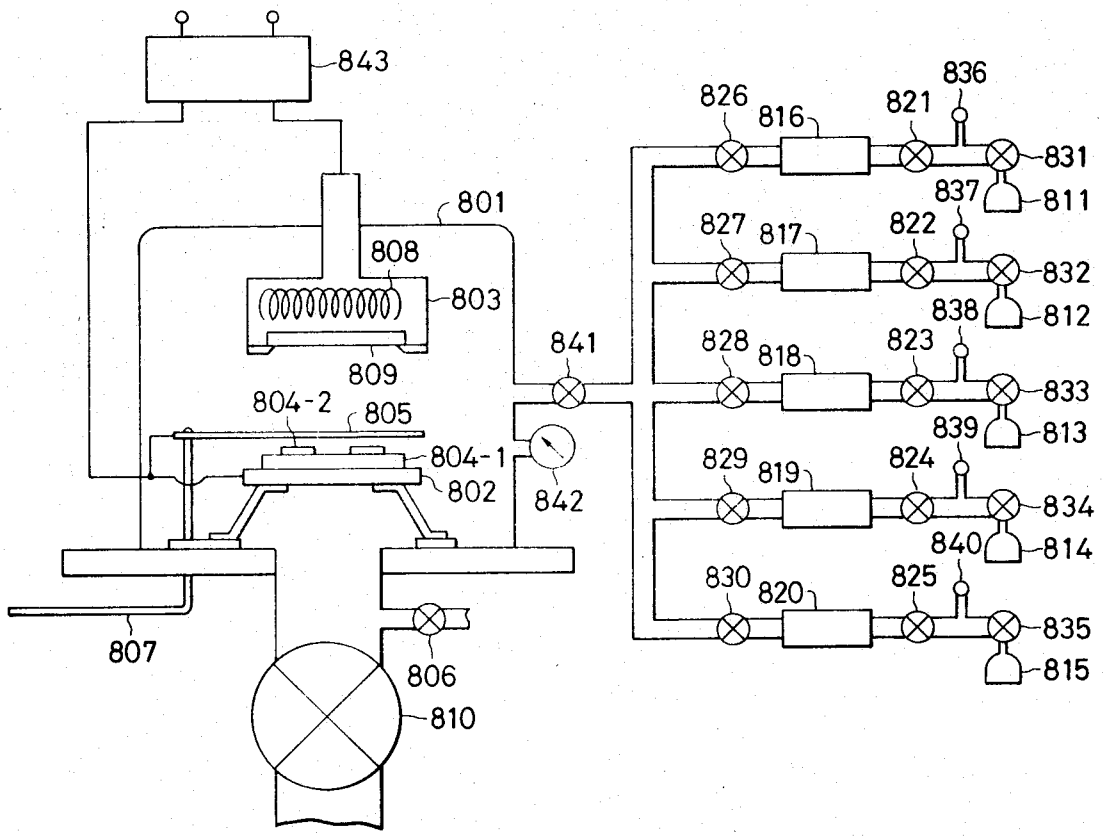

FIG. 7 and FIG. 8 illustrate apparatuses capable of producing the photoconductive member of the present invention.

According to the apparatus of FIG. 7, various layers constituting the photoconductive member of the present invention can be produced by a glow discharging deposition method.

In the gas bombs 702, 703, 704, 705 and 706, there are hermetically contained starting gases for the formation of respective layers of the photoconductive member of the present invention. For example, 702 is a bomb containing $SiH_4$ gas diluted with He (purity: 99.999%, hereinafter abbreviated as $SiH_4$/He), 703 is a bomb containing $B_2H_6$ gas diluted with He (purity: 99.999%, hereinafter abbreviated as $B_2H_6$/He), 704 is a bomb containing $SiF_4$ gas diluted with He (purity: 99.999%, hereinafter abbreviated as $SiF_4$/He), 705 is a bomb containing NO gas (purity: 99.999%), and 706 is a bomb containing $NH_3$ gas diluted with He (purity: 99.999%).

For allowing these gases to flow into the reaction chamber 701, on confirmation of the valves 722–726 of the gas bombs 702–706 and the leak valve 735 to be closed, and the inflow valves 712–716, the outflow valves 717–721 and the auxiliary valve 732 to be opened, the main valve 734 is first opened to evacuate the reaction chamber 701 and the gas pipelines. As the next step, when the reading on the vacuum indicator 736 becomes about $5\times10^{-6}$ Torr, the auxiliary valves 732 and 733, inflow valves 722–726 and outflow valves 717–721 are closed.

Thereafter, the valves of the gas pipelines connected to bombs containing gases to be introduced into reaction chamber 701 are handled accordingly to introduce the desired gases into reaction chamber 701.

In the following there is shown an example of preparing a photoconductive member having the same constitution as that in FIG. 3.

Firstly, an interface layer is prepared on a support cylinder 737 as shown below.

$SiH_4$/He gas and $NH_3$ gas are introduced into mass-flow controllers 707 and 711 from gas bombs 702 and 706 by opening valves 722 and 726 to adjust the pressure of outlet pressure gauge 727 and that of outlet pressure gauge 731 to 1 kg/cm$^2$ and gradually opening inflow valves 712 and 716. Then, outflow valves 717 and 721 and auxiliary valves 732 and 733 are gradually opened and each gas is introduced into reaction chamber 701. At this time, outflow valves 717 and 721 are adjusted to make the flow rate ratio of $SiH_4$/He gas to $NH_3$ gas a predetermined value, and the opening of main valve 734 is adjusted observing the reading of vacuum meter 736 to make the pressure in reaction chamber 701 a desired value. After confirming that the temperature of the support cylinder 737 is set at a temperature of 50°–400° C. by a heater 738, a power source 740 is set to a desired power value to cause a glow discharge in reaction chamber 701 to form an interface layer on support cylinder 737 (support). In order to introduce halogen atoms into the interface layer to be formed, for example, $SiF_4$ gas is used in place of $SiH_4$ gas or $SiF_4$ gas is added to $SiH_4$ gas to form a layer in the above mentioned procedure.

The content of each of nitrogen atoms, hydrogen atoms and halogen atoms in the interface layer is controlled by adjusting the flow rate of starting materials for forming the interface layer having those atoms as constituting atom introduced into reaction chamber 701. For example, content of nitrogen atom and that of halogen atom are controlled by adjusting the flow rate of $NH_3$ gas and that of $SiF_4$ gas.

An example of forming a layer region (III, V) constituting the amorphous layer on the interface layer formed on support cylinder 737 as produced above will be shown below.

$SiH_4$/He gas from gas bomb 702 and $B_2H_6$/He gas from gas bomb 703 are introduced into reaction chamber 701 by opening valves 722 and 723 to adjust the pressures of outlet pressure gauges 727 and 728 to 1 kg/cm$^2$, opening gradually inflow valves 712 and 713 to introduce the respective gases into mass-flow controllers 707 and 708, and then gradually opening outflow valves 717 and 718, respectively and auxiliary valve 732.

At this time, the flow rate ratio of $SiH_4$/He gas to $B_2H_6$/He gas is adjusted to a desired value by controlling outflow valves 717 and 718, and the pressure in reaction chamber 701 is adjusted to a desired value by controlling the opening of main valve 734 while watching the reading of vacuum meter 736. Then, after confirming that the temperature of support cylinder 737 is set to 50°–400° C. by heating 738, the power source is switched on the set to a desired power value so as to cause glow discharge in reaction chamber 701 to form a layer region (III, V) on the interface layer.

A layer region (O) can be produced by using NO gas in place of $B_2H_6$/He gas or in addition to $B_2H_6$/He gas used upon forming the layer region (III, V).

According to the present invention, in the photoconductive member, the layer region (O) and the layer region (III, V) overlap at least partly, and therefore, upon forming the amorphous layer, for example, it is necessary to introduce both $B_2H_6$ gas and NO gas at desired flow rates simultaneously for a certain period of time.

For example, after introducing both $B_2H_6$ and NO gases into reaction chamber 701 for a certain period of time since starting the formation of the amorphous layer, the introduction of one of these gases is stopped. As a result, in any one of the layer region (O) and the layer region (III, V) there is formed the other layer region.

Alternatively, for example, after introducing one of $B_2H_6$ gas and NO gas into reaction chamber 701 for a desired period of time upon forming the amorphous layer, the other is additionally introduced into reaction chamber 701 to effect the layer formation for a desired period of time. Thus, a layer region containing both boron atom and oxygen atom is formed on a layer region containing any one of boron atom and oxygen atom.

In this case, if the introduction of one of $B_2H_6$ gas and NO gas into reaction chamber 701 is stopped and then the other is still introduced into reaction chamber 701, a layer region containing one of boron atom and oxygen atom is formed on a layer region containing both boron atom and oxygen atom.

For producing the layer region 307 in the photoconductive member 300 in FIG. 3, the gas for introducing Group III atom such as $B_2H_6$ gas used upon forming the above mentioned layer region (III, V) is not introduced into reaction chamber 701, but $SiH_4$ gas, $Si_2H_6$ gas, $SiF_4$ gas or a mixture thereof is introduced into reaction chamber 701.

In the case of a photoconductive member 400 in FIG. 4 having an upper interface layer 402-2 in an amorphous layer 403, the same layer formation as for the lower interface layer 402-1 can be effected during the formation of amorphous layer 403 to produce the upper interface layer.

The photoconductive members having a second amorphous layer (II) containing carbon atoms overlying a first amorphous layer (I) as illustrated in FIG. 5 and FIG. 6 are produced in a similar manner to the above by forming a first amorphous layer (I) on the support cylinder 737 and setting gas bombs necessary to form a second amorphous layer (II) to the apparatus of FIG. 7, and carrying out the following procedures. That is, by the valve handling similar to that upon forming the first amorphous layer, for example, $SiH_4$ gas and $C_2H_4$ gas (if desired, diluted with a diluting gas such as He and the like) are introduced into reaction chamber 701 at a desired flow rate ratio to cause a glow discharge.

The photoconductive members having the layer constitution as in FIG. 1 and FIG. 2 can be produced by repeating the above mentioned preparation examples except that the formation of the interface layer is omitted.

All the outflow valves other than those for gases necessary for formation of respective layers are of course closed, and during formation of respective layers, in order to avoid remaining of the gas used in the precedent layer in the reaction chamber 701 and pipelines from the outflow valves 717–721 to the reaction chamber 701, there may be conducted the procedure, comprising once evacuating to a high vacuum the system by closing the outflow valves 717–721 and opening the auxiliary valve 732 and 733 with full opening of the main valve 734, if necessary.

During formation of the layer, the support cylinder 737 may be rotated at a constant speed by means of a motor 739 in order to effect uniform layer formation.

The production apparatus of FIG. 8 is an example of an apparatus in which a glow discharge decomposition method and a sputtering method can be carried out depending upon the desired layer to be formed.

In gas bombs 811–815, there are hermetically contained starting gases for producing respective layer regions of the photoconductive member of the present invention. For example, bomb 811 contains $SiH_4$/He gas, bomb 812 contains $B_2H_6$/He gas, bomb 813 contains $Si_2H_6$ gas (purity: 99.99%) diluted with He (hereinafter referred to as "$Si_2H_6$/He"), bomb 814 contains NO gas (purity: 99.999%), and bomb 815 contains Ar.

For the purpose of introducing halogen atoms into the layer to be formed, for example, the bomb is appropriately changed so as to use $SiF_4$ gas in place of $SiH_4$ gas or $Si_2H_6$ gas.

For allowing these gases to flow into a reaction chamber 801, after confirming that valves 831–835 of gas bombs 811–815 and a leak valve 806 are closed and inflow valves 821–825, outflow valves 826–830, and an auxiliary valve 841 are opened, a main valve 810 is firstly opened to evacuate the reaction chamber 801 and the gas pipelines. When the reading on a vacuum indicator 842 becomes about $5\times10^{-6}$ Torr, auxiliary valve 841 and outflow valves 826–830 are closed.

An embodiment of forming a first layer region (I) on a substrate 809 is as shown below.

A shutter 805 is closed and is connected such that a high voltage power can be applied from a power source 843.

$SiH_4$/He gas from bomb 811, $B_2H_6$/He gas from bomb 812 and NO gas from bomb 814 are permitted to flow into mass-flow controllers 816, 817 and 819 by opening valves 831, 832 and 834 to control outlet pressure gauges 836, 837 and 839 to 1 kg/cm$^2$ and opening gradually inflow valves 821, 822 and 824, respectively. Then, outflow valves 826, 827 and 829 and auxiliary valve 841 are gradually opened to permit the respective gases to flow into reaction chamber 801. Outflow valves 826, 827 and 829 are controlled so that the flow rate ratio of $SiH_4$/He gas: $B_2H_6$/He gas: NO gas may have a desired value, and opening of main valve 810 is also controlled watching the reading of vacuum indicator 842 so that the pressure in reaction chamber 801 may reach a desired value. Then, after confirming that the temperature of substrate 809 is 50°–400° C. by a heater 808, a power source 843 is set at a desired power to cause glow discharge in reaction chamber 801 for a desired period of time to form a layer region containing boron and oxygen on a support 809.

In this case, the thickness of the layer region containing boron atoms or that of the layer containing oxygen atoms can be optionally controlled by intercepting the introduction of $B_2H_6$/He gas or NO gas into reaction chamber 801 by closing the valve of the gas introducing valve corresponding to the gas.

After producing a layer region containing boron and oxygen of a desired thickness as above, outflow valves 827 and 829 are closed and the glow discharge is continued further for a desired period of time to produce a layer containing neither boron nor oxygen of a desired thickness on the layer containing boron and oxygen. Thus, the formation of the first amorphous layer (I) is completed.

For incorporating halogen atoms in the first amorphous layer (I), for example, $SiF_4$/He gas is added to the above-mentioned gases so as to feed $SiF_4$/He gas into the reaction chamber 801.

A second amorphous layer (II) may be formed on the first amorphous layer (I) as shown below.

Shutter 805 is opened, and all gas feeding valves are once closed and reaction chamber 801 is evacuated by fully opening main valve 810. High purity silicon wafer 804-1 and high purity graphite wafer 804-2 are laced as targets on an electrode 802 to which a high voltage power is applied, at a desired area ratio. From bomb 815, Ar gas is introduced into reaction chamber 801, and main valve 810 is controlled so that the inner pressure of the reaction chamber may become 0.05–1 Torr. The high voltage power source is switched on to effect sputtering by using silicon and graphite simultaneously. As a result, the second amorphous layer (II) is formed on the first amorphous layer (I).

The following examples are given for the purpose of illustration and not by way of limitation.

EXAMPLE 1

By using the production apparatus of FIG. 7, layer formation was effected on an aluminum support under the following conditions.

TABLE 1

| Preparation step | Used gas | Flow rate (SCCM) | Flow rate ratio | Layer thickness (μ) |
|---|---|---|---|---|
| 1st step | $SiH_4$/He = 1<br>$B_2H_6$/He = $10^{-2}$<br>NO | $SiH_4$ = 200 | $SiH_4$:$B_2H_6$ = 1:1.6 × $10^{-3}$<br>$SiH_4$:NO = 1:0.03 | 0.3 |
| 2nd step | $SiH_4$/He = 1 | | | 15 |

| | |
|---|---|
| Al support temperature; | 250° C. |
| Discharge frequency; | 13.56 MHz |
| Discharge power; | 0.18 w/cm$^2$ |
| Inner pressure upon reaction; | 0.3 Torr |
| Layer deposition rate; | 11 Å/S |

The resulting image forming member was set in a charging-exposing-developing apparatus, subjected to corona charging at ⊕5 KV for 0.2 sec., and then immediately imagewise exposed. The light source was a tungsten lump and a light image was projected through a transparent test chart at 1.0 lux.sec. Immediately thereafter, the latent image was developed with a negatively charged developer (including toner and carrier) by cascading to produce a good toner image.

The resulting toner image was once cleaned with a rubber blade, and then the above mentioned image forming and cleaning steps were repeated again. Even after repeating the copying 100,000 times or more, there was not observed any degradation of the resulting image.

EXAMPLE 2

Repeating the procedures of Example 1 except that flow rates of $B_2H_6$ gas and NO gas diluted with He gas to 10000 vol. ppm were changed in the first step, there were produced image forming members and they were evaluated in the same manner as in Example 1.

Further, boron and oxygen amounts incorporated in the first step in each sample were measured by the ion microanalysis (IMA method).

The results are shown in Table 2 below.

TABLE 2

| Boron Atom content (atomic ppm) | Oxygen atom content (atomic %) 0.001 | 1.3 | 6.0 | 30 |
|---|---|---|---|---|
| 10 | X (a) | X (a) | X (a) | X (a) |
| 30 | ○ | ○ | Δ | Δ |
| 500 | ○ | ◎ | ○ | ○ |
| 2000 | ○ | ◎ | ◎ | ○ |
| 50000 | Δ | ○ | ○ | ○ |
| 80000 | X (b) | X (b) | Δ | Δ |

(1) In the above table, the oxygen atom content and the boron atom content are the amounts contained in the layer upon forming in the first step.

(2)
◎ : Very good
○ : Good
Δ: Practically sufficiently usable
X(a): Poor image quality
X(b): Layer is liable to exfoliate.

EXAMPLE 3

By using the production apparatus of FIG. 7, layer formation was effected on an aluminum support under the following conditions.

TABLE 3

| Preparation step | Used gas | Flow rate (SCCM) | Flow rate ratio | Layer thickness (μ) |
|---|---|---|---|---|
| 1st step | $SiH_4$/He = 1<br>$B_2H_6$/He = $10^{-2}$<br>NO | $SiH_4$ = 200<br>32<br>3 | $SiH_4$:$B_2H_6$ = 1:2 × $10^{-3}$<br>$SiH_4$:NO = 1:0.015 | Suitably changing |
| 2nd step | $SiH_4$ | 200 | | Suitably changing |

| | |
|---|---|
| Al support temperature; | 250° C. |
| Discharge frequency; | 13.56 MHz |
| Discharge power; | 0.18 w/cm$^2$ |
| Total layer thickness; | 15μ |
| Inner pressure upon reaction; | 0.3 Torr |
| Layer deposition rate; | 11 Å/S |

The resulting image forming members were evaluated as in Example 1. The results are shown in Table 4.

TABLE 4

| Thickness of a layer containing oxygen atom and boron atom (μ) | 0.001 | 0.003 | 0.05 | 0.3 | 1 | 5 | 10 |
|---|---|---|---|---|---|---|---|
| Evaluation | X | Δ | ○ | ◎ | ◎ | ○ | X |

EXAMPLE 4

By using the production apparatus in FIG. 7, layer formation was conducted on an aluminum support under the following conditions.

TABLE 5

| Preparation step | Used gas | Flow rate (SCCM) | Flow rate ratio | Layer thickness (μ) |
|---|---|---|---|---|
| 1st step | $SiH_4$/He = 1 | $SiH_4$ = 200 | $SiH_4$:$B_2H_6$ = 1:1.6 × $10^{-3}$ | 0.3 |

TABLE 5-continued

| | | | |
|---|---|---|---|
| | $B_2H_6$/He = $10^{-2}$<br>NO | $SiH_4$:NO = 1:0.015 | |
| 2nd step | $SiH_4$/He = 1<br>NO | $SiH_4$:NO = 1:0.015 | 0.1 |
| 3rd step | $SiH_4$/He = 1 | | 15 |

| | |
|---|---|
| Al support temperature; | 250° C. |
| Discharge frequency; | 13.56 MHz |
| Discharge power; | 0.18 w/cm$^2$ |
| Inner pressure upon reaction; | 0.3 Torr |
| Layer deposition rate; | 11 Å/S |

The resulting image forming member was evaluated as in Example 1. The result was good.

EXAMPLE 5

By using the apparatus in FIG. 7, layer formation was effected on an aluminum support under the following conditions.

TABLE 6

| Preparation step | Used gas | Flow rate (SCCM) | Flow rate ratio | Layer thickness (μ) |
|---|---|---|---|---|
| 1st step | $SiH_4$/He = 1<br>$B_2H_6$/He = $10^{-2}$<br>NO | $SiH_4$ = 200 | $SiH_4$:$B_2H_6$ = 1:8 × $10^{-4}$<br>$SiH_4$:NO = 1:0.1 | 0.2 |
| 2nd step | $SiH_4$/He = 1<br>$B_2H_6$/He = $10^{-2}$ | | $SiH_4$:$B_2H_6$ = 1:8 × $10^{-4}$ | 0.3 |
| 3rd step | $SiH_4$/He = 1 | | | 15 |

| | |
|---|---|
| Al support temperature; | 250° C. |
| Discharge frequency; | 13.56 MHz |
| Discharge power; | 0.18 w/cm$^2$ |
| Pressure in the reaction chamber; | 0.3 Torr |
| Layer deposition rate; | 11 Å/sec |

The resulting image forming member was evaluated as in Example 1. The result was good.

EXAMPLE 6

An image forming member was prepared under the conditions of Table 7 below. Evaluation was made as in Example 1. The result was good.

TABLE 7

| Preparation step | Used gas | Flow rate (SCCM) | Flow rate ratio | Layer thickness (μ) |
|---|---|---|---|---|
| 1st step | $Si_2H_6$/He = 1<br>$B_2H_6$/He = $10^{-2}$<br>NO | $Si_2H_6$ = 170 | $Si_2H_6$:$B_2H_6$ = 1:4.8 × $10^{-3}$ | 0.3 |
| 2nd step | $Si_2H_6$/He = 1 | | | 15 |

| | |
|---|---|
| Al substrate temperature; | 250° C. |
| Discharge frequency; | 13.56 MHz |
| Discharge power; | 0.54 w/cm$^2$ |
| Pressure in the reaction chamber; | 0.3 Torr |
| Layer deposition rate; | 40 Å/S |

EXAMPLE 7

An image forming member was prepared under the conditions of Table 8 below and evaluation was made as in Example 1. Good result was obtained.

EXAMPLE 8

By using the production apparatus as illustrated in FIG. 8, layer formation was effected under the following conditions.

TABLE 8

| Preparation step | Used gas | Flow rate (SCCM) | Flow rate ratio | Layer thickness (μ) |
|---|---|---|---|---|
| 1st step | $SiH_4$/He = 1<br>$SiF_4$/He = 1<br>$B_2H_6$/He = $10^{-2}$<br>NO | ($SiH_4$ + $SiF_4$) = 150 | $SiH_4$:$SiF_4$ = 8:2<br>($SiH_4$ + $SiF_4$):$B_2H_6$ = 1:1.6 × $10^{-3}$<br>($SiH_4$ + $SiF_4$):NO = 1:0.03 | 0.3 |
| 2nd step | $SiH_4$/He = 1<br>$SiF_4$/He = 1 | | | 15 |

| | |
|---|---|
| Al substrate temperature; | 250° C. |
| Discharge frequency; | 13.56 MHz |
| Discharge power; | 0.18 w/cm$^2$ |
| Pressure in the reaction chamber; | 0.3 Torr |
| Layer deposition rate; | 11 Å/S |

TABLE 9

| | Used gas | Flow rate (SCCM) | | Discharge power (W/cm$^2$) | Layer deposition rate (Å/sec) | Layer thickness (μ) |
|---|---|---|---|---|---|---|
| | | | Flow rate ratio | | | |
| Amorphous layer (I) | $SiH_4$/He = 1<br>$B_2H_6$/He = $10^{-2}$<br>NO | $SiH_4$ = 200 | $B_2H_6$/$SiH_4$ = 1.6 × $10^{-3}$<br>NO/$SiH_4$ = 3 × $10^{-2}$ | 0.18 | 11 | 0.3 |
| | $SiH_4$/He = 1 | $SiH_4$ = 200 | | 0.18 | 11 | 15 |
| | | | Area ratio | | | |
| Amorphous layer (II) | Ar | 200 | Si wafer:Graphite = 1.5:8.5 | 0.3 | 2 | 0.5 |

| | |
|---|---|
| Al substrate temperature: | 250° C. |
| Discharge frequency: | 13.56 MHz |
| Pressure in the reaction chamber: | 0.3 Torr upon forming amorphous layer (I)<br>0.2 Torr upon forming amorphous layer (II) |

The resulting image forming member was set in a charging-exposing-developing apparatus, subjected to corona charging at ⊖5 KV for 0.2 sec. and then immediately imagewise exposed. The light source was a tungsten lamp and a light quantity of 1.0 lux.sec was projected through a transparent test chart. Then immediately the resulting latent image was developed using a positively charged developer (including toner and carrier) by cascading to produce a good toner image.

The resulting toner image was cleaned once with a rubber blade, and then the above mentioned image forming and cleaning steps were repeated. Even when the copying was repeated 150,000 times or more, any degradation image was not observed.

EXAMPLE 9

By using the apparatus in FIG. 8, layer formation was carried out on an Al support under the following conditions.

TABLE 10

| | Used gas | Flow rate (SCCM) | | Discharge power ($W/cm^2$) | Layer deposition rate (Å/sec) | Layer thickness (μ) |
|---|---|---|---|---|---|---|
| | | | Flow rate ratio | | | |
| Amorphous layer (I) | $SiH_4/He = 1$<br>$B_2H_6/He = 10^{-2}$<br>NO | $SiH_4 = 200$ | $B_2H_6/SiH_4 = 1.6 \times 10^{-3}$<br>$NO/SiH_4 = 1.5 \times 10^{-2}$ | 0.18 | 11 | 0.3 |
| | $SiH_4/He = 1$<br>NO | $SiH_4 = 200$ | $NO/SiH_4 = 1.5 \times 10^{-2}$ | 0.18 | 11 | 0.1 |
| | $SiH_4/He = 1$ | $SiH_4 = 200$ | | 0.18 | 11 | 15 |
| | | | Area ratio | | | |
| Amorphous layer (II) | Ar | 200 | Si wafer:Graphite = 0.5:9.5 | 0.3 | 1.5 | 0.3 |

The other conditions were as in Example 8.

The image forming member thus obtained was set in a charging-exposing-developing apparatus, subjected to corona charging at ⊕5 KV for 0.2 sec immediately followed by imagewise exposure. The light source was a tungsten lamp, and irradiation was effected at 1.0 lux.sec through a transparent test chart.

Immediately thereafter, the development was effected with a negatively charged developer (including toner and carrier) by cascading on the surface of the member to produce a good toner image.

The resulting toner image was once cleaned with a rubber blade, and then the above mentioned image forming and cleaning steps were repeated. Even when the copying was repeated 100,000 times or more, any degradation of the image was not observed.

EXAMPLE 10

By using the apparatus in FIG. 8, layer formation was effected on an Al support under the following conditions.

TABLE 11

| | Used gas | Flow rate (SCCM) | | Discharge power ($W/cm^2$) | Layer deposition rate (Å/sec) | Layer thickness (μ) |
|---|---|---|---|---|---|---|
| | | | Flow rate ratio | | | |
| Amorphous layer (I) | $SiH_4/He = 1$<br>$B_2H_6/He = 10^{-2}$<br>NO | $SiH_4 = 200$ | $B_2H_6/SiH_4 = 8 \times 10^{-4}$<br>$NO/SiH_4 = 10^{-1}$ | 0.18 | 11 | 0.2 |
| | $SiH_4/He = 1$<br>$B_2H_6/He = 10^{-2}$ | $SiH_4 = 200$ | $B_2H_6H_6/SiH_4 = 8 \times 10^{-4}$ | 0.18 | 11 | 0.3 |
| | $SiH_4/He = 1$ | $SiH_4 = 200$ | | 0.18 | 11 | 15 |
| | | | Area ratio | | | |
| Amorphous layer (II) | Ar | 200 | Si wafer:Graphite = 6:4 | 0.3 | 3 | 1.0 |

The other conditions were as in Example 8.

The resulting image forming member was set in a charging-exposing-developing apparatus, subjected to corona charging at ⊕5 KV for 0.2 sec, immediately followed by imagewise exposure. The light source was a tungsten lamp. Irradiation was made at 1.0 lux.sec through a transparent test chart.

Immediately thereafter, the development was effected with a negatively charged developer (including toner and carrier) by cascading. A good toner image of a very high density was produced on the surface of the member.

The resulting toner image was once cleaned with a blade, and the above mentioned image formation and cleaning steps were repeated. Even when the copying was repeated 150,000 times or more, any degradation of the image was not observed.

EXAMPLE 11

The procedure of Example 10 was repeated to produce an image forming member except that the area ratio of silicon wafer to graphite upon producing the second amorphous layer (II) was changed so as to change the content ratio of silicon to carbon in the amorphous layer (II).

The resulting image forming member was repeatedly subjected to the image formation, developing and cleaning steps as in Example 8 about 50,000 times, and then the resulting image was evaluated. The results are as shown in Table 12 below.

TABLE 12

| | | | | | | | |
|---|---|---|---|---|---|---|---|
| Si:C target (Area ratio) | 9:1 | 6.5:3.5 | 4:6 | 2:8 | 1:9 | 0.5:9.5 | 0.2:9.8 |
| Si:C (Content ratio) | 9.7:0.3 | 8.8:1.2 | 7.3:2.7 | 4.8:5.2 | 3:7 | 2:8 | 0.8:9.2 |
| Image evaluation | Δ | ○ | ◎ | ◎ | ◎ | ○ | X |

◎: Very good
○: good
Δ: Sufficiently practically usable
X: Defective images are liable to form.

steps as in Example 8. The resulting are as shown below.

TABLE 13

| Thickness of amorphous layer (II) | Result |
|---|---|
| 0.001μ | Defective images were liable to form |
| 0.02μ | When repeated 20,000 times, no defectives image was formed. |
| 0.05μ | Stable when repeated 50,000 times or more. |
| 0.3μ | Stable when repeated 100,000 times. |

EXAMPLE 13

The procedures of Example 8 were repeated to form an image forming member except that the method for preparing the second amorphous layer (I) was changed as shown below.

A good result was obtained when evaluated as in Example 8.

EXAMPLE 14

The procedures of Example 8 were repeated to produce an image forming member except that the method for preparing the first amorphous layer (I) was changed as shown below. When the resulting member was evaluated as in Example 8, a good result was obtained.

TABLE 14

| | Used gas | Flow rate (SCCM) | Flow rate ratio | Discharge power (W/cm$^2$) | Layer deposition rate (Å/sec) | Layer thickness (μ) |
|---|---|---|---|---|---|---|
| Amorphous layer (I) | $Si_2H_6$/He = 1<br>$B_2H_6$/He = $10^{-2}$<br>NO | $Si_2H_6$ = 170 | $B_2H_6$:$Si_2H_6$ = 4.8 × $10^{-3}$<br>NO:$Si_2H_6$ = 9 × $10^{-2}$ | 0.54 | 40 | 0.3 |
| | $Si_2H_6$/He = 1 | $Si_2H_6$ = 170 | | 0.54 | 40 | 15 |

TABLE 15

| | Used gas | Flow rate (SCCM) | Flow rate ratio | Discharge power (W/cm$^2$) | Layer deposition rate (Å/sec) | Layer thickness (μ) |
|---|---|---|---|---|---|---|
| Amorphous layer (I) | $SiH_4$/He = 1<br>$SiF_4$/He = 1<br>$B_2H_6$/He = $10^{-2}$<br>NO | ($SiH_4$ + $SiF_4$) = 150 | $SiH_4$/$SiF_4$ = 8/2<br>$B_2H_6$/($SiH_4$ + $SiF_4$) = 1.6 × $10^{-3}$<br>NO/($SiH_4$ + $SiF_4$) = 0.03 | 0.18 | 11 | 0.3 |
| | $SiH_4$/He = 1<br>$SiF_4$/He = 1 | ($SiH_4$ + $SiF_4$) = 150 | | 0.18 | 11 | 15 |

EXAMPLE 12

The procedures of Example 8 were repeated to produce an image forming member except that the layer thickness of the second amorphous layer (II) was changed. The resulting member was repeatedly subjected to the image forming, developing and cleaning

EXAMPLE 15

By using the production apparatus in FIG. 7, layer formation was effected on a drum-like aluminum support under the following conditions.

TABLE 16

| | Used gas | Flow rate (SCCM) | Flow rate ratio | Discharge power (W/cm$^2$) | Layer deposition rate (Å/sec) | Layer thickness (μ) |
|---|---|---|---|---|---|---|
| Amorphous layer (I) | $SiH_4$/He = 1<br>$B_2H_6$/He = $10^{-2}$<br>NO | $SiH_4$ = 200 | $B_2H_6$/$SiH_4$ = 1.6 × $10^{-3}$<br>NO/$SiH_4$ = 3 × $10^{-2}$ | 0.18 | 11 | 0.3 |
| | $SiH_4$/He = 1 | $SiH_4$ = 200 | | 0.18 | 11 | 15 |
| Amorphous layer (II) | $SiH_4$/He = 0.5<br>$C_2H_4$ | $SiH_4$ = 100 | $SiH_4$:$C_2H_4$ = 3:7 | 0.18 | 6 | 0.5 |

Al support temperature: 250° C.

TABLE 16-continued

| | |
|---|---|
| Discharge frequency: | 13.56 MHz |
| Pressure in the reaction chamber: | 0.3 torr [upon forming amorphous layer (I)] 0.5 torr [upon forming amorphous layer (II)] |

The resulting photosensitive drum (an image forming member for electrophotography) was set in a copying apparatus, subjected to corona charging at ⊖5 KV for 0.2 sec followed by imagewise exposure. The light source was a tungsten lamp. The light quantity was 1.0 lux.sec. The resulting latent image was developed with a positively charged developer (including toner and carrier), and transferred to a plain paper. The resulting image thus transferred was very good. The toner particles remaining on the photosensitive drum without transferred were cleaned with a rubber blade, and then the next copying step was carried out. Even when the copying was repeated 150,000 times or more, any degradation of image was not observed.

EXAMPLE 16

By using the apparatus in FIG. 7, layer formation was effected on a cylinder-like support under the following conditions.

TABLE 17

| | Used gas | Flow rate (SCCM) | Flow rate ratio | Discharge power (W/cm$^2$) | Layer deposition rate (Å/sec) | Layer thickness (μ) |
|---|---|---|---|---|---|---|
| Amorphous layer (I) | $SiH_4$/He = 1<br>$B_2H_6$/He = $10^{-2}$<br>NO | $SiH_4$ = 200 | $B_2H_6/SiH_4 = 1.6 \times 10^{-3}$<br>$NO/SiH_4 = 1.5 \times 10^{-2}$ | 0.18 | 11 | 0.3 |
| | $SiH_4$/He = 1<br>NO | $SiH_4$ = 200 | $NO/SiH_4 = 1.5 \times 10^{-2}$ | 0.18 | 11 | 0.1 |
| | $SiH_4$/He = 1 | $SiH_4$ = 200 | | 0.18 | 11 | 15 |
| Amorphous layer (II) | $SiH_4$/He = 1<br>$C_2H_4$ | $SiH_4$ = 15 | $SiH_4:C_2H_4$ = 0.4:9.6 | 0.18 | 1 | 0.3 |

The other conditions are the same as those in Example 15.

The resulting photosensitive drum was set in a copying apparatus, subjected to corona charging at ⊕5 KV for 0.2 sec, followed by imagewise exposure. The light source was a tungsten lamp and the light quantity was 1.0 lux.sec.

The resulting latent image was developed with a negatively charged developer (including toner and carrier) and transferred to a plain paper to obtain a very good image. The toner remaining on the photosensitive drum without transferred was cleaned with a rubber blade, and then the next copying was carried out. Even when the copying was repeated 100,000 times or more, any degradation of image was not observed.

EXAMPLE 17

By using the apparatus in FIG. 7, layer formation was effected on a cylinder-like Al support.

TABLE 18

| | Used gas | Flow rate (SCCM) | Flow rate ratio | Discharge power (W/cm$^2$) | Layer deposition rate (Å/sec) | Layer thickness (μ) |
|---|---|---|---|---|---|---|
| Amorphous layer (I) | $SiH_4$/He = 1<br>$B_2H_6$/He = $10^{-2}$<br>NO | 200 | $B_2H_6/SiH_4 = 8 \times 10^{-4}$<br>$NO/SiH_4 = 10^{-1}$ | 0.18 | 11 | 0.2 |
| | $SiH_4$/He = 1<br>$B_2H_6$/He = $10^{-2}$ | 200 | $B_2H_6/SiH_4 = 8 \times 10^{-4}$ | 0.18 | 11 | 0.3 |
| | $SiH_4$/He = 1 | 200 | | 0.18 | 11 | 15 |
| Amorphous layer (II) | $SiH_4$/He = 0.5<br>$C_2H_4$ | $SiH_4$ = 100 | $SiH_4:C_2H_4$ = 5:5 | 0.18 | 6 | 1.5 |

The other conditions were the same as those in Example 15. The resulting photosensitive drum was set in a copying apparatus and subjected to a corona discharge at ⊕5 KV for 0.2 sec, followed by imagewise exposure at 1.0 lux.sec by a tungsten lamp. The resulting latent image was developed with a negatively charged developer (including toner and carrier), and the image thus developed was transferred to a plain paper to form a good transferred image of a very high density.

The toner remaining on the photosensitive drum without transferred was cleaned with a rubber blade, and then the next copying was carried out. Even when the copying was repeated 150,000 times or more. Any degradation of image was not observed.

EXAMPLE 18

Upon forming amorphous layer (II), the layer formation was effected by following the procedures of Example 15 except that the content ratio of silicon atom to carbon atom in amorphous layer (II) was varied. Copying by using the resulting photosensitive drum was repeated about 50,000 times in accordance with the method of Example 15. The results are as shown below.

TABLE 19

| | | | | | | | | |
|---|---|---|---|---|---|---|---|---|
| $SiH_4:C_2H_4$ Flow rate ratio | 9:1 | 6:4 | 4:6 | 2:8 | 1:9 | 0.5:9.5 | 0.35:9.65 | 0.2:9.8 |
| Si:C Content ratio | 9:1 | 7:3 | 5.5:4.5 | 4:6 | 3:7 | 2:8 | 1.2:8.8 | 0.8:9.2 |
| Evaluation of image quality | ○ | ⊙ | ⊙ | ⊙ | ⊙ | ⊙ | ⊙ | Δ |

⊙: Very good
○: Good
Δ: Some defective images are formed.

EXAMPLE 20

Layer formation was carried out by repeating the procedures of Example 15 except that the procedure for forming amorphous layer (I) was changed as shown below, and a good result was obtained.

TABLE 21

| | Used gas | Flow rate (SCCM) | Flow rate ratio | Discharge power ($W/cm^2$) | Layer deposition rate (Å/sec) | Layer thickness (μ) |
|---|---|---|---|---|---|---|
| Amorphous layer (I) | $Si_2H_6/He = 1$<br>$B_2H_6/He = 10^{-2}$<br>NO | $Si_2H_6 = 170$ | $B_2H_6/Si_2H_6 = 4.8 \times 10^{-3}$<br>$NO/Si_2H_6 = 9 \times 10^{-2}$ | 0.54 | 40 | 0.3 |
| | $Si_2H_6/He = 1$ | $Si_2H_6 = 170$ | | 0.54 | 40 | 15 |

TABLE 22

| | Used gas | Flow rate (SCCM) | Flow rate ratio | Discharge power ($W/cm^2$) | Layer deposition rate (Å/sec) | Layer thickness (μ) |
|---|---|---|---|---|---|---|
| Amorphous layer (I) | $SiH_4/He = 1$<br>$SiF_4/He = 1$<br>$B_2H_6/He = 10^{-2}$<br>NO | $(SiH_4 + SiF_4) = 150$ | $SiH_4/SiF_4 = 8/2$<br>$B_2H_6/(SiH_4 + SiF_4) = 1.6 \times 10^{-13}$<br>$NO/(SiH_4 + SiF_4) = 0.03$ | 0.18 | 11 | 0.3 |
| | $SiH_4/He = 1$<br>$SiF_4/He = 1$ | $(SiH_4 + SiF_4) = 150$ | | 0.18 | 11 | 15 |

EXAMPLE 19

By repeating the procedure of Example 15 except that the layer thickness of amorphous layer (II) was varied as shown in Table 20 below.

TABLE 20

| Layer thickness of amorphous layer (II) | Result |
|---|---|
| 0.001μ | Defective images are liable to be formed. |
| 0.02μ | Upon repeating 20,000 times, no defective image is formed. |
| 0.05μ | Upon repeating 50,000 times, no defective image is formed. |
| 0.3μ | Stable when repeated 100,000 times or more. |

EXAMPLE 21

Layer formation was effected by repeating the procedures of Example 15 except that the procedure for forming amorphous layer (I) was varied as shown below.

EXAMPLE 22

By using the production apparatus in FIG. 7, layer formation was effected on a drum-like aluminum support under the following conditions.

The resulting image forming member was set in a charging-exposing-developing apparatus and subjected to a corona charging at ⊖5 KV for 0.2 sec, immediately followed by imagewise exposure at 1.0 lux.sec through

TABLE 23

| | Used gas | Flow rate (SCCM) | Flow rate ratio | Discharge power ($W/cm^2$) | Layer deposition rate (Å/sec) | Layer thickness (μ) |
|---|---|---|---|---|---|---|
| Amorphous layer (I) | $SiH_4/He = 1$<br>$B_2H_6/He = 10^{-2}$<br>NO | $SiH_4$ 200 | $B_2H_6/SiH_4 = 1.6 \times 10^{-3}$<br>$NO/SiH_4 = 3 \times 10^{-2}$ | 0.18 | 11 | 0.3 |
| | $SiH_4/He = 0.5$ | $SiH_4$ 200 | | 0.18 | 11 | 15 |
| Amorphous layer (II) | $SiH_4/He = 0.5$<br>$SiF_4/He = 0.5$<br>$C_2H_4$ | $SiH_4 + SiF_4 = 150$ | $SiH_4:SiF_4:C_2H_4 = 1.5:1.5:7$ | 0.18 | 5 | 0.5 |

| | |
|---|---|
| Al support temperature: | 250° C. |
| Discharge frequency: | 13.56 MHz |
| Pressure in the reaction chamber: | 0.3 Torr upon forming amorphous layer (I)<br>0.5 Torr upon forming amorphous layer (II) |

a transparent test chart by using a tungsten lamp as a light source.

Immediately thereafter, a ⊕ charged developer (including toner and carrier) was used to produce a toner image by cascading. A good toner image was obtained on the member.

The resulting toner image was cleaned with a rubber blade. Then the above image forming and cleaning steps were repeated. Even when the steps were repeated 150,000 times or more, any degradation of image was not observed.

EXAMPLE 23

By using the production apparatus in FIG. 7, layer formation was effected on the drum-like Al substrate under the following conditions.

TABLE 24

| | Used gas | Flow rate (SCCM) | Flow rate ratio | Discharge power ($W/cm^2$) | Layer deposition rate (Å/sec) | Layer thickness (μ) |
|---|---|---|---|---|---|---|
| Amorphous layer (I) | $SiH_4/He = 1$<br>$B_2H_6/He = 10^{-2}$<br>NO | $SiH_4$ 200 | $B_2H_6/SiH_4 = 1.6 \times 10^{-3}$<br>$NO/SiH_4 = 1.5 \times 10^{-2}$ | 0.18 | 11 | 0.3 |
| | $SiH_4/He = 1$<br>NO | $SiH_4$ 200 | $NO/SiH_4 = 1.5 \times 10^{-2}$ | 0.18 | 11 | 0.1 |
| | $SiH_4/He = 1$ | $SiH_4$ 200 | | 0.18 | 11 | 15 |
| Amorphous layer (II) | $SiH_4/He = 0.5$<br>$SiF_4/He = 0.5$<br>$C_2H_4$ | $SiH_4 + SiF_4 = 15$ | $SiH_4:SiF_4:C_2H_4 = 0.3:0.1:9.6$ | 0.18 | 1.5 | 0.3 |

The other conditions were the same as in Example 15.

The resulting image forming member was set in a charging-exposing-developing apparatus and subjected to a corona charging at ⊕5 KV for 0.2 sec, immediately followed by imagewise exposure at 1.0 lux.sec through a transparent test chart by using a tungsten lamp as a light source.

Immediately thereafter, development was effected with a ⊖ charged developer (including toner and carrier) by cascading to produce a good toner image on the surface of the member.

The resulting toner image was once cleaned with a rubber blade and then the above mentioned image formation and cleaning steps were repeated.

Even when the steps were repeated 100,000 times or more, any degradation of image was not observed.

EXAMPLE 24

By using the apparatus in FIG. 7, layer formation was effected on the drum-like Al support under the following conditions.

TABLE 25

| | Used gas | Flow rate (SCCM) | Flow rate ratio | Discharge power ($W/cm^2$) | Layer deposition rate (Å/sec) | Layer thickness (μ) |
|---|---|---|---|---|---|---|
| Amorphous layer (I) | $SiH_4/He = 1$<br>$B_2H_6/He = 10^{-2}$<br>NO | 200 | $B_2H_6/SiH_4 = 8 \times 10^{-4}$<br>$NO/SiH_4 = 10^{-1}$ | 0.18 | 11 | 0.2 |
| | $SiH_4/He = 1$<br>$B_2H_6/He = 10^{-2}$ | 200 | $B_2H_6/SiH_4 = 8 \times 10^{-4}$ | 0.18 | 11 | 0.3 |
| | $SiH_4/He = 1$ | 200 | | 0.18 | 11 | 15 |
| Amorphous layer (II) | $SiH_4/He = 0.5$<br>$SiF_4/He = 0.5$<br>$C_2H_4$ | $SiH_4 + SiF_4 = 150$ | $SiH_4:SiF_4:C_2H_4 = 3:3:4$ | 0.18 | 5 | 1.5 |

The other conditions were the same as in Example 22. The resulting image forming member was set in a charging-exposing-developing apparatus and subjected to a corona charging at ⊕5 KV for 0.2 sec, immediately followed by imagewise exposure at 1.0 lux.sec through a transparent test chart by using a tungsten lamp a light source.

Immediately thereafter, development was effected with a ⊖ charged developer (including toner and carrier) by cascading to produce a good toner image of a very high density was produced on the surface of the member.

The resulting toner image was once cleaned with a rubber blade, and then the above mentioned image formation and cleaning steps were repeated. Even when the steps were repeated 150,000 times or more, any degradation of image was not observed.

EXAMPLE 25

By repeating the procedures of Example 22 except that the second amorphous layer (II) was produced by changing the flow rate of $SiH_4$, $SiF_4$ and $C_2H_4$ gases resulting in change in the content ratio of silicon to carbon in the second amorphous layer (II), there was produced an image forming member. By using the resulting image forming member, the image forming, developing and cleaning steps as in Example 22 were repeated above 50,000 times and the image quality was evaluated. The results are shown in Table 26 below.

TABLE 26

| $SiH_4:SiF_4:C_2H_4$ | 5:4:1 | 3:3.5:3.5 | 2:2:6 | 1:1:8 | 0.6:0.4:9 | 0.2:0.3:9.5 | 0.2:0.15:9.65 | 0.1:0.1:9.8 |
|---|---|---|---|---|---|---|---|---|
| Si:C (Content ratio) | 9:1 | 7:3 | 5.5:4.5 | 4:6 | 3:7 | 2:8 | 1.2:8.8 | 0.8:9.2 |
| | ○ | ◎ | ◎ | ◎ | ◎ | ◎ | ○ | Δ |

◎: Very good
○: Good
Δ: Defective images are somewhat formed.

TABLE 29

| | Used gas | Flow rate (SCCM) | Flow rate ratio | Discharge power (W/cm$^2$) | Layer deposition rate (Å/sec) | Layer thickness (μ) |
|---|---|---|---|---|---|---|
| Amorphous layer (I) | $SiH_4$/He = 1<br>$SiF_4$/He = 1<br>$B_2H_6$/He = $10^{-2}$<br>NO | $SiH_4 + SiF_4$ = 150 | $SiH_4/SiF_4$ = 8/2<br>$B_2H_6/(SiH_4 + SiF_4) = 1.6 \times 10^{-3}$<br>$NO/(SiH_4 + SiF_4)$ = 0.03 | 0.18 | 11 | 0.3 |
| | $SiH_4$/He = 1<br>$SiF_4$/He = 1 | $SiH_4 + SiF_4$ = 150 | | 0.18 | 11 | 15 |

EXAMPLE 26

By repeating the procedures of Example 22 except that the layer thickness of the second amorphous layer (II) was varied, there was produced an image forming member, and the image formation, developing and cleaning steps as in Example 22 were repeated to obtain the following results.

TABLE 27

| Thickness of amorphous layer (II) (μ) | Result |
|---|---|
| 0.001 | Defective images are liable to be formed. |
| 0.02 | When repeated 20,000 times, no defective image is formed. |
| 0.05 | Stable upon repeating 50,000 times or more. |
| 0.3 | Stable upon repeating 100,000 times or more. |

EXAMPLE 27

By repeating the procedures of Example 22 except that the first amorphous layer (I) was formed under the condition in Table 28, an image forming member was produced and evaluated as in Example 22. The result was good.

EXAMPLE 28

By repeating the procedures of Example 22 except that the first amorphous layer (I) was formed under the conditions as shown below, and evaluated as in Example 22. The result was good.

TABLE 28

| | Used gas | Flow rate (SCCM) | Flow rate ratio | Discharge power (W/cm$^2$) | Layer deposition rate (Å/sec) | Layer thickness (μ) |
|---|---|---|---|---|---|---|
| Amorphous layer (I) | $Si_2H_6$/He = 1<br>$B_2H_6$/He = $10^{-2}$<br>NO | $Si_2H_6$ = 170 | $B_2H_6:Si_2H_6 = 4.8 \times 10^{-3}$<br>$NO:Si_2H_6 = 9 \times 10^{-2}$ | 0.54 | 40 | 0.3 |
| | $Si_2H_6$/He = 1 | $Si_2H_6$ = 170 | | 0.54 | 40 | 15 |

EXAMPLE 29

By repeating the procedures in Example 24 except that the second amorphous layer (II) was produced by sputtering under the following conditions, an image forming member was produced and evaluated as in Example 24. A good result was obtained.

TABLE 30

| | Used gas | Flow rate (SCCM) | Target area ratio (Si:C) | Discharge power (W/cm$^2$) | Layer deposition rate (Å/sec) | Layer thickness (μ) |
|---|---|---|---|---|---|---|
| Amorphous layer (II) | Ar<br>$SiF_4$/He = 0.5 | Ar 200<br>$SiF_4$ 100 | 2.5:7.5 | 0.30 | 3 | 1 |

EXAMPLE 30

By using the apparatus in FIG. 7, layer formation was conducted on the cylinder-like aluminum support under the following conditions.

TABLE 31

| Layer preparation step | Used gas | Flow rate (SCCM) | Flow rate ratio | Layer thickness (μ) |
|---|---|---|---|---|
| 1st step | $SiH_4$/He = 1<br>$NH_3$ | $SiH_4$ = 10 | $SiH_4:NH_3$ = 1:30 | 0.05 |
| 2nd step | $SiH_4$/He = 1<br>$B_2H_6$/He = $10^{-2}$<br>NO | $SiH_4$ = 200 | $SiH_4:B_2H_6 = 1:1.6 \times 10^{-3}$<br>$SiH_4$:NO = 1:0.03 | 0.3 |
| 3rd step | $SiH_4$/He = 1 | | | 15 |
| | Al support temperature: | | 250° C. | |
| | Discharge frequency: | | 13.56 MHz | |
| | Discharge power: | | 0.18 W/cm$^2$ | |
| | Pressure in the reaction chamber: | | 0.3 Torr | |

The resulting image forming member was set in a charging-exposing-developing apparatus and subjected to a corona charging at ⊕5 KV for 0.2 sec, immediately followed by imagewise exposure at 1.0 lux.sec through a transparent test chart by using a tungsten lamp as a light source.

Immediately thereafter, development was effected with a ⊖ charge developer (including toner and carrier) by cascading to produce a good toner image on the surface of the member.

The resulting toner was once cleaned with a rubber blade, and the above mentioned image forming and cleaning steps were repeated again. Even when the steps were repeated 100,000 times or more, any degradation of image was not observed.

EXAMPLE 31

By repeating the procedures of Example 30 except that, in the second step of preparation of the image forming member, the flow rate of each of the $B_2H_6$ gas diluted to 10000 Vppm with He gas and the NO gas was changed, there was produced an image forming member and the evaluation was effected as in Example 30.

Further the amounts of boron atom and oxygen atom incorporated in the second step was determined by an ion microanalysis (IMA method).

The result is shown below in Table 32.

TABLE 32

| Content of boron atom (atomic ppm) | Content of oxygen atom (atomic %) 0.001 | 1.3 | 6.0 | 30 |
|---|---|---|---|---|
| 10 | X (a) | X (a) | X (a) | X (a) |
| 30 | ○ | ○ | Δ | Δ |
| 500 | ○ | ⊙ | ⊙ | ○ |
| 2000 | ○ | ⊙ | ⊙ | ○ |
| 50000 | Δ | Δ | Δ | ○ |
| 80000 | X (b) | X (b) | X (b) | X (b) |

(1)The contents of oxygen atom and boron atom are those contained in the second step of the preparation.
(2)
⊙Very good
○ Good
Δ Sufficently practically usable
X (a) Poor image quality
X (b) Layer is liable to exfoliate.

EXAMPLE 32

By repeating the procedures in Example 30 except that the layer thickness of the layer region produced in the second step is changed, an image forming member was produced and evaluated as in Example 30. The result is shown in Table 33.

TABLE 33

| Layer thickness of the layer containing oxygen and boron (μ) | 0.001 | 0.003 | 0.05 | 0.3 | 1 | 5 | 10 |
|---|---|---|---|---|---|---|---|
| Evaluation | X | ○ | ○ | ⊙ | ⊙ | ○ | X |

⊙Very good
○ Good
X Practically somewhat poor

EXAMPLE 33

By repeating the procedures in Example 30 except that the conditions for production at the first step were changed as shown below, an image forming member was produced, and evaluated as in Example 30. The film strength and image quality were good.

TABLE 34

| Sample No. | Conditions: $SiH_4$:$NH_3$ (Flow rate ratio) | Layer thickness (Å) |
|---|---|---|
| 331 | 7:3 | 1000 |
| 332 | 1:1 | 500 |
| 333 | 1:3 | 300 |
| 334 | 1:50 | 200 |

EXAMPLE 34

By using the production apparatus in FIG. 7, layer formation was effected on the cylindrical Al support under the following conditions.

TABLE 35

| Layer production step | Used gas | Flow rate (SCCM) | Flow rate ratio | Layer thickness (μ) |
|---|---|---|---|---|
| 1st | $SiH_4$/He = 1<br>$NH_3$ | $SiH_4$ = 10 | $SiH_4$:$NH_3$ = 1:30 | 0.05 |
| 2nd step | $SiH_4$/He = 1<br>$B_2H_6$/He = $10^{-2}$<br>NO | $SiH_4$ = 200 | $SiH_4$:$B_2H_6$ = 1:1.6 × $10^{-3}$<br>$SiH_4$:NO = 1:0.03 | 0.3 |
| 3rd step | $SiH_4$/He = 1<br>$NH_3$ | $SiH_4$ = 10 | $SiH_4$ $NH_3$ = 1:30 | 0.05 |
| 4th step | $SiH_4$/He = 1 | $SiH_4$ = 200 | | 15 |

The resulting image forming member was evaluated as in Example 30. The film strength and image quality were very good.

EXAMPLE 35

By using the apparatus in FIG. 7, layer formation was effected on the aluminum cylindrical support under the following conditions.

TABLE 36

| Layer preparation step | Used gas | Flow rate (SCCM) | Flow rate ratio | Layer thickness (μ) |
|---|---|---|---|---|
| 1st step | $SiH_4$/He = 1<br>$SiF_4$/He = 1<br>$NH_3$ | $SiH_4$ = 8 | $SiH_4$:$SiF_4$ = 8:2<br>($SiH_4$ $SiF_4$):$NH_3$ = 1:30 | 0.05 |
| 2nd step | $SiH_4$/He = 1<br>$SiF_4$/He = 1<br>$B_2H_6$/He = $10^{-2}$<br>NO | $SiH_4$ = 120 | $SiH_4$:$SiF_4$ = 8:2<br>($SiH_4$ + $SiF_4$):$B_2H_6$ = 1:1.6 × $10^{-3}$<br>($SiH_4$ + $SiF_4$):NO = 1:0.03 | 0.3 |
| 3rd step | $SiH_4$/He = 1<br>$SiF_4$/He = 1 | | $SiH_4$:$SiF_4$ = 8:2 | 15 |

The resulting image forming member was evaluated as in Example 30. The result was good.

EXAMPLE 36

By using the apparatus in FIG. 7, layer formation was effected on an Al support under the conditions of Example 30 except the following conditions.

TABLE 37

| Constituting layer | Used gas | Flow rate (SCCM) | Flow rate ratio | Discharge power (W/cm²) | Layer deposition rate (Å/sec) | Layer thickness (μ) |
|---|---|---|---|---|---|---|
| Interface layer | $SiH_4/He = 1$<br>$NH_3$ | $SiH_4 = 10$ | $NH_3/SiH_4 = 30$ | 0.18 | 5 | 0.05 |
| Amorphous layer (I) | $SiH_4/He = 1$<br>$B_2H_6/He = 10^{-2}$<br>NO | $SiH_4 = 200$ | $B_2H_6/SiH_4 = 1.6 \times 10^{-3}$<br>$NO/SiH_4 = 1.5 \times 10^{-2}$ | 0.18 | 11 | 0.3 |
| | $SiH_4/He = 1$<br>NO | $SiH_4 = 200$ | $NO/SiH_4 = 1.5 \times 10^{-2}$ | 0.18 | 11 | 0.1 |
| | $SiH_4/He = 1$ | $SiH_4 = 200$ | | 0.18 | 11 | 15 |

The resulting electrophotographic image forming member was evaluated as in Example 30. The result was good.

EXAMPLE 37

By using the apparatus in FIG. 7, layer formation on an aluminum support was effected under the following conditions

TABLE 38

| Constituting layer | Used gas | Flow rate (SCCM) | Flow rate ratio | Discharge power (W/cm²) | Layer deposition rate (Å/sec) | Layer thickness (μ) |
|---|---|---|---|---|---|---|
| Interface layer | $SiH_4/He = 1$<br>$NH_3$ | $SiH_4 = 10$ | $NH_3/SiH_4 = 3$ | 0.18 | 5 | 0.05 |
| Amorphous layer (I) | $SiH_4/He = 1$<br>$B_2H_6/He = 10^{-2}$<br>NO | $SiH_4 = 200$ | $B_2H_6/SiH_4 = 8 \times 10^{-4}$<br>$NO/SiH_4 = 10^{-1}$ | 0.18 | 11 | 0.2 |
| | $SiH_4/He = 1$<br>$B_2H_6/He = 10^{-2}$ | $SiH_4 = 200$ | $B_2H_6/SiH_4 = 8 \times 10^{-4}$ | 0.18 | 11 | 0.3 |
| | $SiH_4/He = 1$ | $SiH_4 = 200$ | | 0.18 | 11 | 15 |

The other conditions were the same as in Example 30. The resulting image forming member was evaluated as in Example 30. The image was of high quality, and the durability was excellent.

EXAMPLE 38

By using the production apparatus in FIG. 8, layer formation was effected on an Al support under the following conditions.

TABLE 39

| Constituting layer | Used gas | Flow rate (SCCM) | Flow rate ratio | Discharge power (W/cm²) | Layer deposition rate (Å/sec) | Layer thickness (μ) |
|---|---|---|---|---|---|---|
| Interface layer | $SiH_4/He = 1$<br>$NH_3$ | $SiH_4 = 10$ | $SiH_4:NH_3 = 1:30$ | 0.18 | 5 | 0.05 |
| Amorphous layer (I) | $SiH_4/He = 1$<br>$B_2H_6/He = 10^{-2}$<br>NO | $SiH_4 = 200$ | $B_2H_6/SiH_4 = 1.6 \times 10^{-3}$<br>$NO/SiH_4 = 3 \times 10^{-2}$ | 0.18 | 11 | 0.3 |
| | $SiH_4/He = 1$ | $SiH_4 = 200$ | | 0.18 | 11 | 15 |
| Amorphous layer (II) | Ar | 200 | Area ratio<br>Si wafer:Graphite = 1.5:8.5 | 0.3 | 2 | 0.5 |

| | |
|---|---|
| Al support temperature: | 250° C. |
| Discharge frequency: | 13.56 MHz |
| Pressure in the reaction chamber: | 0.3 Torr upon forming amorphous layer (I); 0.2 Torr upon forming amorphous layer (II) |

The resulting image forming member was set in a charging-exposing-developing apparatus and subjected to a corona charging at ⊖5 KV for 0.2 sec, immediately followed by imagewise exposure at 1.0 lux.sec through a transparent test chart by using a tungsten lamp.

Immediately thereafter, development was effected with a ⊕ charged developer (including toner and carrier) by cascading to produce a good toner image on the surface of the member.

The resulting toner image was cleaned once with a rubber blade, and then the above mentioned image formation and cleaning steps were repeated. Even when the steps were repeated 150,000 times or more, any degradation of image was not observed.

EXAMPLE 39

By using the production apparatus in FIG. 8 layer formation was effected on an Al support under the following conditions.

TABLE 40

| Constituting layer | Used gas | Flow rate (SCCM) | Flow rate ratio | Discharge power (W/cm²) | Layer deposition rate (Å/sec) | Layer thickness (μ) |
|---|---|---|---|---|---|---|
| Interface layer | $SiH_4$/He = 1<br>$NH_3$ | $SiH_4$ = 10 | $NH_3/SiH_4$ = 30 | 0.18 | 5 | 0.05 |
| Amorphous layer (I) | $SiH_4$/He = 1<br>$B_2H_6$/He = $10^{-2}$<br>NO | $SiH_4$ = 200 | $B_2H_6/SiH_4 = 1.6 \times 10^{-3}$<br>$NO/SiH_4 = 2 \times 10^{-2}$ | 0.18 | 11 | 0.2 |
| | $SiH_4$/He = 1 | $SiH_4$ = 200 | | 0.18 | 11 | 15 |
| Amorphous layer (II) | Ar | 200 | Si wafer:Graphite = 0.5:9.5 | 0.3 | 1.5 | 0.3 |

The other conditions are the same as in Example 38. The resulting image forming member was set in a charging-exposing-developing apparatus and subjected to a corona charging at ⊕65 KV for 0.2 sec, immediately followed by imagewise exposure at 1.0 lux.sec through a transparent test chart by using a tungsten lamp as a light source.

Immediately thereafter, development was effected with a ⊖ charged developer (including toner and carrier) by cascading to produce a good toner image on the surface of the member. The resulting toner image was cleaned with a rubber blade and the image forming and cleaning steps were repeated. Even when the steps were repeated 100,000 times or more, any degradation of image was not observed.

EXAMPLE 40

By using the apparatus in FIG. 8, layer formation was effected on an Al support under the following conditions.

TABLE 41

| Constituting layer | Used gas | Flow rate (SCCM) | | Discharge power (W/cm²) | Layer deposition rate (Å/sec) | Layer thickness (μ) |
|---|---|---|---|---|---|---|
| | | | Flow rate ratio | | | |
| Interface layer | $SiH_4$/He = 1<br>$NH_3$ | $SiH_4$ = 10 | $NH_3/SiH_4$ = 3 | 0.18 | 5 | 0.05 |
| Amorphous layer (I) | $SiH_4$/He = 1<br>$B_2H_6$/He = $10^{-2}$<br>NO | $SiH_4$ = 200 | $B_2H_6/SiH_4 = 3 \times 10^{-3}$<br>$NO/SiH_4 = 3 \times 10^{-2}$ | 0.18 | 11 | 0.3 |
| | $SiH_4$/He = 1 | $SiH_4$ = 200 | | 0.18 | 11 | 15 |
| | | | Area ratio | | | |
| Amorphous layer (II) | Ar | 200 | Si wafer:Graphite = 6:4 | 0.3 | 3 | 1.0 |

The other conditions are the same as in Example 38. The resulting image forming member was set in a charging-exposing-developing apparatus and subjected to a corona charging at ⊕5 KV for 0.2 sec, immediately followed by imagewise exposure at 1.0 lux.sec through a transparent test chart by using a tungsten lamp as a light source.

Immediately thereafter, development was effected with a ⊖ charged developer (including toner and carrier) by cascading to produce a good toner image of very high density on the surface of the member.

The resulting toner image was once cleaned with a rubber blade, and the above mentioned image formation and cleaning steps were repeated. Even when the steps were repeated 150,000 times or more, any degradation of image was not observed.

EXAMPLE 41

By repeating the procedures in Example 40 except that the area ratio of silicon wafer to graphite was changed upon forming the second amorphous layer (II) so as to change the content ratio of silicon atom to carbon atom in said layer (II), an image forming member was produced.

The resulting image forming member was subjected to the image formation, developing and cleaning steps as in Example 38 about 50,000 times and then the image quality was evaluated.

TABLE 42

| | | | | | | | |
|---|---|---|---|---|---|---|---|
| Si:C Target (Area ratio) | 9:1 | 6.5:3.5 | 4:6 | 2:8 | 1:9 | 0.5:9.5 | 0.2:9.8 |
| Si:C (Content ratio) | 9.7:0.3 | 8.8:1.2 | 7.3:2.7 | 4.8:5.2 | 3:7 | 2:8 | 0.8:9.2 |
| Evaluation of image quality | Δ | ○ | ⊙ | ⊙ | ⊙ | ○ | X |

⊙: Very good
○: Good
Δ: Sufficiently practically usable
X: Defective images are formed sometimes.

EXAMPLE 42

By repeating the procedures in Example 38 except that the layer thickness of the second amorphous layer (II) was changed, an image forming member was produced. The image formation, developing and cleaning steps as in Example 38 were repeated. The results are shown in Table 43.

TABLE 43

| Thickness of amorphous layer (II) | Result |
|---|---|
| 0.001μ | Defective images were liable to be formed. |
| 0.02μ | Defective image was not formed when the steps were repeated 20,000 times. |
| 0.05μ | Stable upon repeating the steps 50,000 times or more. |
| 1μ | Stable upon repeating the steps 200,000 times or more. |

EXAMPLE 43

By repeating the procedures in Example 38 except that the formation of the interface layer and the amorphous layer (I) was changed as shown in Table 44 below, an image forming member was produced and evaluated as in Example 38. The result was good.

TABLE 44

| Layer preparation order | | Used gas | Flow rate (SCCM) | Flow rate ratio | Layer thickness (μ) |
|---|---|---|---|---|---|
| Interface layer | 1st step | $SiH_4/He = 1$ $NH_3$ | $SiH_4 = 10$ | $SiH_4:NH_3 = 1:30$ | 0.05 |
| Amorphous layer (I) | 2nd step | $SiH_4/He = 1$ $B_2H_6/He = 10$ NO | $SiH_4 = 200$ | $SiH_4:B_2H_6 = 1:1.6 \times 10^{-3}$ $SiH_4:NO = 1:0.03$ | 0.3 |
| Interface layer | 3rd step | $SiH_4/He = 1$ $NH_3$ | $SiH_4 = 10$ | $SiH_4:NH_3 = 1:30$ | 0.05 |
| Amorphous layer (I) | 4th step | $SiH_4/He = 1$ | $SiH_4 = 200$ | | 15 |

EXAMPLE 44

By repeating the procedures in Example 38 except that the formation of the interface layer and the amorphous layer (I) was changed as shown in the following table, an image forming member was produced, and evaluated as in Example 38. A good result was obtained.

TABLE 45

| Layer preparation step | | Used gas | Flow rate (SCCM) | Flow rate ratio | Layer thickness (μ) |
|---|---|---|---|---|---|
| Interface layer | 1st step | $SiH_4/He = 1$ $SiF_4/He = 1$ $NH_3$ | $SiH_4 \sim 8$ | $SiH_4:SiF_4 = 8:2$ $(SiH_4 + SiF_4):NH_3 = 1:30$ | 0.05 |
| Amorphous layer (I) | 2nd step | $SiH_4/He = 1$ $SiF_4/He = 1$ $B_2H_6/He = 10^{-2}$ NO | $SiH_4 = 120$ | $SiH_4:SiF_4 = 8:2$ $(SiH_4 + SiF_4):B_2H_6 = 1:1.6 \times 10^{-3}$ $(SiH_4 + SiF_4):NO = 1:0.03$ | 0.3 |
| | 3rd step | $SiH_4/He = 1$ $SiF_4/He = 1$ | | $SiH_4:SiF_4 = 8:2$ | 15 |

EXAMPLE 45

By using the apparatus in FIG. 8 and repeating the procedures in Example 38 except that the following conditions were employed, layer formation was effected on an Al support.

TABLE 46

| Constituting layer | Used gas | Flow rate (SCCM) | Flow rate ratio | Discharge power (W/cm²) | Layer deposition rate (Å/sec) | Layer thickness (μ) |
|---|---|---|---|---|---|---|
| Interface layer | $SiH_4/He = 1$ $NH_3$ | $SiH_4 = 10$ | $NH_3/SiH_4 = 30$ | 0.18 | 5 | 0.05 |
| Amorphous layer (I) | $SiH_4/He = 1$ $B_2H_6/He = 10^{-2}$ | $SiH_4 = 200$ | $B_2H_6/SiH_4 = 1.6 \times 10^{-3}$ | 0.18 | 11 | 0.3 |

TABLE 46-continued

| Constituting layer | Used gas | Flow rate (SCCM) | | Discharge power (W/cm²) | Layer deposition rate (Å/sec) | Layer thickness (μ) |
|---|---|---|---|---|---|---|
| | NO | | | | | |
| | $SiH_4$/He = 1 | $SiH_4$ = 200 | NO/$SiH_4$ = 1.5 × $10^{-2}$ | 0.18 | 11 | 0.1 |
| | NO | | | | | |
| | $SiH_4$/He = 1 | $SiH_4$ = 200 | | 0.18 | 11 | 15 |
| | | | Area ratio | | | |
| Amorphous layer (II) | Ar | 200 | Si wafer:Graphite = 0.5:9.5 | 0.3 | 1.5 | 0.3 |

The resulting electrophotographic image forming member was evaluated as in Example 39 and the result was good.

EXAMPLE 46

By using the apparatus in FIG. 8, layer formation was effected on an Al support under the following conditions.

TABLE 47

| Constituting layer | Used gas | Flow rate (SCCM) | | Discharge power (W/cm²) | Layer deposition rate (Å/sec) | Layer thickness (μ) |
|---|---|---|---|---|---|---|
| | | | Flow rate ratio | | | |
| Interface layer | $SiH_4$/He = 1 | $SiH_4$ = 10 | $NH_3$/$SiH_4$ = 3 | 0.18 | 5 | 0.05 |
| | $NH_3$ | | | | | |
| Amorphous layer (I) | $SiH_4$/He = 1 | $SiH_4$ = 200 | $B_2H_6$/$SiH_4$ = 8 × $10^{-4}$ | 0.18 | 11 | 0.2 |
| | $B_2H_6$/He = $10^{-2}$ | | NO/$SiH_4$ = $10^{-1}$ | | | |
| | NO | | | | | |
| | $SiH_4$/He = 1 | $SiH_4$ = 200 | $B_2H_6$/$SiH_4$ = 8 × $10^{-4}$ | 0.18 | 11 | 0.3 |
| | $B_2H_6$/He = $10^{-2}$ | | | | | |
| | $SiH_4$/He = 1 | $SiH_4$ = 200 | | 0.18 | 11 | 15 |
| | | | Area ratio | | | |
| Amorphous layer (II) | Ar | 200 | Si wafer:Graphite = 6:4 | 0.3 | 3 | 1.0 |

The other conditions were the same as those in Example 38. The resulting image forming member was evaluated as in Example 40. The image quality was high and the durability was excellent.

EXAMPLE 47

By using the apparatus in FIG. 7, layer formation was effected on the drum-like Al support under the following conditions.

TABLE 48

| Constituting layer | Used gas | Flow rate (SCCM) | Flow rate ratio | Discharge power (W/cm²) | Layer deposition rate (Å/sec) | Layer thickness (μ) |
|---|---|---|---|---|---|---|
| Interface layer | $SiH_4$/He = 1 | $SiH_4$ = 10 | $SiH_4$:$NH_3$ = 1:30 | 0.18 | 5 | 0.05 |
| | $NH_3$ | | | | | |
| Amorphous layer (I) | $SiH_4$/He = 1 | $SiH_4$ = 200 | $B_2H_6$/$SiH_4$ = 1.6 × $10^{-3}$ | 0.18 | 11 | 0.3 |
| | $B_2H_6$/He = $10^{-2}$ | | NO/$SiH_4$ = 3 × $10^{-2}$ | | | |
| | NO | | | | | |
| | $SiH_4$/He = 1 | $SiH_4$ = 200 | | 0.18 | 11 | 15 |
| Amorphous layer (II) | $SiH_4$/He = 0.5 | $SiH_4$ = 100 | $SiH_4$:$C_2H_4$ = 3:7 | 0.3 | 2 | 0.5 |
| | $C_2H_4$ | | | | | |

| | |
|---|---|
| Al support temperature: | 250° C. |
| Discharge frequency: | 13.56 MHz |
| Pressure in the reaction chamber: | 0.3 Torr upon forming amorphous layer (I)<br>0.2 Torr upon forming amorphous layer (II) |

The resulting image forming member was set in a charging-exposing-developing apparatus and subjected to a corona charging at ⊕5 KV for 0.2 sec, immediately followed by imagewise exposure at 1.0 lux.sec through a transparent test chart by using a tungsten lamp as a light source.

Immediately thereafter, development was effected with a ⊖ charged developer (including toner and carrier) by cascading to produce a good toner image on the surface of the member.

The resulting toner image was once cleaned with a rubber blade, and then the above mentioned image formation and cleaning steps were repeated. Even when the steps were repeated 150,000 times or more, any degradation of image was not observed.

EXAMPLE 48

By using the apparatus in FIG. 7, layer formation was effected on a drum-like Al support under the following conditions.

TABLE 49

| Constituting layer | Used gas | Flow rate (SCCM) | Flow rate ratio | Discharge power (W/cm²) | Layer deposition rate (Å/sec) | Layer thickness (μ) |
|---|---|---|---|---|---|---|
| Interface layer | $SiH_4$/He = 1<br>$NH_3$ | $SiH_4$ = 10 | $NH_3/SiH_4$ = 30 | 0.18 | 5 | 0.05 |
| Amorphous layer (I) | $SiH_4$/He = 1<br>$B_2H_6$/He = $10^{-2}$<br>NO | $SiH_4$ = 200 | $B_2H_6/SiH_4 = 1.6 \times 10^{-3}$<br>$NO/SiH_4 = 2 \times 10^{-2}$ | 0.18 | 11 | 0.2 |
| | $SiH_4$/He = 1 | $SiH_4$ = 200 | | 0.18 | 11 | 15 |
| Amorphous layer (II) | $SiH_4$/He = 1<br>$C_2H_4$ | $SiH_4$ = 100 | $SiH_4:C_2H_4$ = 0.4:9.6 | 0.3 | 1.5 | 0.3 |

The other conditions were the same as those in Example 47.

The resulting image forming member was set in a charging-exposing-developing apparatus and subjected to a corona charging at ⊕5 KV for 0.2 sec, immediately followed by imagewise exposure at 1.0 lux.sec through a transparent test chart by a tungsten lamp as a light source.

Immediately thereafter, development was effected with a ⊖ charged developer (including toner and carrier) by cascading to produce a good toner image on the surface of the member.

The resulting toner image was cleaned with a rubber blade, and then the image forming and cleaning steps were repeated. Even when the steps were repeated 100,000 times or more, any degradation of image was not observed.

EXAMPLE 49

Layer formation was effected on a drum-like support under the following conditions by the apparatus shown in FIG. 7.

The other conditions were the same as those in Example 47.

The resulting image forming member was set in a charging-exposing-developing apparatus and subjected to a corona charging at ⊕5 KV for 0.2 sec, immediately followed by imagewise exposure at 1.0 lux.sec through a transparent test chart by a tungsten lamp as a light source.

Immediately thereafter, development was effected with a ⊖ charged developer (including toner and carrier) by cascading to produce a good toner image of a very high density.

TABLE 50

| Constituting layer | Used gas | Flow rate (SCCM) | Flow rate ratio | Discharge power (W/cm²) | Layer deposition rate (Å/sec) | Layer thickness (μ) |
|---|---|---|---|---|---|---|
| Interface layer | $SiH_4$/He = 1<br>$NH_3$ | $SiH_4$ = 10 | $NH_3/SiH_4$ = 3 | 0.18 | 5 | 0.05 |
| Amorphous layer (I) | $SiH_4$/He = 1<br>$B_2H_6$/He = $10^{-2}$<br>NO | $SiH_4$ = 200 | $B_2H_6/SiH_4 = 3 \times 10^{-3}$<br>$NO/SiH_4 = 3 \times 10^{-2}$ | 0.18 | 11 | 0.3 |
| | $SiH_4$/He = 1 | $SiH_4$ = 200 | | 0.18 | 11 | 15 |
| Amorphous layer (II) | $SiH_4$/He = 0.5<br>$C_2H_4$ | $SiH_4$ = 100 | $SiH_4:C_2H_4$ = 5:5 | 0.3 | 3 | 1.5 |

The resulting toner image was once cleaned with a rubber blade, and then the above mentioned image forming and cleaning steps. Even when the steps were repeated 150,000 times or more, any degradation of image was not observed.

EXAMPLE 50

By repeating the procedures in Example 49 except that, upon producing the second amorphous layer (II), the flow rate ratio of $SiH_4$ gas to $C_2H_4$ gas was changed so as to change the content ratio of silicon atom to carbon atom in said layer (II), an image forming member was formed and was subjected to the image forming, developing and cleaning steps as in Example 47 about 50,000 times. Then the image evaluation was effected. The result is shown in Table 51.

TABLE 51

| | | | | | | | | |
|---|---|---|---|---|---|---|---|---|
| $SiH_4:C_2H_4$ Flow rate ratio | 9:1 | 6:4 | 4:6 | 2:8 | 1:9 | 0.5:9.5 | 0.34:9.66 | 0.2:9.8 |
| Si:C Content ratio | 9:1 | 7:3 | 5.5:4.5 | 4:6 | 3:7 | 2:8 | 1.2:8.8 | 0.8:9.2 |
| Evaluation of image quality | ○ | ⊙ | ⊙ | ⊙ | ⊙ | ⊙ | ○ | Δ |

⊙: Very good
○: Good
Δ: Defective images are formed somewhat, but practically usable.

EXAMPLE 51

By repeating the procedures in Example 47 except that the second amorphous layer (II) was changed in the thickness, an image forming member was produced, and repeatedly subjected to the image forming, developing and cleaning steps as in Example 47. The results are shown in the following.

TABLE 52

| Layer thickness of amorphous layer (II) | Result |
|---|---|
| 0.001μ | Defective images were liable to be formed. |
| 0.02μ | Upon repeating 20,000 times, no defective image was formed. |
| 0.05μ | Stable upon repeating 50,000 times or more. |
| 2μ | Stable upon repeating 200,000 times or more. |

EXAMPLE 53

By repeating the procedures in Example 47 except that the formation of the interface layer and the amorphous layer (I) was changed as shown in the following table, an image forming member was produced and evaluated as in Example 47. The result was good.

EXAMPLE 54

By using the apparatus in FIG. 7, layer formation was effected on an Al support following the procedures in Example 47 except the following conditions were employed.

TABLE 54

| Layer preparation order | | Used gas | Flow rate (SCCM) | Flow rate ratio | Layer thickness (μ) |
|---|---|---|---|---|---|
| Interface layer | 1st step | $SiH_4/He = 1$<br>$SiF_4/He = 1$<br>$NH_3$ | $SiH_4 \sim 8$ | $SiH_4:SiF_4 = 8:2$<br>$(SiH_4 + SiF_4):NH_3 = 1:30$ | 0.05 |
| Amorphous layer (I) | 2nd step | $SiH_4/He = 1$<br>$SiF_4/He = 1$<br>$B_2H_6/He = 10^{-2}$<br>NO | $SiH_4 = 120$ | $SiH_4:SiF_4 = 8:2$<br>$(SiH_4 + SiF_4):B_2H_6 = 1:1.6 \times 10^{-3}$<br>$(SiH_4 + SiF_4):NO = 1:0.03$ | 0.3 |
| | 3rd step | $SiH_4/He = 1$<br>$SiF_4/He = 1$ | | $SiH_4:SiF_4 = 8:2$ | 15 |

TABLE 55

| Constituting layer | Used gas | Flow rate (SCCM) | Flow rate ratio | Discharge power ($W/cm^2$) | Layer deposition rate (Å/sec) | Layer thickness (μ) |
|---|---|---|---|---|---|---|
| Interface layer | $SiH_4/He = 1$<br>$NH_3$ | $SiH_4 = 10$ | $NH_3/SiH_4 = 30$ | 0.18 | 5 | 0.05 |
| Amorphous layer (I) | $SiH_4/He = 1$<br>$B_2H_6/He = 10^{-2}$<br>NO | $SiH_4 = 200$ | $B_2H_6/SiH_4 = 1.6 \times 10^{-3}$<br>$NO/SiH_4 = 1.5 \times 10^{-2}$ | 0.18 | 11 | 0.3 |
| | $SiH_4/He = 1$<br>NO | $SiH_4 = 200$ | $NO/SiH_4 = 1.5 \times 10^{-2}$ | 0.18 | 11 | 0.1 |
| | $SiH_4/He = 1$ | $SiH_4 = 200$ | | 0.18 | 11 | 15 |
| Amorphous layer (II) | $SiH_4/He = 1$<br>$C_2H_4$ | $SiH_4 = 100$ | $SiH_4:C_2H_4 = 0.4:9.6$ | 0.3 | 15 | 0.3 |

EXAMPLE 52

By repeating the procedures in Example 47 except that the formation of interface layer and amorphous layer (I) was changed as shown in Table 53 below, an image forming layer was produced, and evaluated as in Example 47. The result was good.

TABLE 53

| Layer preparation order | | Used gas | Flow rate (SCCM) | Flow rate ratio | Layer thickness (μ) |
|---|---|---|---|---|---|
| Interface layer | 1st step | $SiH_4/He = 1$<br>$NH_3$ | $SiH_4 = 10$ | $SiH_4:NH_3 = 1:30$ | 0.05 |
| Amorphous layer (I) | 2nd step | $SiH_4/He = 1$<br>$B_2H_6/He = 10^{-2}$<br>NO | $SiH_4 = 200$ | $SiH_4:B_2H_6 = 1:1.6 \times 10^{-3}$<br>$SiH_4:NO = 1:0.03$ | 0.3 |
| Interface layer | 3rd step | $SiH_4/He = 1$<br>$NH_3$ | $SiH_4 = 10$ | $SiH_4:NH_3 = 1:30$ | 0.05 |
| Amorphous layer (I) | 4th step | $SiH_4/He = 1$ | $SiH_4 = 200$ | | 15 |

The resulting electrophotographic image forming member was evaluated as in Example 48. A good result was obtained.

EXAMPLE 55

By using the apparatus in FIG. 7, layer formation was effected on an Al support under the following conditions.

TABLE 56

| Constituting layer | Used gas | Flow rate (SCCM) | Flow rate ratio | Discharge power (W/cm²) | Layer deposition rate (Å/sec) | Layer thickness (μ) |
|---|---|---|---|---|---|---|
| Interface layer | $SiH_4/He = 1$<br>$NH_3$ | $SiH_4 = 10$ | $NH_3/SiH_4 = 3$ | 0.18 | 5 | 0.05 |
| Amorphous layer (I) | $SiH_4/He = 1$<br>$B_2H_6/He = 10^{-2}$<br>NO | $SiH_4 = 200$ | $B_2H_6/SiH_4 = 8 \times 10^{-4}$<br>$NO/SiH_4 = 10^{-1}$ | 0.18 | 11 | 0.2 |
| | $SiH_4/He = 1$<br>$B_2H_6/He = 10^{-2}$ | $SiH_4 = 200$ | $B_2H_6/SiH_4 = 8 \times 10^{-4}$ | 0.18 | 11 | 0.3 |
| | $SiH_4/He = 1$ | $SiH_4 = 200$ | | 0.18 | 11 | 15 |
| Amorphous layer (II) | $SiH_4/He = 0.5$<br>$C_2H_4$ | $SiH_4 = 100$ | $SiH_4:C_2H_4 = 5:5$ | 0.3 | 3 | 1.5 |

The other conditions were the same as those in Example 47. The resulting image forming member was evaluated as in Example 49. The image quality was high and the durability was excellent.

EXAMPLE 56

By using the production apparatus in FIG. 8, layer formation was effected on an Al support under the following conditions.

The resulting toner image was once cleaned with a rubber blade, and then the above mentioned image forming and cleaning steps were repeated. Even when the steps were repeated 150,000 times or more, any degradation of image was not observed.

EXAMPLE 57

By using the apparatus in FIG. 8, layer formation was effected on an Al support under the following conditions.

TABLE 57

| Constituting layer | Used gas | Flow rate (SCCM) | Flow rate ratio | Discharge power (W/cm²) | Layer deposition rate (Å/sec) | Layer thickness (μ) |
|---|---|---|---|---|---|---|
| Interface layer | $SiH_4/He = 1$<br>$NH_3$ | $SiH_4 = 10$ | $SiH_4:NH_3 = 1:30$ | 0.18 | 5 | 0.05 |
| Amorphous layer (I) | $SiH_4/He = 1$<br>$B_2H_6/He = 10^{-2}$<br>NO | $SiH_4 = 200$ | $B_2H_6/SiH_4 = 1.6 \times 10^{-3}$<br>$NO/SiH_4 = 3 \times 10^{-2}$ | 0.18 | 11 | 0.3 |
| | $SiH_4/He = 1$ | $SiH_4 = 200$ | | 0.18 | 11 | 15 |
| Amorphous layer (II) | $SiF_4/He = 0.5$<br>$C_2H_4$ | $SiF_4 = 100$ | $SiF_4:C_2H_4 = 3:7$ | 0.3 | 2 | 0.5 |

| | |
|---|---|
| Al support temperature: | 250° C. |
| Discharge frequency: | 13.56 MHz |
| Pressure in the reaction chamber: | 0.3 Torr upon forming amorphous layer (I); 0.2 Torr upon forming amorphous layer (II) |

TABLE 58

| Constituting layer | Used gas | Flow rate (SCCM) | Flow rate ratio | Discharge power (W/cm²) | Layer deposition rate (Å/sec) | Layer thickness (μ) |
|---|---|---|---|---|---|---|
| Interface layer | $SiH_4/He = 1$<br>$NH_3$ | $SiH_4 = 10$ | $NH_3/SiH_4 = 30$ | 0.18 | 5 | 0.05 |
| Amorphous layer (I) | $SiH_4/He = 1$<br>$B_2H_6/He = 10^{-2}$<br>NO | $SiH_4 = 200$ | $B_2H_6/SiH_4 = 1.6 \times 10^{-3}$<br>$NO/SiH_4 = 2 \times 10^{-2}$ | 0.18 | 11 | 0.2 |
| | $SiH_4/He = 1$ | $SiH_4 = 200$ | | 0.18 | 11 | 15 |
| Amorphous layer (II) | $SiH_4/He = 0.5$<br>$SiF_4/He = 0.5$<br>$C_2H_4$ | $SiH_4 + SiF_4 = 15$ | $SiH_4:SiF_4:C_2H_4 = 0.3:0.1:9.6$ | 0.3 | 1.5 | 0.3 |

The resulting image forming member was set in a charging-exposing-developing apparatus and subjected to a corona charging at ⊕5 KV for 0.2 sec, immediately followed by imagewise exposure at 1.0 lux.sec through a transparent test chart by using a tungsten lamp as a light source.

Immediately thereafter, development was effected with a ⊖ charged developer (including toner and carrier) by cascading to form a good toner image on the surface of the image forming member.

The other conditions were the same as those in Example 56.

The resulting image forming member was set in a charging-exposing-developing apparatus and subjected to a corona charging at ⊕5 KV for 0.2 sec, immediately followed by imagewise exposure at 1.0 lux.sec through a transparent test chart by using a tungsten lamp as a light source.

Immediately thereafter, development was carried out with a ⊖ charged developer (including toner and carrier) by cascading to produce a good toner image on the surface of the member.

The resulting toner image was once cleaned with a rubber blade, and the above mentioned image formation and cleaning steps were repeated. Even when the steps were repeated 100,000 times or more, any degradation of image was not observed.

EXAMPLE 58

By using the apparatus in FIG. 8, layer formation was effected on an Al support under the following conditions.

The other conditions were the same as those in Example 56.

The resulting image forming member was set in a charging-exposing-developing apparatus and subjected to a corona charging at ⊕5 KV for 0.2 sec, immediately followed by imagewise exposure at 1.0 lux.sec through a transparent test chart by using a tungsten lamp as a light source.

Immediately thereafter, development was effected with a ⊖ charged developer (including toner and carrier) by cascading to produce a good toner image of a very high density on the surface of the member.

The resulting toner image was once cleaned with a rubber blade, and then the above mentioned image forming and cleaning steps were repeated. Even when the steps were repeated 150,000 times or more, any degradation of image was not observed.

TABLE 59

| Constituting layer | Used gas | Flow rate (SCCM) | Flow rate ratio | Discharge power ($W/cm^2$) | Layer deposition rate (Å/sec) | Layer thickness (μ) |
|---|---|---|---|---|---|---|
| Interface layer | $SiH_4/He = 1$<br>$NH_3$ | $SiH_4 = 10$ | $NH_3/SiH_4 = 3$ | 0.18 | 5 | 0.05 |
| Amorphous layer (I) | $SiH_4/He = 1$<br>$B_2H_6/He = 10^{-2}$<br>NO | $SiH_4 = 200$ | $B_2H_6/SiH_4 = 3 \times 10^{-3}$<br>$NO/SiH_4 = 3 \times 10^{-2}$ | 0.18 | 11 | 0.3 |
| | $SiH_4/He = 1$ | $SiH_4 = 200$ | | 0.18 | 11 | 15 |
| Amorphous layer (II) | $SiH_4/He = 0.5$<br>$SiF_4/He = 0.5$<br>$C_2H_4$ | $(SiH_4 + SiF_4) = 150$ | $SiH_4:SiF_4:C_2H_4 = 3:3:4$ | 0.3 | 3 | 1.5 |

EXAMPLE 59

By repeating the procedures of Example 58 except that, upon forming the second amorphous layer (II), the flow rate ratio of $SiH_4$ gas:$SiF_4$ gas:$C_2H_4$ gas was changed so as to change the content ratio of silicon atom to carbon atom in said layer (II), there were produced image forming members.

The resulting image forming member was subjected to the image forming, developing and cleaning steps as in Example 56 about 50,000 times and the image evaluation was made. The results are shown in Table 60 below.

TABLE 60

| $SiH_4:SiF_4:C_2H_4$ | 5:4:1 | 3:3.5:3.5 | 2:2:6 | 1:1:8 | 0.6:0.4:9 | 0.2:0.3:9.5 | 0.2:0.15:9.65 | 0.1:0.1:9.8 |
|---|---|---|---|---|---|---|---|---|
| Si:C content ratio | 9:1 | 7:3 | 5.5:4.5 | 4:6 | 3:7 | 2:8 | 1.2:8.8 | 0.8:9.2 |
| Image quality evaluation | ○ | ◎ | ◎ | ◎ | ◎ | ◎ | ○ | Δ |

◎: Very good
○: Good
Δ: Practically usable though defective images were formed sometimes.

EXAMPLE 60

By repeating the procedures in Example 56 except that the layer thickness of the second amorphous layer (II) was changed, there were produced image forming members. Then the members were subjected to the image forming, developing and cleaning steps as in Example 56 repeatedly. The results are as shown below.

TABLE 61

| Thickness of amorphous layer (II) (μ) | Result |
|---|---|
| 0.001 | Defective images were liable to be formed. |
| 0.02 | No defective image was formed upon repeating 20,000 times. |
| 0.05 | Stable upon repeating 50,000 times or more. |
| 1 | Stable upon repeating 200,000 times or more. |

EXAMPLE 61

By repeating the procedures in Example 56 except that the formation of amorphous layer (I) and the interface layer was changed as shown in the following table, an image forming member was produced, and evaluated as in Example 56. A good result was obtained.

TABLE 62

| Layer preparation order | | Used gas | Flow rate (SCCM) | Flow rate ratio | Layer thickness (μ) |
|---|---|---|---|---|---|
| Interface layer | 1st step | $SiH_4/He = 1$<br>$NH_3$ | $SiH_4 = 10$ | $SiH_4:NH_3 = 1:30$ | 0.05 |
| Amorphous layer (I) | 2nd step | $SiH_4/He = 1$<br>$B_2H_6/He = 10^{-2}$<br>NO | $SiH_4 = 200$ | $SiH_4:B_2H_6 = 1:1.6 \times 10^{-3}$<br>$SiH_4:NO = 1:0.03$ | 0.3 |
| Interface layer | 3rd step | $SiH_4/He = 1$<br>$NH_3$ | $SiH_4 = 10$ | $SiH_4:NH_3 = 1:30$ | 0.05 |
| Amorphous layer (I) | 4th step | $SiH_4/He = 1$ | $SiH_4/He = 200$ | | 15 |

EXAMPLE 62

By repeating the procedures in Example 56 except that the formation of the interface layer and amorphous layer (I) was changed as in the following table, an image forming member was produced, and evaluated as in Example 56. A good result was obtained.

TABLE 63

| Layer preparation order | | Used gas | (SCCM) | Flow rate Flow rate ratio | Layer thickness (μ) |
|---|---|---|---|---|---|
| Interface layer | 1st step | $SiH_4/He = 1$<br>$SiF_4/He = 1$<br>$NH_3$ | $SiF_4 \sim 8$ | $SiH_4:SiF_4 = 8:2$<br>$(SiH_4 + SiF_4):NH_3 = 1:30$ | 0.05 |
| Amorphous layer (I) | 2nd step | $SiH_4/He = 1$<br>$SiF_4/He = 1$<br>$B_2H_6/He = 10^{-2}$<br>NO | $SiH_4 = 120$ | $SiH_4:SiF_4 = 8:2$<br>$(SiH_4 + SiF_4):B_2H_6 = 1:1.6 \times 10^{-3}$<br>$(SiH_4 + SiF_4):NO = 1:0.03$ | 0.3 |
| | 3rd step | $SiH_4/He = 1$<br>$SiF_4/He = 1$ | | $SiH_4:SiF_4 = 8:2$ | 15 |

EXAMPLE 63

By using the apparatus in FIG. 8 and repeating the procedures in Example 56 except the following conditions, layer formation was effected on an Al support.

TABLE 64

| Constituting layer | Used gas | Flow rate (SCCM) | Flow rate ratio | Discharge power ($W/cm^2$) | Layer deposition rate (Å/sec) | Layer thickness (μ) |
|---|---|---|---|---|---|---|
| Interface layer | $SiH_4/He = 1$<br>$NH_3$ | $SiH_4 = 10$ | $NH_3/SiH_4 = 30$ | 0.18 | 5 | 0.05 |
| Amorphous layer (I) | $SiH_4/He = 1$<br>$B_2H_6/He = 10^{-2}$<br>NO | $SiH_4 = 200$ | $B_2H_6/SiH_4 = 1.6 \times 10^{-3}$<br>$NO/SiH_4 = 1.5 \times 10^{-3}$ | 0.18 | 11 | 0.3 |
| | $SiH_4/He = 1$<br>NO | $SiH_4 = 200$ | $NO/SiH_4 = 1.5 \times 10^{-2}$ | 0.18 | 11 | 0.1 |
| | $SiH_4/He = 1$ | $SiH_4 = 200$ | | 0.18 | 11 | 15 |
| Amorphous layer (II) | $SiH_4/He = 0.5$<br>$SiF_4/He = 0.5$<br>$C_2H_4$ | $SiH_4 + SiF_4 = 15$ | $SiH_4:SiF_4:C_2H_4 = 0.3:0.1:9.6$ | 0.3 | 1.5 | 0.3 |

The resulting electrophotographic image forming member was evaluated as in Example 57. The result was good.

EXAMPLE 64

Layer formation was effected on an Al support under the following conditions by the apparatus in FIG. 8.

TABLE 65

| Constituting layer | Used gas | Flow rate (SCCM) | Flow rate ratio | Discharge power ($W/cm^2$) | Layer deposition rate (Å/sec) | Layer thickness (μ) |
|---|---|---|---|---|---|---|
| Interface layer | $SiH_4/He = 1$<br>$NH_3$ | $SiH_4 = 10$ | $NH_3/SiH_4 = 3$ | 0.18 | 5 | 0.05 |
| Amorphous layer (I) | $SiH_4/He = 1$<br>$B_2H_6/He = 10^{-2}$<br>NO | $SiH_4 = 200$ | $B_2H_6/SiH_4 = 8 \times 10^{-4}$<br>$NO/SiH_4 = 10^{-1}$ | 0.18 | 11 | 0.2 |
| | $SiH_4/He = 1$<br>$B_2H_6/He = 10^{-2}$ | $SiH_4 = 200$ | $B_2H_6/SiH_4 = 8 \times 10^{-4}$ | 0.18 | 11 | 0.3 |
| | $SiH_4/He = 1$ | $SiH_4 = 200$ | | 0.18 | 11 | 15 |
| Amorphous layer (II) | $SiH_4/He = 0.5$<br>$SiF_4/He = 0.5$<br>$C_2H_4$ | $SiH_4 + SiF_4 = 150$ | $SiH_4:SiF_4:C_2H_4 = 3:3:4$ | 0.3 | 3 | 1.5 |

The other conditions were the same as those in Example 56. The resulting image forming member was evaluated as in Example 58. The image was of a high quality and the durability was good.

EXAMPLE 65

By repeating the procedures in Example 58 except that amorphous layer (II) was formed by sputtering under the conditions below, an image forming member was produced, and evaluated as in Example 58. A good result was obtained.

TABLE 66

| | Used gas | Flow rate (SCCM) | Target area ratio (Si wafer:Graphite) | Discharge power (w/cm$^2$) | Layer thickness (μ) |
|---|---|---|---|---|---|
| Amorphous layer (II) | Ar<br>$SiF_4$/He = 0.5 | Ar 200<br>$SiF_4$ 100 | 2.5:7.5 | 0.3 | 1 |

EXAMPLE 66

By using the production apparatus in FIG. 7, layer formation was effected on an Al support under the following conditions.

The resulting image forming member was set in a charging-exposing-developing apparatus and subjected to a corona charging at ⊖5 KV for 0.2 sec, immediately followed by imagewise exposure at 1.0 lux.sec through a transparent test chart by a tungsten lamp as a light source.

Immediately thereafter, development was effected with a ⊕ charged developer (including toner and carrier) by cascading to produce a good toner image on the surface of the image forming member.

The resulting toner image was once cleaned with a rubber blade, and the above mentioned image formation and cleaning steps were repeated. Even when the steps were repeated 100,000 times or more, any degradation of image was not observed.

TABLE 67

| Layer preparation step | Used gas | Flow rate (SCCM) | Flow rate ratio | Layer thickness (μ) |
|---|---|---|---|---|
| 1st step | $SiH_4$/He = 1<br>$PH_3$/He = $10^{-2}$<br>NO | $SiH_4$ = 200 | $SiH_4$:$PH_3$ = 1:1.0 × $10^{-3}$<br>$SiH_4$:NO = 1:0.03 | 0.3 |
| 2nd step | $SiH_4$/He = 1 | | 15 | |

| | |
|---|---|
| Al support temperature: | 250° C. |
| Discharge frequency: | 13.56 MHz |
| Discharge power: | 0.18 W/cm$^2$ |
| Pressure upon reaction: | 0.3 Torr |
| Layer deposition rate: | 11 Å/S |

EXAMPLE 67

By repeating the procedures in Example 66 except that in the first step the flow rate of $PH_3$ gas diluted to 10000 vol.ppm with He gas and that of NO gas were changed, image forming members were produced, and evaluated as in Example 66.

Amounts of phosphorus and oxygen incorporated in the first step in each sample were determined by ion microanalysis (IMA method).

The results are shown in Table 68.

TABLE 68

| Phosphorus atom content (atomic ppm) | Oxygen atom content (atomic %) 0.001 | 1.3 | 6.0 | 30 |
|---|---|---|---|---|
| 10 | X (a) | X (a) | X (a) | X (a) |
| 30 | ○ | ○ | Δ | Δ |
| 500 | ○ | ⊙ | ○ | ○ |
| 2000 | ○ | ⊙ | ⊙ | ○ |
| 50000 | Δ | ○ | ○ | ○ |

TABLE 68-continued

| Phosphorus atom content (atomic ppm) | Oxygen atom content (atomic %) 0.001 | 1.3 | 6.0 | 30 |
|---|---|---|---|---|
| 80000 | X (b) | X (b) | X (b) | X (b) |

(1)In the table, the amounts of oxygen atom and phosphorus atom are those incorporated in the first step of the production.
(2)
⊙Very good
○ Good
Δ Sufficiently practically usable
X (a) Poor image quality
X (b) Layer is liable to exfoliate.

EXAMPLE 68

By using the production apparatus in FIG. 7, layer formation was effected on an Al support under the following conditions. The resulting image forming members were evaluated as in Example 66. The results are shown in Table 70.

TABLE 69

| Layer preparation step | Used gas | Flow rate (SCCM) | Flow rate ratio | Layer thickness (μ) |
|---|---|---|---|---|
| 1st step | $SiH_4$/He = 1<br>$PH_3$/He = $10^{-2}$<br>NO | $SiH_4$ = 200<br>$PH_3$ = 32<br>NO = 3 | $SiH_4$:$PH_3$ = 1:1.6 × $10^{-3}$<br>$SiH_4$:NO = 1:0.015 | Suitably changing |
| 2nd step | $SiH_4$/He = 1 | $SiH_4$ = 200 | | Suitably changing |

| | |
|---|---|
| Al support temperature: | 250° C. |
| Discharge frequency: | 13.56 MHz |
| Discharge power: | 0.18 W/cm$^2$ |
| Total layer thickness: | 15 μ |
| Pressure upon reaction: | 0.3 Torr |
| Layer deposition rate: | 11 Å/S |

TABLE 70

| Thickness of the layer containing oxygen atom and phosphorus (μ) | 0.001 | 0.003 | 0.05 | 0.3 | 1 | 5 | 10 |
|---|---|---|---|---|---|---|---|
| Evaluation | X | Δ | ○ | ⊙ | ⊙ | ○ | X |

⊙Very good
○ Good
Δ Sufficiently practicable
X Practically problematic

EXAMPLE 69

By using the apparatus in FIG. 7, layer formation was effected on an Al support under the conditions in Table 71. The resulting image forming member was evaluated as in Example 66. The result was good.

TABLE 71

| Layer preparation step | Used gas | Flow rate (SCCM) | Flow rate ratio | Layer thickness (μ) |
|---|---|---|---|---|
| 1st step | $SiH_4$/He = 1<br>$PH_3$/He = | $SiH_4$ = 200 | $SiH_4$:$PH_3$ = 1:1.0 × $10^{-3}$<br>$SiH_4$:NO = | 0.3 |

TABLE 71-continued

| | | | |
|---|---|---|---|
| | $10^{-2}$ NO | 1:0.015 | |
| 2nd step | $SiH_4$/He = 1 NO | $SiH_4$:NO = 1:0.015 | 0.1 |
| 3rd step | $SiH_4$/He = 1 | | 15 |

| | |
|---|---|
| Al support temperature: | 250° C. |
| Discharge frequency: | 13.56 MHz |
| Discharge power: | 0.18 W/cm$^2$ |
| Pressure upon reaction: | 0.3 Torr |
| Layer deposition rate: | 11 Å/S |

EXAMPLE 70

By using the apparatus in FIG. 7, layer formation was effected on an Al support under the conditions in Table 72. The resulting image forming member was evaluated as in Example 66. A good result was obtained.

TABLE 72

| Layer preparation step | Used gas | Flow rate (SCCM) | Flow rate ratio | Layer thickness (μ) |
|---|---|---|---|---|
| 1st step | $SiH_4$/He = 1 $PH_3$/He = $10^{-2}$ NO | $SiH_4$ = 200 | $SiH_4$:$PH_3$ = 1:5 × $10^{-4}$ $SiH_4$:NO = 1:0.1 | 0.2 |
| 2nd step | $SiH_4$/He = 1 $PH_3$/He = $10^{-2}$ | | $SiH_4$:$PH_3$ 1:5 × $10^{-4}$ | 0.3 |
| 3rd step | $SiH_4$/He = 1 | | | 15 |

| | |
|---|---|
| Al support temperature: | 250° C. |
| Discharge frequency: | 13.56 MHz |
| Discharge power: | 0.18 W/cm$^2$ |
| Pressure upon reaction: | 0.3 Torr |
| Layer deposition rate: | 11 Å/S |

EXAMPLE 71

An image forming member was produced under the conditions in Table 73, and evaluated as in Example 66. A good result was obtained.

TABLE 73

| Layer preparation step | Used gas | Flow rate (SCCM) | Flow rate ratio | Layer thickness (μ) |
|---|---|---|---|---|
| 1st step | $Si_2H_6$/He = 1 $PH_3$/He = $10^{-2}$ NO | $Si_2H_6$ = 170 | $Si_2H_6$:$PH_3$ = 1:3.2 × $10^{-3}$ $Si_2H_6$:NO = 1:0.09 | 0.3 |
| 2nd step | $Si_2H_6$/He = 1 | | | 15 |

TABLE 73-continued

| | |
|---|---|
| Al support teperature: | 250° C. |
| Discharge frequency: | 13.56 MHz |
| Discharge power: | 0.54 W/cm$^2$ |
| Pressure upon reaction: | 0.3 Torr |
| Layer deposition rate: | 40 Å/S |

EXAMPLE 72

An image forming member was produced under the conditions in Table 74, and evaluated as in Example 66. The image quality and the durability were good.

TABLE 74

| Layer preparation step | Used gas | Flow rate (SCCM) | Flow rate ratio | Layer thickness (μ) |
|---|---|---|---|---|
| 1st step | $SiH_4$/He = 1 $SiF_4$/He = 1 $PH_3$/He = $10^{-2}$ NO | $SiH_4$ + $SiF_4$ = 150 | $SiH_4$:$SiF_4$ = 8:2 ($SiH_4$ + $SiF_4$):$PH_3$ = 1:1.0 × $10^{-3}$ ($SiH_4$ + $SiF_4$):NO = 1:0.03 | 0.3 |
| 2nd step | $SiH_4$/He = 1 $SiF_4$/He = 1 | | | 15 |

| | |
|---|---|
| Al support temperature: | 250° C. |
| Discharge frequency: | 13.56 MHz |
| Discharge power: | 0.18 W/cm$^2$ |
| Pressure upon reaction: | 0.3 Torr |
| Layer deposition rate: | 11 Å/S |

EXAMPLE 73

By repeating the procedures in Example 68 except that the second layer formation step was changed as in Table 75 below, or repeating the procedures in Example 69 except that the second layer and the third layer preparation steps were changed as in Table 75 below, electrophotographic image forming members were prepared, and evaluated as in Example 66. The image quality and the durability were good.

TABLE 75

| Condition | Used gas | Flow rate (SCCM) | Flow rate ratio | Layer thickness (μ) |
|---|---|---|---|---|
| 1 | $SiH_4$/He = 1 $B_2H_6$/He = $10^{-2}$ | $SiH_4$ = 200 | $B_2H_6$/$SiH_4$ = 2 × $10^{-5}$ | 15 |
| 2 | $SiH_4$/He = 1 $B_2H_6$/He = $10^{-2}$ NO | $SiH_4$ = 200 | $B_2H_6$/$SiH_4$ = 1 × $10^{-5}$ NO/$SiH_4$ = 1.5 × $10^{-2}$ | 15 |
| 3 | $Si_2H_6$/He = 1 $B_2H_6$/He = $10^{-2}$ | $Si_2H_6$ = 170 | $B_2H_6$/$Si_2H_6$ = 3 × $10^{-4}$ | 10 |
| 4 | $SiH_4$/He = 1 $SiF_4$/He = 1 $B_2H_6$/He = $10^{-2}$ | $SiH_4$ + $SiF_4$ = 100 | $SiH_4$:$SiF_4$ = 8:2 $B_2H_6$/($SiH_4$ + $SiF_4$) = 2 × $10^{-5}$ | 15 |
| 5 | $SiH_4$/He = 1 NO | $SiH_4$ = 200 | NO/$SiH_4$ = 1.5 × $10^{-2}$ | 15 |

EXAMPLE 74

By using the production apparatus in FIG. 8, layer formation was effected on an Al support under the following conditions.

The resulting image forming member was set in a charging-exposing-developing apparatus and subjected to a corona charging at ⊖5 KV for 0.2 sec, immediately followed by imagewise exposure at 1.0 lux.sec through a transparent test chart by a tungsten lamp as a light source.

Immediately thereafter, development was effected with a ⊕ charged developer (including toner and carrier) by cascading to produce a good toner image on the surface of the image forming member.

The resulting toner image was once cleaned with a rubber blade, and the above mentioned image forming and cleaning steps were repeated. Even when repeated 150,000 times or more, any degradation of image was not observed.

TABLE 76

| | Layer preparation step | Used gas | Flow rate (SCCM) | | Discharge power ($W/cm^2$) | Layer deposition rate (Å/sec) | Layer thickness (μ) |
|---|---|---|---|---|---|---|---|
| | | | | Flow rate ratio | | | |
| Amorphous layer (I) | 1st step | $SiH_4/He = 1$<br>$PH_3/He = 10^{-2}$<br>NO | $SiH_4 = 200$ | $PH_3/SiH_4 = 1.0 \times 10^{-3}$<br>$NO/SiH_4 = 3 \times 10^{-2}$ | 0.18 | 11 | 0.3 |
| | 2nd step | $SiH_4/He = 1$ | $SiH_4 = 200$ | | 0.18 | 11 | 15 |
| | | | | Area ratio | | | |
| Amorphous layer (II) | 3rd step | Ar | 200 | Si wafer:Graphite = 1.5:8.5 | 0.3 | 2 | 0.5 |
| | | Al support temperature: | | 250° C. | | | |
| | | Discharge frequency: | | 13.56 MHz | | | |
| | | Pressure in the reaction chamber: | | 0.3 Torr upon forming amorphous layer (I);<br>0.2 Torr upon forming amorphous layer (II) | | | |

EXAMPLE 75

By using the production apparatus in FIG. 8, layer formation was effected on an Al support under the following conditions. The other conditions were as in Example 74. The resulting image forming member was set in a charging-exposing-developing apparatus and subjected to a corona charging at ⊖5 KV for 0.2 sec, immediately followed by imagewise exposure at 1.0 lux.sec through a transparent test chart by a tungsten lamp as a light source.

Immediately thereafter, development was effected with a ⊕ charged developer (including toner and carrier) by cascading to produce a good toner image on the surface of the image forming member.

The resulting toner image was once cleaned with a rubber blade, and the above mentioned image forming and cleaning steps were repeated. Even when repeated 100,000 times or more, any degradation of image was not observed.

TABLE 77

| | Layer preparation step | Used gas | Flow rate (SCCM) | | Discharge power ($W/cm^2$) | Layer deposition rate (Å/sec) | Layer thickness (μ) |
|---|---|---|---|---|---|---|---|
| | | | | Flow rate ratio | | | |
| Amorphous layer (I) | 1st step | $SiH_4/He = 1$<br>$PH_3/He = 10^{-2}$<br>NO | $SiH_4 = 200$ | $PH_3/SiH_4 = 1.0 \times 10^{-3}$<br>$NO/SiH_4 = 1.5 \times 10^{-2}$ | 0.18 | 11 | 0.3 |
| | 2nd step | $SiH_4/He = 1$<br>NO | $SiH_4 = 200$ | $NO/SiH_4 = 1.5 \times 10^{-2}$ | 0.18 | 11 | 0.1 |
| | 3rd step | $SiH_4/He = 1$ | $SiH_4 = 200$ | | 0.18 | 11 | 15 |
| | | | | Area ratio | | | |
| Amorphous layer (II) | 4th step | Ar | 200 | Si wafer:Graphite = 0.5:9.5 | 0.3 | 1.5 | 0.3 |

EXAMPLE 76

By using the production apparatus in FIG. 8, layer formation was effected on an Al support under the following conditions. The other conditions were the same as in Example 74. The resulting image forming member was set in a charging-exposing-developing apparatus and subjected to a corona charging at ⊖5 KV for 0.2 sec, immediately followed by imagewise exposure at 1.0 lux.sec through a transparent test chart by a tungsten lamp as a light source.

Immediately thereafter, development was effected with a ⊕ charged developer (including toner and carrier) by cascading to produce a good toner image of a very high density on the surface of the image forming member.

The resulting toner image was once cleaned with a rubber blade, and the above mentioned image forming and cleaning steps were repeated. Even when repeated 150,000 times or more, any degradation of image was not observed.

TABLE 78

| | Layer preparation step | Used gas | Flow rate (SCCM) | | Discharge power (W/cm²) | Layer deposition rate (Å/sec) | Layer thickness (μ) |
|---|---|---|---|---|---|---|---|
| | | | | Flow rate ratio | | | |
| Amorphous layer (I) | 1st step | $SiH_4/He = 1$<br>$PH_3/He = 10^{-2}$<br>NO | $SiH_4 = 200$ | $PH_3/SiH_4 = 5 \times 10^{-4}$<br>$NO/SiH_4 = 10^{-1}$ | 0.18 | 11 | 0.2 |
| | 2nd step | $SiH_4/He = 1$<br>$PH_3/He = 10^{-2}$ | $SiH_4 = 200$ | $PH_3/SiH_4 = 5 \times 10^{-4}$ | 0.18 | 11 | 0.3 |
| | 3rd step | $SiH_4/He = 1$ | $SiH_4 = 200$ | | 0.18 | 11 | 15 |
| | | | | Area ratio | | | |
| Amorphous layer (II) | 4th step | Ar | 200 | Si wafer:Graphite = 6:4 | 0.3 | 3 | 1.0 |

EXAMPLE 77

By repeating the procedures in Example 76 except that, upon producing the second amorphous layer (II), the area ratio of silicon wafer to graphite to change the content ratio of silicon atom to carbon atom in the layer (II), image forming members were produced, and subjected to the image forming, developing and cleaning steps as in Example 74 repeatedly about 50,000 times, and image evaluation was made. The results are shown in Table 79 below.

TABLE 79

| | | | | | | | |
|---|---|---|---|---|---|---|---|
| Si:C target (Area ratio) | 9:1 | 6.5:3.5 | 4:6 | 2:8 | 1:9 | 0.5:9.5 | 0.2:9.8 |
| Si:C (Content ratio) | 9.7:0.3 | 8.8:1.2 | 7.3:2.7 | 4.8:5.2 | 3:7 | 2:8 | 0.8:9.2 |
| Image quality evaluation | Δ | ○ | ◎ | ◎ | ◎ | ○ | X |

◎: Very good
○: Good
Δ: Sufficiently practically usable
X: Defective images were liable to be formed.

EXAMPLE 78

By repeating the procedure in Example 74 except that the thickness of the second amorphous layer (II), image forming members were produced, and subjected to the image forming, developing and cleaning steps as in Example 74 repeatedly. The results are shown below.

TABLE 80

| Thickness of amorphous Layer (II) (μ) | Result |
|---|---|
| 0.001 | Defective images were liable to be formed. |
| 0.02 | No defective image was formed when repeated 20,000 times. |
| 0.05 | Stable when repeated 50,000 times or more. |
| 0.3 | Stable when repeated 100,000 times or more. |

EXAMPLE 79

By repeating the procedures in Example 74 except that the formation of the second amorphous layer (I) was changed as shown in the following table, an image forming member was produced, and evaluated as in Example 74. A good result was obtained.

EXAMPLE 80

By repeating the procedures in Example 74 except that the formation of the first amorphous layer (I) was changed as shown in the following table, an image forming member was produced, and evaluated as in Example 74. A good result was obtained.

TABLE 81

| | Layer preparation step | Used gas | Flow rate (SCCM) | Flow rate ratio | Discharge power (W/cm²) | Layer deposition rate (Å/sec) | Layer thickness (μ) |
|---|---|---|---|---|---|---|---|
| Amorphous layer (I) | 1st step | $Si_2H_6/He = 1$<br>$PH_3/He = 10^{-2}$<br>NO | $Si_2H_6 = 170$ | $PH_3/Si_2H_6 = 3.2 \times 10^{-3}$<br>$NO/Si_2H_6 = 9 \times 10^{-2}$ | 0.54 | 40 | 0.3 |
| | 2nd step | $Si_2H_6/He = 1$ | $Si_2H_6 = 170$ | | 0.54 | 40 | 15 |

TABLE 82

| | Layer preparation step | Used gas | Flow rate (SCCM) | Flow rate ratio | Discharge power (W/cm²) | Layer deposition rate (Å/sec) | Layer thickness (μ) |
|---|---|---|---|---|---|---|---|
| Amorphous layer (I) | 1st step | $SiH_4/He = 1$<br>$SiF_4/He = 1$<br>$PH_3/He = 10^{-2}$<br>NO | $SiH_4 + SiF_4 = 150$ | $SiH_4/SiF_4 = 8/2$<br>$PH_3/(SiH_4 + SiF_4) = 1.0 \times 10^{-3}$<br>$NO/(SiH_4 + SiF_4) = 0.03$ | 0.18 | 11 | 0.3 |
| | 2nd step | $SiH_4/He = 1$<br>$SiF_4/He = 1$ | $SiH_4 + SiF_4 = 150$ | | 0.18 | 11 | 15 |

EXAMPLE 81

By repeating the procedures in Example 74 except that the formation of the first amorphous layer (I) was changed as shown in the following table, an image forming member was produced, and evaluated as in Example 74. A good result was obtained.

TABLE 82A

| | Layer preparation step | Used gas | Flow rate (SCCM) | Flow rate ratio | Discharge power (W/cm$^2$) | Layer deposition rate (Å/sec) | Layer thickness (μ) |
|---|---|---|---|---|---|---|---|
| Amorphous layer (I) | 1st step | $SiH_4/He = 1$<br>$SiF_4/He = 1$<br>$PH_3/He = 10^{-2}$<br>NO | $SiH_4 + SiF_4 = 150$ | $SiH_4/SiF_4 = 8/2$<br>$PH_3/(SiH_4 + SiF_4) = 1.0 \times 10^{-4}$<br>$NO/(SiH_4 + SiF_4) = 0.02$ | 0.18 | 11 | 0.3 |
| | 2nd step | $SiH_4/He = 1$<br>$SiF_4/He = 1$ | $SiH_4 + SiF_4 = 150$ | | 0.18 | 11 | 18 |

EXAMPLE 82

By repeating the procedures in Example 75 except that the formation of the second layer and the third layer was effected under the conditions in Table 83 below, electrophotographic image forming members were produced, and evaluated as in Example 74. The results were good for the image quality and the durability.

TABLE 83

| Condition | Used gas | Flow rate (SCCM) | Flow rate ratio | Layer thickness (μ) |
|---|---|---|---|---|
| 1 | $SiH_4/He = 1$<br>$B_2H_6/He = 10^{-2}$ | $SiH_4 = 200$ | $B_2H_6/SiH_4 = 2 \times 10^{-5}$ | 15 |
| 2 | $SiH_4/He = 1$<br>$B_2H_6/He = 10^{-2}$<br>NO | $SiH_4 = 200$ | $B_2H_6/SiH_4 = 1 \times 10^{-5}$<br>$NO/SiH_4 = 1.5 \times 10^{-2}$ | 15 |
| 3 | $Si_2H_6/He = 1$<br>$B_2H_6/He = 10^{-2}$ | $Si_2H_6 = 170$ | $B_2H_6/Si_26 = 3 \times 10^{-4}$ | 10 |
| 4 | $SiH_4/He = 1$<br>$SiF_4/He = 1$<br>$B_2H_6/He = 10^{-2}$ | $(SiH_4 + SiF_4) = 100$ | $SiH_4:SiF_4 = 8:2$<br>$B_2H_6/(SiH_4 + SiF_4) = 2 \times 10^{-5}$ | 15 |
| 5 | $SiH_4/He = 1$<br>NO | $SiH_4 = 200$ | $NO/SiH_4 = 1.5 \times 10^{-2}$ | 15 |

EXAMPLE 83

By using the production apparatus in FIG. 7, layer formation was effected on a drum-like Al support under the following conditions.

The resulting photosensitive drum (electrophotographic image forming member) was set in a copying apparatus and subjected to a corona charging at ⊖5 KV for 0.2 sec, followed by imagewise exposure at 1.0 lux.-sec by a tungsten lamp as a light source. The resulting latent image was developed with a ⊕ charged developer (including toner and carrier) and then transferred to a plain paper. The transferred image was very good. The toner remaining on the photosensitive drum without transferred was cleaned with a rubber blade, and the next copying step started.

Even when such copying step was repeated 150,000 times or more, any degradation of image was not observed.

TABLE 84

| | Layer preparation step | Used gas | Flow rate (SCCM) | Flow rate ratio | Discharge power (W/cm$^2$) | Layer deposition rate (Å/sec) | Layer thickness (μ) |
|---|---|---|---|---|---|---|---|
| Amorphous layer (I) | 1st step | $SiH_4/He = 1$<br>$PH_3/He = 10^{-2}$<br>NO | $SiH_4 = 200$ | $PH_3/SiH_4 = 1.0 \times 10^{-3}$<br>$NO/SiH_4 = 3 \times 10^{-2}$ | 0.18 | 11 | 0.3 |
| | 2nd step | $SiH_4/He = 1$ | $SiH_4 = 200$ | | 0.18 | 11 | 15 |
| Amorphous layer (II) | 3rd step | $SiH_4/He = 0.5$<br>$C_2H_4$ | $SiH_4 = 100$ | $SiH_4:C_2H_4 = 3:7$ | 0.18 | 6 | 0.5 |

| | |
|---|---|
| Al support temperature: | 250° C. |
| Discharge frequency: | 13.56 MHz |
| Pressure in the reaction chamber: | 0.3 Torr upon forming amorphous layer (I);<br>0.2 Torr upon forming amorphous layer (II) |

EXAMPLE 84

By using the production apparatus in FIG. 7, layer formation was effected on an Al cylinder-like support under the following conditions. The other conditions were the same as those in Example 83. The resulting photosensitive drum was set in a copying apparatus and subjected to a corona charging at ⊖5 KV for 0.2 sec, followed by imagewise exposure at 1.0 lux.sec by a tungsten lamp as a light source. The resulting latent image was developed with a ⊕ charged developer (including toner and carrier) and then transferred to a plain paper. The transferred image was very good. The toner remaining on the photosensitive drum without transferred was cleaned with a rubber blade, and the next copying step started.

Even when such copying step was repeated 100,000 times or more, any degradation of image was not observed.

TABLE 85

| | Layer preparation step | Used gas | Flow rate (SCCM) | Flow rate ratio | Discharge power (W/cm$^2$) | Layer deposition rate (Å/sec) | Layer thickness (μ) |
|---|---|---|---|---|---|---|---|
| Amorphous layer (I) | 1st step | $SiH_4/He = 1$<br>$PH_3/He = 10^{-2}$<br>NO | $SiH_4 = 200$ | $PH_3/SiH_4 = 1.0 \times 10^{-3}$<br>$NO/SiH_4 = 1.5 \times 10^{-2}$ | 0.18 | 11 | 0.3 |
| | 2nd step | $SiH_4/He = 1$<br>NO | $SiH_4 = 200$ | $NO/SiH_4 = 1.5 \times 10^{-2}$ | 0.18 | 11 | 0.1 |
| | 3rd step | $SiH_4/He = 1$ | $SiH_4 = 200$ | | 0.18 | 11 | 15 |
| Amorphous layer (II) | 4th step | $SiH_4/He = 1$<br>$C_2H_4$ | $SiH_4 = 15$ | $SiH_4:C_2H_4 = 0.4:9.6$ | 0.18 | 1 | 0.3 |

EXAMPLE 85

By using the production apparatus in FIG. 7, layer formation was effected on an Al support under the following conditions. The other conditions were the same as those in Example 83. The resulting photosensitive drum was set in a copying apparatus and subjected to a corona charging at ⊖5 KV for 0.2 sec, followed by imagewise exposure at 1.0 lux.sec by a tungsten lamp as a light source. The resulting latent image was developed with a ⊕ charged developer (including toner and carrier) and then transferred to a plain paper. The transferred image was very good and had a very high density. The toner remaining on the photosensitive drum without transferred was cleaned with a rubber blade, and the next copying step started.

Even when such copying step was repeated 150,000 times or more, any degradation of image was not observed.

TABLE 86

| | Layer preparation step | Used gas | Flow rate (SCCM) | Flow rate ratio | Discharge power (W/cm$^2$) | Layer deposition rate (Å/sec) | Layer thickness (μ) |
|---|---|---|---|---|---|---|---|
| Amorphous layer (I) | 1st step | $SiH_4/He = 1$<br>$PH_3/He = 10^{-2}$<br>NO | 200 | $PH_3/SiH_4 = 5 \times 10^{-4}$<br>$NO/SiH_4 = 10^{-1}$ | 0.18 | 11 | 0.2 |
| | 2nd step | $SiH_4/He = 1$<br>$PH_3/He = 10^{-2}$ | 200 | $PH_3/SiH_4 = 5 \times 10^{-4}$ | 0.18 | 11 | 0.3 |
| | 3rd step | $SiH_4/He = 1$ | 200 | | 0.18 | 11 | 15 |
| Amorphous layer (II) | 4th step | $SiH_4/He = 0.5$<br>$C_2H_4$ | $SiH_4 = 100$ | $SiH_4:C_2H_4 = 5:5$ | 0.18 | 6 | 1.5 |

EXAMPLE 86

By repeating the procedures in Example 83 except that, upon producing amorphous layer (II), the flow rate ratio of $SiH_4$ gas to $C_2H_4$ gas was changed to change the content ratio of Si atom to carbon atom, a photosensitive drum was produced, and was repeatedly subjected to the steps up to transferring as in Example 83 about 50,000 times. Then, image evaluation was made. The results are shown in Table 87.

TABLE 87

| | | | | | | | | |
|---|---|---|---|---|---|---|---|---|
| $SiH_4:C_2H_4$ (Flow rate ratio) | 9:1 | 6:4 | 4:6 | 2:8 | 1:9 | 0.5:9.5 | 0.35:9.65 | 0.2:9.8 |
| Si:C (Content ratio) | 9:1 | 7:3 | 5.5:4.5 | 4:6 | 3:7 | 2:8 | 1.2:8.8 | 0.8:9.2 |
| Image quality | Δ | ○ | ◎ | ◎ | ◎ | ◎ | ○ | X |

◎: Very good
○: Good
Δ: Practically sufficient
X: Defective images were formed.

effected and evaluation was made. A good result was obtained.

TABLE 89

| | Layer preparation step | Used gas | Flow rate (SCCM) | Flow rate ratio | Discharge power (W/cm$^2$) | Layer deposition rate (Å/sec) | Layer thickness (μ) |
|---|---|---|---|---|---|---|---|
| Amorphous layer (I) | 1st step | $Si_2H_6$/He = 1<br>$PH_3$/He = $10^{-2}$<br>NO | $Si_2H_6$ = 170 | $PH_3/Si_2H_6 = 3.2 \times 10^{-3}$<br>$NO/Si_2H_6 = 9 \times 10^{-2}$ | 0.54 | 40 | 0.3 |
| | 2nd step | $Si_2H_6$/He = 1 | $Si_2H_6$ = 170 | | 0.54 | 40 | 15 |

EXAMPLE 87

By repeating the procedures in Example 83 except that the thickness of amorphous layer (II) was changed as shown in the table below, layer formation was effected. The result of evaluation is as follows.

TABLE 88

| Thickness of amorphous layer (II) (μ) | Result |
|---|---|
| 0.001 | Defective image were liable to be formed. |
| 0.02 | When repeated 20,000 times, no defective image was formed. |
| 0.05 | When repeated 50,000 times, no defective image was formed. |
| 0.3 | Stable when repeated 100,000 times or more. |

EXAMPLE 88

By repeating the procedures in Example 83 except that the formation of amorphous layer (I) was changed as shown in the following table, layer formation was effected and evaluation was made. A good result was obtained.

TABLE 90

| | Layer preparation step | Used gas | Flow rate (SCCM) | Flow rate ratio | Discharge power (W/cm$^2$) | Layer deposition rate (Å/sec) | Layer thickness (μ) |
|---|---|---|---|---|---|---|---|
| Amorphous layer (I) | 1st step | $SiH_4$/He = 1<br>$SiF_4$/He = 1<br>$PH_3$/He = $10^{-2}$<br>NO | $SiH_4 + SiF_4$ = 150 | $SiH_4/SiF_4$ = 8/2<br>$PH_3/(SiH_4 + SiF_4) = 1.0 \times 10^{-3}$<br>$NO/(SiH_4 + SiF_4)$ = 0.03 | 0.18 | 11 | 0.3 |
| | 2nd step | $SiH_4$/He = 1<br>$SiF_4$/He = 1 | $SiH_4 + SiF_4$ = 150 | | 0.18 | 11 | 15 |

EXAMPLE 89

By repeating the procedures in Example 83 except that the formation of amorphous layer (I) was changed as shown in the following table, layer formation was effected and evaluation was made. A good result was obtained.

EXAMPLE 90

By repeating the procedures in Example 84 except that, upon preparation of the second layer and the third layer in Example 84, the conditions in Table 91 below were employed, electrophotographic image forming members were produced, and were evaluated as in Example 83. The image quality and the durability were good.

TABLE 91

| Condition | Used gas | Flow rate (SCCM) | Flow rate ratio | Layer thickness (μ) |
|---|---|---|---|---|
| 1 | $SiH_4$/He = 1<br>$B_2H_6$/He = $10^{-2}$ | $SiH_4$ = 200 | $B_2H_6/SiH_4 = 2 \times 10^{-5}$ | 15 |
| 2 | $SiH_4$/He = 1<br>$B_2H_6$/He = $10^{-2}$<br>NO | $SiH_4$ = 200 | $B_2H_6/SiH_4 = 1 \times 10^{-5}$<br>$NO/SiH_4 = 1.5 \times 10^{-2}$ | 15 |
| 3 | $Si_2H_6$/He = 1<br>$B_2H_6$/He = $10^{-2}$ | $Si_2H_6$ = 170 | $B_2H_6/Si_2H_6 = 3 \times 10^{-4}$ | 10 |
| 4 | $SiH_4$/He = 1<br>$SiF_4$/He = 1<br>$B_2H_6$/He = $10^{-2}$ | $SiH_4 + SiF_4$ = 100 | $SiH_4:SiF_4$ = 8:2<br>$B_2H_6/(SiH_4 + SiF_4) = 2 \times 10^{-5}$ | 15 |
| 5 | $SiH_4$/He = 1<br>NO | $SiH_4$ = 200 | $NO/SiH_4 = 1.5 \times 10^{-2}$ | 15 |

EXAMPLE 91

By using the production apparatus in FIG. 7, layer formation was effected on an Al support under the following conditions.

The resulting image forming member was set in a charging-exposing-developing apparatus and subjected to a corona charging at ⊖5 KV for 0.2 sec, immediately followed by imagewise exposure at 1.0 lux.sec through a transparent test chart by a tungsten lamp as a light source.

Immediately thereafter, development was effected with a ⊕ charged developer (including toner and carrier) by cascading to produce a good toner image on the surface of the image forming member.

The resulting toner image was once cleaned with a rubber blade, and the above mentioned image forming and cleaning steps were repeated. Even when repeated 150,000 times or more, any degradation of image was not observed.

TABLE 93

| | Layer preparation step | Used gas | Flow rate (SCCM) | Flow rate ratio | Discharge power (W/cm$^2$) | Layer deposition rate (Å/sec) | Layer thickness (μ) |
|---|---|---|---|---|---|---|---|
| Amorphous layer (I) | 1st step | $SiH_4/He = 1$<br>$PH_3/He = 10^{-2}$<br>NO | $SiH_4 = 200$ | $PH_3/SiH_4 = 1.0 \times 10^{-3}$<br>$NO/SiH_4 = 1.5 \times 10^{-2}$ | 0.18 | 11 | 0.3 |
| | 2nd step | $SiH_4/He = 1$<br>NO | $SiH_4 = 200$ | $NO/SiH_4 = 1.5 \times 10^{-2}$ | 0.18 | 11 | 0.1 |
| | 3rd step | $SiH_4/He = 1$ | $SiH_4 = 200$ | | 0.18 | 11 | 15 |
| Amorphous layer (II) | 4th step | $SiH_4/He = 0.5$<br>$SiF_4/He = 0.5$<br>$C_2H_4$ | $SiH_4 + SiF_4 = 15$ | $SiH_4:SiF_4:C_2H_4 = 0.3:0.1:9.6$ | 0.18 | 1.5 | 0.3 |

EXAMPLE 92

By using the production apparatus in FIG. 7, layer formation was effected on an Al support under the following conditions. The other conditions were the same as those in Example 91.

The resulting image forming member was set in a charging-exposing-developing apparatus and subjected to a corona charging at ⊖5 KV for 0.2 sec, immediately followed by imagewise exposure at 1.0 lux.sec through a transparent test chart by a tungsten lamp as a light source.

Immediately thereafter, development was effected with a ⊕ charged developer (including toner and carrier) by cascading to produce a good toner image on the surface of the image forming member.

The resulting toner image was once cleaned with a rubber blade, and the above mentioned image forming and cleaning steps were repeated. Even when repeated 100,000 times or more, any degradation of image was not observed.

TABLE 92

| | Layer preparation step | Used gas | Flow rate (SCCM) | Flow rate ratio | Discharge power (W/cm$^2$) | Layer deposition rate (Å/sec) | Layer thickness (μ) |
|---|---|---|---|---|---|---|---|
| Amorphous layer (I) | 1st step | $SiH_4/He = 1$<br>$PH_3/He = 10^{-2}$<br>NO | $SiH_4 = 200$ | $PH_3/SiH_4 = 1.0 \times 10^{-3}$<br>$NO/SiH_4 = 3 \times 10^{-2}$ | 0.18 | 11 | 0.3 |
| | 2nd step | $SiH_4/He = 0.5$ | $SiH_4 = 200$ | | 0.18 | 11 | 15 |
| Amorphous layer (II) | 3rd step | $SiH_4/He = 0.5$<br>$SiF_4/He = 0.5$<br>$C_2H_4$ | $SiH_4 + SiF_4 = 150$ | $SiH_4:SiF_4:C_2H_4 = 1.5:1.5:7$ | 0.18 | 5 | 0.5 |

| | |
|---|---|
| Al support temperature: | 250° C. |
| Discharge frequency: | 13.56 MHz |
| Pressure in the reaction chamber: | 0.3 Torr upon forming amorphous layer (I);<br>0.2 Torr upon forming amorphous layer (II) |

EXAMPLE 93

By using the production apparatus in FIG. 7, layer formation was effected on an Al support under the following conditions. The other conditions were the same as those in Example 91.

The resulting image forming member was set in a charging-exposing-developing apparatus and subjected to a corona charging at ⊖5 KV for 0.2 sec, immediately followed by imagewise exposure at 1.0 lux.sec through a transparent test chart by a tungsten lamp as a light source.

Immediately thereafter, development was effected with a ⊕ charged developer (including toner and carrier) by cascading to produce a good image having a very high density on the surface of the image forming member.

The resulting toner image was once cleaned with a rubber blade, and the above mentioned image forming and cleaning steps were repeated. Even when repeated 150,000 times or more, any degradation of image was not observed.

TABLE 94

| | Layer preparation step | Used gas | Flow rate (SCCM) | Flow rate ratio | Discharge power (W/cm$^2$) | Layer deposition rate (Å/sec) | Layer thickness (μ) |
|---|---|---|---|---|---|---|---|
| Amorphous layer (I) | 1st step | $SiH_4$/He = 1<br>$PH_3$/He = $10^{-2}$<br>NO | 200 | $PH_3/SiH_4 = 5 \times 10^{-4}$<br>$NO/SiH_4 = 10^{-1}$ | 0.18 | 11 | 0.2 |
| | 2nd step | $SiH_4$/He = 1<br>$PH_3$/He = $10^{-2}$ | 200 | $PH_3/SiH_4 = 5 \times 10^{-4}$ | 0.18 | 11 | 0.3 |
| | 3rd step | $SiH_4$/He = 1 | 200 | | 0.18 | 11 | 15 |
| Amorphous layer (II) | 4th step | $SiH_4$/He = 0.5<br>$SiF_4$/He = 0.5<br>$C_2H_4$ | $SiH_4 + SiF_4 = 150$ | $SiH_4:SiF_4:C_2H_4$ = 3:3:4 | 0.18 | 5 | 1.5 |

EXAMPLE 94

By repeating the procedures in Example 91 except the content ratio of Si atom to carbon atom in the second amorphous layer (II), an image forming member was produced. The resulting image forming members were subjected to the image forming, developing and cleaning steps as in Example 91 about 50,000 times, and image evaluation was effected. The results are shown in Table 95.

TABLE 95

| $SiH_4:SiF_4:C_2H_4$ | 5:4:1 | 3:3.5:3.5 | 2:2:6 | 1:1:8 | 0.6:0.4:9 | 0.2:0.3:9.5 | 0.2:0.15:9.65 | 0.1:0.1:9.8 |
|---|---|---|---|---|---|---|---|---|
| Si:C (Content ratio) | 9:1 | 7:3 | 5.5:4.5 | 4:6 | 3:7 | 2:8 | 1.2:8.8 | 0.8:9.2 |
| | Δ | ○ | ◎ | ◎ | ◎ | ◎ | ○ | X |

◎: Very good
○: Good
Δ: Sufficiently practical
X: Defective images were formed.

TABLE 96

| Thickness of amorphous layer (II) (μ) | Result |
|---|---|
| 0.001 | Defective images were liable to be formed. |
| 0.02 | When repeated 20,000 times, no defective image was formed. |
| 0.05 | Stable when repeated 50,000 times or more. |
| 0.3 | Stable when repeated 100,000 times or more. |

EXAMPLE 95

By repeating the procedures in Example 91 except that the second amorphous layer (II) thickness was changed, image forming members were produced and subjected to the image forming, developing and cleaning steps as in Example 91. The results are shown below.

EXAMPLE 96

By repeating the procedures in Example 91 except that the formation of the first amorphous layer (I) was changed as shown below, an image forming member was produced, and evaluated as in Example 91. A good result was obtained.

TABLE 97

| | Layer preparation step | Used gas | Flow rate (SCCM) | Flow rate ratio | Discharge power (W/cm$^2$) | Layer deposition rate (Å/sec) | Layer thickness (μ) |
|---|---|---|---|---|---|---|---|
| Amorphous layer (I) | 1st step | $Si_2H_6$/He = 1<br>$PH_3$/He = $10^{-2}$<br>NO | $Si_2H_6$ = 170 | $PH_3/Si_2H_6 = 3.2 \times 10^{-3}$<br>$NO/Si_2H_6 = 9 \times 10^{-2}$ | 0.54 | 40 | 0.3 |
| | 2nd step | $Si_2H_6$/He = 1 | $Si_2H_6$ = 170 | | 0.54 | 40 | 15 |

EXAMPLE 97

By using the procedures in Example 91 except that the formation of the first amorphous layer (I) was changed as shown in the following table, an image forming member was produced, and evaluated as in Example 91. A good result was obtained.

TABLE 98

| | Layer preparation step | Used gas | Flow rate (SCCM) | Flow rate ratio | Discharge power (W/cm$^2$) | Layer deposition rate (Å/sec) | Layer thickness (μ) |
|---|---|---|---|---|---|---|---|
| Amorphous layer | 1st step | $SiH_4$/He = 1<br>$SiF_4$/He = 1 | $SiH_4 + SiF_4 = 150$ | $SiH_4/SiF_4$ = 8/2<br>$PH_3/(SiH_4 + SiF_4) = 1.0 \times 10^{-3}$ | 0.18 | 11 | 0.3 |

TABLE 98-continued

| | Layer preparation step | Used gas | Flow rate (SCCM) | Flow rate ratio | Discharge power (W/cm²) | Layer deposition rate (Å/sec) | Layer thickness (μ) |
|---|---|---|---|---|---|---|---|
| (I) | | $PH_3/He = 10^{-2}$<br>NO | | $NO/(SiH_4 + SiF_4) = 0.03$ | | | |
| | 2nd step | $SiH_4/He = 1$<br>$SiF_4/He = 1$ | $SiH_4 + SiF_4 = 150$ | | 0.18 | 11 | 15 |

EXAMPLE 98

By repeating the procedures in Example 93 except that the second amorphous layer (II) was prepared by sputtering under the following conditions, an image forming member was produced and evaluated as in Example 93. A good result was obtained.

TABLE 99

| | Used gas | Flow rate (SCCM) | Target area ratio (Si:C) | Discharge power (W/cm²) | Layer deposition rate (Å/sec) | Layer thickness (μ) |
|---|---|---|---|---|---|---|
| Amorphous layer (II) | Ar<br>$SiF_4/He = 0.5$ | Ar = 200<br>$SiF_4 = 100$ | 2.5:7.5 | 0.30 | 3 | 1 |

EXAMPLE 99

By repeating the procedures in Example 92 except that the layer forming conditions in the second and the third layer preparations were those as shown in Table 100, electrophotographic image forming members were produced and evaluated as in Example 91. The image quality and the durability were good.

TABLE 100

| Condition | Used gas | Flow rate (SCCM) | Flow rate ratio | Layer thickness (μ) |
|---|---|---|---|---|
| 1 | $SiH_4/He = 1$<br>$B_2H_6/He = 10^{-2}$ | $SiH_4 = 200$ | $B_2H_6/SiH_4 = 2 \times 10^{-5}$ | 15 |
| 2 | $SiH_4/He = 1$<br>$B_2H_6/He = 10^{-2}$<br>NO | $SiH_4 = 200$ | $B_2H_6/SiH_4 = 1 \times 10^{-5}$<br>$NO/SiH_4 = 1.5 \times 10^{-2}$ | 15 |
| 3 | $Si_2H_6/He = 1$<br>$B_2H_6/He = 10^{-2}$ | $Si_2H_6 = 170$ | $B_2H_6/Si_2H_6 = 3 \times 10^{-4}$ | 10 |
| 4 | $SiH_4/He = 1$<br>$SiF_4/He = 1$<br>$B_2H_6/He = 10^{-2}$ | $SiH_4 + SiF_4 = 100$ | $SiH_4:SiF_4 = 8:2$<br>$B_2H_6/(SiH_4 + SiF_4) = 2 \times 10^{-5}$ | 15 |
| 5 | $SiH_4/He = 1$<br>NO | $SiH_4 = 200$ | $NO/SiH_4 = 1.5 \times 10^{-2}$ | 15 |

EXAMPLE 100

By using the production apparatus in FIG. 7, layer formation was effected on a cylinder-like Al support under the following conditions.

The resulting image forming member was set in a charging-exposing-developing apparatus and subjected to a corona charging at ⊖5 KV for 0.2 sec, immediately followed by imagewise exposure at 1.0 lux.sec through a transparent test chart by a tungsten lamp as a light source.

Immediately thereafter, development was effected with a ⊕ charged developer (including toner and carrier) by cascading to produce a good toner image on the surface of the image forming member.

The resulting toner image was once cleaned with a rubber blade, and the above mentioned image forming and cleaning steps were repeated. Even when repeated 100,000 times or more, any degradation of image was not observed.

TABLE 101

| Constituting layer | Layer preparation step | Used gas | Flow rate (SCCM) | Flow rate ratio | Layer thickness (μ) |
|---|---|---|---|---|---|
| Interface layer | 1st step | $SiH_4/He = 1$<br>$NH_3$ | $SiH_4 = 10$ | $SiH_4:NH_3 = 1:30$ | 0.05 |
| Amorphous layer | 2nd step | $SiH_4/He = 1$<br>$PH_3/He = 10^{-2}$<br>NO | $SiH_4 = 200$ | $SiH_4:PH_3 = 1:1.0 \times 10^{-3}$<br>$SiH_4:NO = 1:0.03$ | 0.3 |
| | 3rd step | $SiH_4/He = 1$ | | | 15 |

| | |
|---|---|
| Al support temperature: | 250° C. |
| Discharge frequency: | 13.56 MHz |
| Discharge power: | 0.18 W/cm² |
| Pressure in the reaction chamber: | 0.3 Torr |

EXAMPLE 101

By repeating the procedures in Example 100 except that, in the second step of producing the image forming member, the flow rate of $PH_3$ gas diluted to 10000 vol.ppm with He gas and that of NO gas were changed, image forming members were produced and evaluated as in Example 100. The amounts of phosphorus atom and oxygen atom incorporated in each sample in the second step were analyzed by ion microanalysis (IMA method).

The results are shown in Table 102 below.

TABLE 102

| Phosphorus content (atomic ppm) | Oxygen content (atomic %) 0.001 | 1.3 | 6.0 | 30 |
|---|---|---|---|---|
| 10 | X (a) | X (a) | X (a) | X (a) |
| 30 | ○ | ○ | Δ | Δ |
| 500 | ○ | ⊙ | ⊙ | ○ |
| 2000 | ○ | ⊙ | ⊙ | ○ |
| 50000 | Δ | Δ | Δ | ○ |
| 80000 | X (b) | X (b) | X (b) | X (b) |

(1)In the table, the contents of oxygen atom and phosphorus atom are those incorporated in the second step of the preparation step.
(2)⊙Very good
○ Good
Δ Sufficiently practically usable
X(a) Poor image quality
X(b) Layer is liable to exfoliate.

EXAMPLE 102

By repeating the procedures in Example 100 except that the layer thickness of the layer produced in the second step was changed, image forming members were produced, and evaluated as in Example 100. The results are shown in Table 103.

TABLE 103

| Layer thickness of the layer containing oxygen and phosphorus atoms (μ) | 0.001 | 0.003 | 0.05 | 0.3 | 1 | 5 | 10 |
|---|---|---|---|---|---|---|---|
| Evaluation | X | ○ | ○ | ⊙ | ⊙ | ○ | X |

⊙Very good
○ Good
X Practically somewhat poor

EXAMPLE 103

By repeating the procedures in Example 100 except that the condition for the first step was changed as shown below, image forming members were produced and evaluated as in Example 100. The layer strength and the image quality were good.

TABLE 104

| Sample No. | Condition $SiH_4$:$NH_3$ (Flow rate) | Layer thickness (Å) |
|---|---|---|
| 1031 | 7:3 | 1000 |
| 1032 | 1:1 | 500 |
| 1033 | 1:3 | 300 |
| 1034 | 1:50 | 200 |

EXAMPLE 104

By using the production apparatus in FIG. 7, layer formation was effected on a cylinder-like aluminum support under the following conditions. The resulting image forming member was evaluated as in Example 100. The layer strength and the image quality were very good.

TABLE 105

| Layer preparation step | Used gas | Flow rate (SCCM) | Flow rate ratio | Layer thickness (μ) |
|---|---|---|---|---|
| 1st step | $SiH_4$/He = 1<br>$NH_3$ | $SiH_4$ = 10 | $SiH_4$:$NH_3$ = 1:30 | 0.05 |
| 2nd step | $SiH_4$/He = 1<br>$PH_3$/He = $10^{-2}$<br>NO | $SiH_4$ = 200 | $SiH_4$:$PH_3$ = 1:1.0 × $10^{-3}$<br>$SiH_4$:NO = 1:0.03 | 0.3 |
| 3rd step | $SiH_4$/He = 1<br>$NH_3$ | $SiH_4$ = 10 | $SiH_4$:$NH_3$ = 1:30 | 0.05 |
| 4th step | $SiH_4$/He = 1 | $SiH_4$ = 200 | | 15 |

EXAMPLE 105

By using the production apparatus in FIG. 7, layer formation was effected on a cylinder-like aluminum support under the following conditions. The resulting image forming member was evaluated as in Example 100. The result was good.

TABLE 106

| Constituting layer | Layer preparation step | Used gas | Flow rate (SCCM) | Flow rate ratio | Layer thickness (μ) |
|---|---|---|---|---|---|
| Interface layer | 1st step | $SiH_4$/He = 1<br>$SiF_4$/He = 1<br>$NH_3$ | $SiH_4$ = 8 | $SiH_4$:$SiF_4$ = 8:2<br>($SiH_4$ + $SiF_4$):$NH_3$ = 1:30 | 0.05 |
| Amorphous layer | 2nd step | $SiH_4$/He = 1<br>$SiF_4$/He = 1<br>$PH_3$/He = $10^{-2}$<br>NO | $SiH_4$ = 120 | $SiH_4$:$SiF_4$ = 8:2<br>($SiH_4$ + $SiF_4$):$PH_3$ = 1:1.0 × $10^{-3}$<br>($SiH_4$ + $SiF_4$):NO = 1:0.03 | 0.3 |
| | 3rd step | $SiH_4$/He = 1<br>$SiF_4$/He = 1 | | $SiH_4$:$SiF_4$ = 8:2 | 15 |

EXAMPLE 106

By using the apparatus in FIG. 7, layer formation was effected on an Al support following the procedures in Example 100 except the following conditions, and the resulting electrophotographic image forming member was evaluated as in Example 100. A good result was obtained.

TABLE 107

| Constituting layer | Layer preparation step | Used gas | Flow rate (SCCM) | Flow rate ratio | Discharge power (W/cm$^2$) | Layer deposition rate (Å/sec) | Layer thickness (μ) |
|---|---|---|---|---|---|---|---|
| Interface layer | 1st step | $SiH_4/He = 1$<br>$NH_3$ | $SiH_4 = 10$ | $NH_3/SiH_4 = 30$ | 0.18 | 5 | 0.05 |
| Amorphous layer | 2nd step | $SiH_4/He = 1$<br>$PH_3/He = 10^{-2}$<br>NO | $SiH_4 = 200$ | $PH_3/SiH_4 = 1.0 \times 10^{-3}$<br>$NO/SiH_4 = 1.5 \times 10^{-2}$ | 0.18 | 11 | 0.3 |
| | 3rd step | $SiH_4/He = 1$<br>NO | $SiH_4 = 200$ | $NO/SiH_4 = 1.5 \times 10^{-2}$ | 0.18 | 11 | 0.1 |
| | 4th step | $SiH_4/He = 1$ | $SiH_4 = 200$ | | 0.18 | 11 | 15 |

EXAMPLE 107

By using the apparatus in FIG. 7, layer formation was effected under the following conditions. The other conditions were the same as in Example 100. The resulting image forming member was evaluated as in Example 100. There was obtained an image of high quality and the durability was good.

EXAMPLE 108

By repeating the procedures in Example 106 except that the layer formation conditions for the third and the fourth steps in Example 106 were replaced by the following conditions in Table 109, electrophotographic image forming members were evaluated as in Example 100. The image quality and the durability were good.

TABLE 108

| Constituting layer | Layer preparation step | Used gas | Flow rate (SCCM) | Flow rate ratio | Discharge power (W/cm$^2$) | Layer deposition rate (Å/sec) | Layer thickness (μ) |
|---|---|---|---|---|---|---|---|
| Interface layer | 1st step | $SiH_4/He = 1$<br>$NH_3$ | $SiH_4 = 10$ | $NH_3/SiH_4 = 3$ | 0.18 | 5 | 0.05 |
| Amorphous layer | 2nd step | $SiH_4/He = 1$<br>$PH_3/He = 10^{-2}$<br>NO | $SiH_4 = 200$ | $PH_3/SiH_4 = 5 \times 10^{-3}$<br>$NO/SiH_4 = 1.5 \times 10^{-2}$ | 0.18 | 11 | 0.2 |
| | 3rd step | $SiH_4/He = 1$<br>$PH_3/He = 10^{-2}$ | $SiH_4 = 200$ | $PH_3/SiH_4 = 5 \times 10^{-4}$ | 0.18 | 11 | 0.3 |
| | 4th step | $SiH_4/He = 1$ | $SiH_4 = 200$ | | 0.18 | 11 | 15 |

EXAMPLE 109

By using the production apparatus in FIG. 7, layer formation was effected on an Al support under the following conditions.

The resulting image forming member was set in a charging-exposing-developing apparatus and subjected to a corona charging at ⊖5 KV for 0.2 sec, immediately followed by imagewise exposure at 1.0 lux.sec through a transparent test chart by a tungsten lamp as a light source.

Immediately thereafter, development was effected with a ⊕ charged developer (including toner and carrier) by cascading to produce a good toner image on the surface of the image forming member.

The resulting toner image was once cleaned with a rubber blade, and the above mentioned image forming and cleaning steps were repeated. Even when repeated 150,000 times, any degradation of image was not observed.

TABLE 109

| Condition | Used gas | Flow rate (SCCM) | Flow rate ratio | Layer thickness (μ) |
|---|---|---|---|---|
| 1 | $SiH_4/He = 1$<br>$B_2H_6/He = 10^{-2}$ | $SiH_4 = 200$ | $B_2H_6/SiH_4 = 2 \times 10^{-5}$ | 15 |
| 2 | $SiH_4/He = 1$<br>$B_2H_6/He = 10^{-2}$<br>NO | $SiH_4 = 200$ | $B_2H_6/SiH_4 = 1 \times 10^{-5}$<br>$NO/SiH_4 = 1.5 \times 10^{-2}$ | 15 |
| 3 | $Si_2H_6/He = 1$<br>$B_2H_6/He = 10^{-2}$ | $Si_2H_6 = 170$ | $B_2H_6/Si_2H_6 = 3 \times 10^{-4}$ | 10 |
| 4 | $SiH_4/He = 1$<br>$SiF_4/He = 1$<br>$B_2H_6/He = 10^{-2}$ | $SiH_4 + SiF_4 = 100$ | $SiH_4:SiF_4 = 8:2$<br>$B_2H_6/(SiH_4 + SiF_4) = 2 \times 10^{-5}$ | 15 |
| 5 | $SiH_4/He = 1$<br>NO | $SiH_4 = 200$ | $NO/SiH_4 = 1.5 \times 10^{-2}$ | 15 |

TABLE 110

| Constituting layer | Layer preparation step | Used gas | Flow rate (SCCM) | | Discharge power (W/cm$^2$) | Layer deposition rate (Å/sec) | Layer thickness (μ) |
|---|---|---|---|---|---|---|---|
| | | | | Flow rate ratio | | | |
| Interface layer | 1st step | $SiH_4/He = 1$<br>$NH_3$ | $SiH_4 = 10$ | $SiH_4:NH_3 = 1:30$ | 0.18 | 5 | 0.05 |
| Amorphous layer (I) | 2nd step | $SiH_4/He = 1$<br>$PH_3/He = 10^{-2}$<br>NO | $SiH_4 = 200$ | $PH_3/SiH_4 = 1.0 \times 10^{-3}$<br>$NO/SiH_4 = 3 \times 10^{-2}$ | 0.18 | 11 | 0.3 |
| | 3rd step | $SiH_4/He = 1$ | $SiH_4 = 200$ | | 0.18 | 11 | 15 |
| | | | | Area ratio | | | |
| Amorphous layer (II) | 4th step | Ar | 200 | Si wafer: Graphite = 1.5:8.5 | 0.3 | 2 | 0.5 |

| | |
|---|---|
| Al support temperature: | 250° C. |
| Discharge frequency: | 13.56 MHz |
| Pressure in the reaction chamber: | 0.3 Torr upon forming amorphous layer (I); 0.2 Torr upon forming amorphous layer (II) |

EXAMPLE 110

By using the production apparatus in FIG. 7, layer formation was effected on an Al support under the following conditions. The other conditions were the same as those in Example 109.

The resulting image forming member was set in a charging-exposing-developing apparatus and subjected to a corona charging at ⊖5 KV for 0.2 sec, immediately followed by imagewise exposure at 1.0 lux.sec through a transparent test chart by a tungsten lamp as a light source.

Immediately thereafter, development was effected with a ⊕ charged developer (including toner and carrier) by cascading to produce a good toner image on the surface of the image forming member.

The resulting toner image was once cleaned with a rubber blade, and the above mentioned image forming and cleaning steps were repeated. Even when repeated 100,000 times or more, any degradation of image was not observed.

EXAMPLE 111

By using the production apparatus in FIG. 7, layer formation was effected on an Al support under the following conditions. The other conditions were the same as those in Example 109.

The resulting image forming member was set in a charging-exposing-developing apparatus and subjected to a corona charging at ⊖5 KV for 0.2 sec, immediately followed by imagewise exposure at 1.0 lux.sec through a transparent test chart by a tungsten lamp as a light source.

Immediately thereafter, development was effected with a ⊕ charged developer (including toner and carrier) by cascading to produce a good toner image of a very high density on the surface of the image forming member.

The resulting toner image was once cleaned with a rubber blade, and the above mentioned image forming and cleaning steps were repeated. Even when repeated 150,000 times, any degradation of image was not observed.

TABLE 111

| Constituting layer | Layer preparation step | Used gas | Flow rate (SCCM) | | Discharge power (W/cm$^2$) | Layer deposition rate (Å/sec) | Layer thickness (μ) |
|---|---|---|---|---|---|---|---|
| | | | | Flow rate ratio | | | |
| Interface layer | 1st step | $SiH_4/He = 1$<br>$NH_3$ | $SiH_4 = 10$ | $NH_3/SiH_4 = 30$ | 0.18 | 5 | 0.05 |
| Amorphous layer (I) | 2nd step | $SiH_4/He = 1$<br>$PH_3/He = 10^{-2}$<br>NO | $SiH_4 = 200$ | $PH_3/SiH_4 = 1.0 \times 10^{-3}$<br>$NO/SiH_4 = 2 \times 10^{-2}$ | 0.18 | 11 | 0.3 |
| | 3rd step | $SiH_4/He = 1$ | $SiH_4 = 200$ | | 0.18 | 11 | 15 |
| | | | | Area ratio | | | |
| Amorphous layer (II) | 4th step | Ar | 200 | Si wafer:Graphite = 0.5:9.5 | 0.3 | 1.5 | 0.3 |

TABLE 112

| Constituting layer | Layer preparation step | Used gas | Flow rate (SCCM) | Flow rate ratio | Discharge power (W/cm$^2$) | Layer deposition rate (Å/sec) | Layer thickness (μ) |
|---|---|---|---|---|---|---|---|
| Interface layer | 1st step | $SiH_4/He = 1$<br>$NH_3$ | $SiH_4 = 10$ | $NH_3/SiH_4 = 3$ | 0.18 | 5 | 0.05 |
| Amorphous layer (I) | 2nd step | $SiH_4/He = 1$<br>$PH_3/He = 10^{-2}$<br>NO | $SiH_4 = 200$ | $PH_3/SiH_4 = 3 \times 10^{-3}$<br>$NO/SiH_4 = 3 \times 10^{-2}$ | 0.18 | 11 | 0.3 |

TABLE 112-continued

| Constituting layer | Layer preparation step | Used gas | Flow rate (SCCM) | Flow rate ratio | Discharge power (W/cm$^2$) | Layer deposition rate (Å/sec) | Layer thickness (μ) |
|---|---|---|---|---|---|---|---|
| | 3rd step | $SiH_4$/He = 1 | $SiH_4$ = 200 | | 0.18 | 11 | 15 |
| Amorphous layer (II) | 4th step | Ar | 200 | Si wafer:Graphite = 6:4 | 0.3 | 3 | 1.0 |

EXAMPLE 112

By repeating the procedures in Example 111 except that, upon forming the second amorphous layer (II), the area ratio of silicon wafer to graphite was changed to change the content ratio of silicon atom to carbon atom in the layer (II), image forming members were produced. The resulting image forming members were repeatedly subjected to the image forming, developing and cleaning steps as in Example 109 about 50,000 times, and the evaluation of the images was made. The results are shown in Table 113.

TABLE 113

| | | | | | | | |
|---|---|---|---|---|---|---|---|
| Si:C target (Area ratio) | 9:1 | 6.5:3.5 | 4:6 | 2:8 | 1:9 | 0.5:9.5 | 0.2:9.8 |
| Si:C (Content ratio) | 9.7:0.3 | 8.8:1.2 | 7.3:2.7 | 4.8:5.2 | 3:7 | 2:8 | 0.8:9.2 |
| Image quality evaluation | Δ | ○ | ◎ | ◎ | ◎ | ○ | X |

◎: Very good
○: Good
Δ: Sufficiently practically usable
X: Defective images were liable to be formed.

EXAMPLE 113

By repeating the procedures in Example 109 except that the thickness of the second amorphous layer (II) was changed as shown in Table 114, image forming members were produced. The image formation, developing and cleaning steps as in Example 109 were repeated, and the results are shown in Table 114.

TABLE 114

| Thickness of amphorphous layer (II) | Result |
|---|---|
| 0.001μ | Defective images were liable to be formed. |
| 0.02μ | No defective image was formed when repeated 20,000 times. |
| 0.05μ | Stable when repeated 50,000 times or more. |
| 1μ | Stable when repeated 200,000 times or more. |

EXAMPLE 114

By repeating the procedures in Example 109 except that the formation of the interface layer and the amorphous layer (I) was changed as in Table 115, an image forming member was produced and evaluation was made as in Example 109. The result was good.

TABLE 115

| Constituting layer | Layer preparation step | Used gas | Flow rate (SCCM) | Flow rate ratio | Layer thickness (μ) |
|---|---|---|---|---|---|
| Interface layer | 1st step | $SiH_4$/He = 1<br>$NH_3$ | $SiH_4$ = 10 | $SiH_4$:$NH_3$ = 1:30 | 0.05 |
| Amorphous layer (I) | 2nd step | $SiH_4$/He = 1<br>$PH_3$/He = $10^{-2}$<br>NO | $SiH_4$ = 200 | $SiH_4$:$PH_3$ = 1:1.0 × $10^{-3}$<br>$SiH_4$:NO = 1:0.03 | 0.3 |
| Interface layer | 3rd step | $SiH_4$/He = 1<br>$NH_3$ | $SiH_4$ = 10 | $SiH_4$:$NH_3$ = 1:30 | 0.05 |
| Amorphous layer (II) | 4th step | $SiH_4$/He = 1 | $SiH_4$ 200 | | 15 |

EXAMPLE 115

By repeating the procedures in Example 109 except that the formation of the interface layer and the amorphous layer (I) was changed as shown in Table 116, an image forming member was produced and evaluated as in Example 109. The result was good.

TABLE 116

| Constituting layer | Layer preparation step | Used gas | Flow rate (SCCM) | Flow rate ratio | Layer thickness (μ) |
|---|---|---|---|---|---|
| Interface layer | 1st step | $SiH_4$/He = 1<br>$SiF_4$/He = 1<br>$NH_3$ | $SiH_4$ = 8 | $SiH_4$:$SiF_4$ = 8:2<br>($SiH_4$+ $SiF_4$):$NH_3$ = 1:30 | 0.05 |
| Amorphous layer (I) | 2nd step | $SiH_4$/He = 1<br>$SiF_4$/He = 1<br>$PH_3$/He = $10^{-2}$ | $SiH_4$ = 120 | $SiH_4$:$SiF_4$ + 8:2<br>($SiH_4$ + $SiF_4$):$PH_3$ = 1:1.0 × $10^{-3}$<br>($SiH_4$ + $SiF_4$):NO = 1:0.03 | 0.3 |
| | 3rd step | $SiH_4$/He = 1<br>$SiF_4$/He = 1 | | $SiH_4$:$SiF_4$ = 8:2 | 15 |

EXAMPLE 116

By using the production process in FIG. 7 and repeating the procedures in Example 109 except that the conditions in Table 117 were employed, layer formation was effected on an Al support. The resulting electrophotographic image forming member was evaluated as in Example 110. A good result was obtained.

TABLE 117

| Constituting layer | Layer preparation step | Used gas | Flow rate (SCCM) | Flow rate ratio | Discharge power (W/cm$^2$) | Layer deposition rate (Å/sec) | Layer thickness (μ) |
|---|---|---|---|---|---|---|---|
| Interface layer | 1st step | $SiH_4/He = 1$<br>$NH_3$ | $SiH_4 = 10$ | $NH_3:SiH_4 = 30$ | 0.18 | 5 | 0.05 |
| Amorphous layer (I) | 2nd step | $SiH_4/He = 1$<br>$PH_3/He = 10^{-2}$<br>NO | $SiH_4 = 200$ | $PH_3/SiH_4 = 1.0 \times 10^{-3}$<br>$NO/SiH_4 = 1.5 \times 10^{-2}$ | 0.18 | 11 | 0.3 |
| | 3rd step | $SiH_4/He = 1$<br>NO | $SiH_4 = 200$ | $NO/SiH_4 = 1.5 \times 10^{-2}$ | 0.18 | 11 | 0.1 |
| | 4th step | $SiH_4/He = 1$ | $SiH_4 = 200$ | | 0.18 | 11 | 15 |
| Amorphous layer (II) | 5th step | Ar | 200 | Si wafer:Graphite = 0.5:9.5 | 0.3 | 1.5 | 0.3 |

EXAMPLE 117

By using the production apparatus in FIG. 7, layer formation was made on an Al support under the following conditions in Table 118.

The other conditions were the same as those in Example 109.

The resulting image forming member was evaluated as in Example 11. The image was of high quality and the durability was excellent.

TABLE 118

| Constituting layer | Layer preparation step | Used gas | Flow rate (SCCM) | Flow rate ratio | Discharge power (W/cm$^2$) | Layer deposition rate (Å/sec) | Layer thickness (μ) |
|---|---|---|---|---|---|---|---|
| Interface layer | 1st | $SiH_4/He = 1$<br>$NH_3$ | $SiH_4 = 10$ | $NH_3:SiH_4 = 3$ | 0.18 | 5 | 0.05 |
| Amorphous layer (I) | 2nd step | $SiH_4/He = 1$<br>$PH_3/He = 10^{-2}$<br>NO | $SiH_4 = 200$ | $PH_3/SiH_4 = 5 \times 10^{-4}$<br>$NO/SiH_4 = 10^{-1}$ | 0.18 | 11 | 0.2 |
| | 3rd step | $SiH_4/He = 1$<br>$PH_3/He = 10^{-2}$ | $SiH_4 = 200$ | $NO/SiH_4 = 5 \times 10^{-4}$ | 0.18 | 11 | 0.3 |
| | 4th step | $SiH_4/He = 1$ | $SiH_4 = 200$ | | 0.18 | 11 | 15 |
| Amorphous layer (II) | 5th step | Ar | 200 | Si wafer:Graphite = 6:4 | 0.3 | 3 | 1.0 |

EXAMPLE 118

By repeating the procedures in Example 116 except that layer formation conditions for the third and the fourth layer preparation steps were as shown in Table 119, electrophotographic image forming members were produced and evaluated as in Example 109. The image quality and the durability were good.

TABLE 119

| Condition | Used gas | Flow rate (SCCM) | Flow rate ratio | Layer thickness (μ) |
|---|---|---|---|---|
| 1 | $SiH_4/He = 1$<br>$B_2H_6/He = 10^{-2}$ | $SiH_4 = 200$ | $B_2H_6/SiH_4 = 2 \times 10^{-5}$ | 15 |
| 2 | $SiH_4/He = 1$<br>$B_2H_6/He = 10^{-2}$<br>NO | $SiH_4 = 200$ | $B_2H_6/SiH_4 = 1 \times 10^{-5}$<br>$NO/SiH_4 = 1.5 \times 10^{-2}$ | 15 |
| 3 | $Si_2H_6/He = 1$<br>$B_2H_6/He = 10^{-2}$ | $Si_2H_6 = 170$ | $B_2H_6/Si_2H_6 = 3 \times 10^{-4}$ | 10 |
| 4 | $SiH_4/He = 1$<br>$SiF_4/He = 1$<br>$B_2H_6/He = 10^{-2}$ | $SiH_4 + SiF_4 = 100$ | $SiH_4:SiF_4 = 8:2$<br>$B_2H_6/(SiH_4 + SiF_4) = 2 \times 10^{-5}$ | 15 |
| 5 | $SiH_4/He = 1$<br>NO | $SiH_4 = 200$ | $NO/SiH_4 = 1.5 \times 10^{-2}$ | 15 |

EXAMPLE 119

By using the production apparatus in FIG. 7, layer formation was effected on a drum-like aluminum support under the following conditions.

The resulting image forming member was set in a charging-exposing-developing apparatus and subjected to a corona charging at ⊖5 KV for 0.2 sec, immediately followed by imagewise exposure at 1.0 lux.sec through a transparent test chart by a tungsten lamp as a light source.

Immediately thereafter, development was effected with a ⊕ charged developer (including toner and carrier) by cascading to produce a good toner image on the surface of the image forming member.

The resulting toner image was once cleaned with a rubber blade, and the above mentioned image forming and cleaning steps were repeated. Even when repeated 150,000 times or more, any degradation of image was not observed.

TABLE 120

| Constituting layer | Layer preparation step | Used gas | Flow rate (SCCM) | Flow rate ratio | Discharge power (W/cm$^2$) | Layer deposition rate (Å/sec) | Layer thickness (μ) |
|---|---|---|---|---|---|---|---|
| Interface layer | 1st step | $SiH_4$/He = 1<br>$NH_3$ | $SiH_4$ = 10 | $SiH_4$:$NH_3$ = 1:30 | 0.18 | 5 | 0.05 |
| Amorphous layer (I) | 2nd step | $SiH_4$/He = 1<br>$PH_3$/He = $10^{-2}$<br>NO | $SiH_4$ = 200 | $PH_3/SiH_4 = 1.0 \times 10^{-3}$<br>$NO/SiH_4 = 3 \times 10^{-2}$ | 0.18 | 11 | 0.3 |
| | 3rd step | $SiH_4$/He = 1 | $SiH_4$ = 200 | | 0.18 | 11 | 15 |
| Amorphous layer (II) | 4th step | $SiF_4$/He = 0.5<br>$C_2H_4$ | $SiF_4$ = 100 | $SiF_4$:$C_2H_4$ = 3:7 | 0.3 | 2 | 0.5 |

| | |
|---|---|
| Al support temperature: | 250° C. |
| Discharge frequency: | 13.56 MHz |
| Pressure in the reaction chamber: | 0.3 Torr upon forming amorphous layer (I); 0.2 Torr upon forming amorphous layer (II) |

EXAMPLE 120

By using the production apparatus in FIG. 7, layer formation was effected on a drum-like Al support under the following conditions. The other conditions were the same as those in Example 119.

The resulting image forming member was set in a charging-exposing-developing apparatus and subjected to a corona charging at ⊖5 KV for 0.2 sec, immediately followed by imagewise exposure at 1.0 lux.sec through a transparent test chart by a tungsten lamp as a light source.

Immediately thereafter, development was effected with a ⊕ charged developer (including toner and carrier) by cascading to produce a good toner image on the surface of the image forming member.

The resulting toner image was once cleaned with a rubber blade, and the above mentioned image forming and cleaning steps were repeated. Even when repeated 100,000 times or more, any degradation of image was not observed.

TABLE 121

| Constituting layer | Layer preparation step | Used gas | Flow rate (SCCM) | Flow rate ratio | Discharge power (W/cm$^2$) | Layer deposition rate (Å/sec) | Layer thickness (μ) |
|---|---|---|---|---|---|---|---|
| Interface layer | 1st step | $SiH_4$/He = 1<br>$NH_3$ | $SiH_4$ = 10 | $NH_3/SiH_4$ = 30 | 0.18 | 5 | 0.05 |
| Amorphous layer (I) | 2nd step | $SiH_4$/He = 1<br>$PH_3$/He = $10^{-2}$<br>NO | $SiH_4$ = 200 | $PH_3/SiH_4 = 1.0 \times 10^{-3}$<br>$NO/SiH_4 = 2 \times 10^{-2}$ | 0.18 | 11 | 0.2 |
| | 3rd step | $SiH_4$/He = 1 | $SiH_4$ = 200 | | 0.18 | 11 | 15 |
| Amorphous layer (II) | 4th step | $SiF_4$/He = 0.5<br>$C_2H_4$ | $SiF_4$ = 100 | $SiF_4$ :$C_2H_4$ = 0.4:9.6 | 0.3 | 1.5 | 0.3 |

EXAMPLE 121

By using the production apparatus in FIG. 7, layer formation was effected on a drum-like support under the following conditions. The other conditions were the same as those in Example 119.

The resulting image forming member was set in a charging-exposing-developing apparatus and subjected to a corona charging at ⊖5 KV for 0.2 sec, immediately followed by imagewise exposure at 1.0 lux.sec through a transparent test chart by a tungsten lamp as a light source.

Immediately thereafter, development was effected with a ⊕ charged developer (including toner and carrier) by cascading to produce a good toner image of a very high density on the surface of the image forming member.

The resulting toner image was once cleaned with a rubber blade, and the above mentioned image forming and cleaning steps were repeated. Even when repeated 150,000 times or more, any degradation of image was not observed.

TABLE 122

| Constituting layer | Layer preparation step | Used gas | Flow rate (SCCM) | Flow rate ratio | Discharge power ($W/cm^2$) | Layer deposition rate (Å/sec) | Layer thickness (μ) |
|---|---|---|---|---|---|---|---|
| Interface layer | 1st step | $SiH_4/He = 1$ $NH_3$ | $SiH_4 = 10$ | $NH_3/SiH_4 = 3$ | 0.18 | 5 | 0.05 |
| Amorphous layer (I) | 2nd step | $SiH_4/He = 1$ $PH_3/He = 10^{-2}$ NO | $SiH_4 = 200$ | $PH_3/SiH_4 = 3 \times 10^{-3}$ $NO/SiH_4 = 3 \times 10^{-2}$ | 0.18 | 11 | 0.3 |
| | 3rd step | $SiH_4/He = 1$ | $SiH_4 = 200$ | | 0.18 | 11 | 15 |
| Amorphous layer (II) | 4th step | $SiF_4/He = 0.5$ $C_2H_4$ | $SiF_4 = 100$ | $SiF_4:C_2H_4 = 5:5$ | 0.3 | 3 | 1.5 |

EXAMPLE 122

By repeating the procedures in Example 121 except that the content ratio of Si atom to carbon atom in the second amorphous layer (II) was changed, image forming members were produced.

The resulting image forming members were repeatedly subjected to the image forming, developing and cleaning steps as in Example 119 about 50,000 times, and image evaluation was effected. The results are shown in Table 123.

TABLE 123

| | | | | | | | | |
|---|---|---|---|---|---|---|---|---|
| $SiH_4:C_2H_4$ (Flow rate ratio) | 9:1 | 6:4 | 4:6 | 2:8 | 1:9 | 0.5:9.5 | 0.34:9.66 | 0.2:9.8 |
| Si:C (Content ratio) | 9:1 | 7:3 | 5.5:4.5 | 4:6 | 3:7 | 2:8 | 1.2:8.8 | 0.8:9.2 |
| Image quality evaluation | Δ | ○ | ⊙ | ⊙ | | ⊙ | ○ | X |

⊙: Very good
○: Good
Δ: Practically sufficiently usable
X: Defective images were formed.

EXAMPLE 123

By repeating the procedures in Example 119 except that the second amorphous layer (II) thickness was changed, image forming members were produced and subjected to the image forming, developing and cleaning steps as in Example 199. The results are shown in the following Table 124.

TABLE 124

| Thickness of amorphous layer (II) (μ) | Result |
|---|---|
| 0.001 | Defective images were liable to be formed. |
| 0.02 | Defective images were not formed when repeated 20,000 times. |
| 0.05 | Stable when repeated 50,000 times or more. |
| 2 | Stable when repeated 200,000 times or more. |

EXAMPLE 124

By repeating the procedures in Example 119 except that the formation of the interface layer and the amorphous layer (I) was changed as shown in the following table, an image forming member was produced and evaluated as in Example 119. A good result was obtained.

TABLE 125

| Constituting layer | Layer preparation step | Used gas | (SCCM) | Flow rate Flow rate ratio | Layer thickness (μ) |
|---|---|---|---|---|---|
| Interface layer | 1st step | $SiH_4/He = 1$ $NH_3$ | $SiH_4 = 10$ | $SiH_4:NH_3 = 1:30$ | 0.05 |
| Amorphous layer (I) | 2nd step | $SiH_4/He = 1$ $PH_3/He = 10^{-2}$ NO | $SiH_4 = 200$ | $SiH_4:PH_3 = 1:1.0 \times 10^{-3}$ $SiH_4:NO = 1:0.03$ | 0.3 |
| Interface layer | 3rd step | $SiH_4/He = 1$ $NH_3$ | $SiH_4/He = 10$ | $SiH_4:NH_3 = 1:30$ | 0.05 |
| Amorphous layer (II) | 4th step | $SiH_4/He = 1$ | $SiH_4 = 200$ | | 15 |

EXAMPLE 125

By repeating the procedures in Example 119 except that the formation of the interface layer and the amorphous layer (I) was changed as shown in the following table, an image forming member was produced, and evaluated as in Example 119. A good result was obtained.

TABLE 126

| Constituting layer | Layer preparation step | Used gas | (SCCM) | Flow rate Flow rate ratio | layer thickness (μ) |
|---|---|---|---|---|---|
| Interface layer | 1st step | $SiH_4/He = 1$ $SiF_4/He = 1$ $NH_3$ | $SiH_4 = 8$ | $SiH_4:SiF_4 = 8:2$ $(SiH_4 + SiF_4):NH_3 = 1:30$ | 0.05 |
| Amorphous layer | 2nd step | $SiH_4/He = 1$ $SiF_4/He = 1$ $PH_3/He = 10^{-2}$ | $SiH_4 = 120$ | $SiH_4:SiF_4 = 8:2$ $(SiH_4 + SiF_4):PH_3 = 1:1.0 \times 10^{-3}$ $(SiH_4 + SiF_4):NO = 1:0.03$ | 0.3 |

TABLE 126-continued

| Constituting layer | Layer preparation step | Used gas | (SCCM) | Flow rate Flow rate ratio | layer thickness (μ) |
|---|---|---|---|---|---|
| | | NO | | | |
| | 3rd step | $SiH_4/He = 1$<br>$SiF_4/He = 1$ | | $SiH_4:SiF_4 = 8:2$ | 15 |

EXAMPLE 126

By using the apparatus in FIG. 7 and repeating the procedures in Example 119 except that the conditions in Table 127 were employed, layer formation was effected on a drum-like Al support. The resulting electrophotographic image forming member was evaluated as in Example 120. A good result was obtained.

The other conditions were the same as those in Example 119.

The resulting image forming member was evaluated as in Example 121.

The image was of a high quality and the durability was excellent.

TABLE 128

| Constituting layer | Layer preparation step | Used gas | Flow rate (SCCM) | Flow rate ratio | Discharged power ($W/cm^2$) | Layer deposition rate (Å/sec) | Layer thickness (μ) |
|---|---|---|---|---|---|---|---|
| Interface layer | 1st step | $SiH_4/He = 1$<br>$NH_3$ | $SiH_4 = 10$ | $NH_3/SiH_4 = 3$ | 0.18 | 5 | 0.05 |
| Amorphous layer (I) | 2nd step | $SiH_4/He = 1$<br>$PH_3/He = 10^{-2}$<br>NO | $SiH_4 = 200$ | $PH_3/SiH_4 = 5 \times 10^{-4}$<br>$NO/SiH_4 = 10^{-1}$ | 0.18 | 11 | 0.2 |
| | 3rd step | $SiH_4/He = 1$<br>$PH_3/He = 10^{-2}$ | $SiH_4 = 200$ | $PH_3/SiH_4 = 5 \times 10^{-4}$ | 0.18 | 11 | 0.3 |
| | 4th step | $SiH_4/He = 1$ | $SiH_4 = 200$ | | 0.18 | 11 | 15 |
| Amorphous layer (II) | 5th step | $SiH_4/He = 0.5$<br>$C_2H_4$ | $SiH_4 = 100$ | $SiH_4:C_2H_4 = 5:5$ | 0.3 | 3 | 1.5 |

TABLE 127

| Constituting layer | Layer preparation step | Used gas | Flow rate (SCCM) | Flow rate ratio | Discharge power ($W/cm^2$) | Layer deposition rate (Å/sec) | Layer thickness (μ) |
|---|---|---|---|---|---|---|---|
| Interface layer | 1st step | $SiH_4/He = 1$<br>$NH_3$ | $SiH_4 = 10$ | $NH_3/SiH_4 = 30$ | 0.18 | 5 | 0.05 |
| Amorphous layer (I) | 2nd step | $SiH_4/He = 1$<br>$PH_3/He = 10^{-2}$<br>NO | $SiH_4 = 200$ | $PH_3/SiH_4 = 1.0 \times 10^{-3}$<br>$NO/SiH_4 = 1.5 \times 10^{-2}$ | 0.18 | 11 | 0.3 |
| | 3rd step | $SiH_4/He = 1$<br>NO | $SiH_4 = 200$ | $NO/SiH_4 = 1.5 \times 10^{-2}$ | 0.18 | 11 | 0.1 |
| | 4th step | $SiH_4/He = 1$ | $SiH_4 = 200$ | | 0.18 | 11 | 15 |
| Amorphous layer (II) | 5th step | $SiH_4/He = 1$<br>$C_2H_4$ | $SiH_4 = 100$ | $SiH_4:C_2H_4 = 0.4:9.6$ | 0.3 | 1.5 | 0.3 |

EXAMPLE 127

By using the apparatus in FIG. 7, layer formation was effected on an Al support under the following conditions in Table 128.

EXAMPLE 128

By repeating the procedures in Example 126 except that the layer forming conditions for the third and the fourth layer preparation steps in Example 126 were replaced by the conditions in Table 129, electrophotographic image forming members were produced and evaluated as in Example 119. The image quality and the durability were good.

TABLE 129

| Condition | Used gas | Flow rate (SCCM) | Flow rate ratio | Layer thickness (μ) |
|---|---|---|---|---|
| 1 | $SiH_4/He = 1$<br>$B_2H_6/He = 10^{-2}$ | $SiH_4 = 200$ | $B_2H_6/SiH_4 = 2 \times 10^{-5}$ | 15 |
| 2 | $SiH_4/He = 1$<br>$B_2H_6/He = 10^{-2}$<br>NO | $SiH_4 = 200$ | $B_2H_6/SiH_4 = 1 \times 10^{-5}$<br>$NO/SiH_4 = 1.5 \times 10^{-2}$ | 15 |
| 3 | $Si_2H_6/He = 1$<br>$B_2H_6/He = 10^{-2}$ | $Si_2H_6 = 170$ | $B_2H_6/Si_2H_6 = 3 \times 10^{-4}$ | 10 |
| 4 | $SiH_4/He = 1$<br>$SiF_4/He = 1$ | $SiH_4 + SiF_4 = 100$ | $SiH_4:SiF_4 = 8:2$<br>$B_2H_6/(SiH_4 + SiF_4) = 2 \times 10^{-5}$ | 15 |

TABLE 129-continued

| Condition | Used gas | Flow rate (SCCM) | Flow rate ratio | Layer thickness (μ) |
|---|---|---|---|---|
| 5 | $B_2H_6$/He = $10^{-2}$<br>$SiH_4$/He = 1<br>NO | $SiH_4$ = 200 | NO/$SiH_4$ = 1.5 × $10^{-2}$ | 15 |

EXAMPLE 129

By using the production apparatus in FIG. 8, layer formation was effected on an Al support under the following conditions.

The resulting image forming member was set in a charging-exposing-developing apparatus and subjected to a corona charging at ⊖5 KV for 0.2 sec, immediately followed by imagewise exposure at 1.0 lux.sec through a transparent test chart by a tungsten lamp as a light source.

Immediately thereafter, development was effected with a ⊕ charged developer (including toner and carrier) by cascading to produce a good toner image on the surface of the image forming member.

The resulting toner image was once cleaned with a rubber blade, and the above mentioned image forming and cleaning steps were repeated. Even when repeated 150,000 times or more, any degradation of image was not observed.

EXAMPLE 130

By using the production apparatus in FIG. 8, layer formation was effected on an Al support under the following conditions.

The resulting image forming member was set in a charging-exposing-developing apparatus and subjected to a corona charging at ⊖5 KV for 0.2 sec, immediately followed by imagewise exposure at 1.0 lux.sec through a transparent test chart by a tungsten lamp as a light source.

Immediately thereafter, development was effected with a ⊕ charged developer (including toner and carrier) by cascading to produce a good toner image on the surface of the image forming member.

The resulting toner image was once cleaned with a rubber blade, and the above mentioned image forming and cleaning steps were repeated. Even when repeated 150,000 times or more, any degradation of image was not observed.

TABLE 130

| Constituting layer | Layer formation step | Used gas | (SCCM) | Flow rate<br>Flow rate ratio | Discharged power (W/cm²) | Layer deposition rate (Å/sec) | Layer thickness (μ) |
|---|---|---|---|---|---|---|---|
| Interface layer | 1st step | $SiH_4$/He = 1<br>$NH_3$ | $SiH_4$ = 10 | $SiH_4$:$NH_3$ = 1:30 | 0.18 | 5 | 0.05 |
| Amorphous layer (I) | 2nd step | $SiH_4$/He = 1<br>$PH_3$/He = $10^{-2}$<br>NO | $SiH_4$ = 200 | $PH_3$/$SiH_4$ = 1.0 × $10^{-3}$<br>NO/$SiH_4$ = 3 × $10^{-2}$ | 0.18 | 11 | 0.3 |
| | 3rd step | $SiH_4$/He = 1 | $SiH_4$ = 200 | | 0.18 | 11 | 15 |
| Amorphous layer (II) | 4th step | $SiF_4$/He = 0.5<br>$C_2H_4$ | $SiF_4$ = 100 | $SiF_4$:$C_2H_4$ = 3:7 | 0.3 | 2 | 0.5 |

| | |
|---|---|
| Al support temperature: | 250° C. |
| Discharge frequency: | 13.56 MHz |
| Pressure in the reaction chamber: | 0.3 Torr upon forming amorphous layer (I);<br>0.2 Torr upon forming amorphous layer (II) |

TABLE 130A

| Constituting layer | Layer formation step | Used gas | Flow rate (SCCM) | Flow rate ratio | Discharge power (W/cm²) | Layer deposition rate (Å/sec) | Layer thickness (μ) |
|---|---|---|---|---|---|---|---|
| Interface layer | 1st step | $SiH_4$/He = 1<br>$NH_3$ | $SiH_4$ = 10 | $SiH_4$:$NH_3$ = 1:30 | 0.18 | 5 | 0.05 |
| Amorphous layer (I) | 2nd step | $SiH_4$/He = 1<br>$PH_3$/He = $10^{-2}$<br>NO | $SiH_4$ = 200 | $PH_3$/$SiH_4$ = 1.0 × $10^{-4}$<br>NO/$SiH_4$ = 1 × $10^{-2}$ | 0.18 | 11 | 0.3 |
| | 3rd step | $SiH_4$/He = 1 | $SiH_4$ = 200 | | 0.18 | 11 | 18 |
| Amorphous layer (II) | 4th step | $SiF_4$/He = 0.5<br>$C_2H_4$ | $SiF_4$ = 100 | $SiF_4$:$C_2H_4$ = 3:7 | 0.3 | 2 | 0.5 |

| | |
|---|---|
| Al support temperature: | 250° C. |
| Discharge frequency: | 13.56 MHz |
| Pressure in the reaction chamber: | 0.3 Torr upon forming amorphous layer (I);<br>0.2 Torr upon forming amorphous layer (II) |

EXAMPLE 131

By using the production apparatus in FIG. 8, layer formation was effected on an Al support under the following conditions. The other conditions were the same as those in Example 129.

The resulting image forming member was set in a charging-exposing-developing apparatus and subjected to a corona charging at ⊖5 KV for 0.2 sec, immediately followed by imagewise exposure at 1.0 lux.sec through a transparent test chart by a tungsten lamp as a light source.

Immediately thereafter, development was effected with a ⊕ charged developer (including toner and carrier) by cascading to produce a good toner image on the surface of the image forming member.

The resulting image forming member was set in a charging-exposing-developing apparatus and subjected to a corona charging at ⊖5 KV for 0.2 sec, immediately followed by imagewise exposure at 1.0 lux.sec through a transparent test chart by a tungsten lamp as a light source.

Immediately thereafter, development was effected with a ⊕ charged developer (including toner and carrier) by cascading to produce a good toner image of a very high density on the surface of the image forming member.

The resulting toner image was once cleaned with a rubber blade, and the above mentioned image forming and cleaning steps were repeated. Even when repeated 150,000 times or more, any degradation of image was not observed.

TABLE 132

| Constituting layer | Layer preparation step | Used gas | Flow rate (SCCM) | Flow rate ratio | Discharge power (W/cm$^2$) | Layer deposition rate (Å/sec) | Layer thickness (μ) |
|---|---|---|---|---|---|---|---|
| Interface layer | 1st step | $SiH_4$/He = 1<br>$NH_3$ | $SiH_4$ = 10 | $NH_3/SiH_4$ = 3 | 0.18 | 5 | 0.05 |
| Amorphous layer (I) | 2nd step | $SiH_4$/He = 1<br>$PH_3$/He = $10^{-2}$<br>NO | $SiH_4$ = 200 | $PH_3/SiH_4 = 3 \times 10^{-3}$<br>$NO/SiH_4 = 3 \times 10^{-2}$ | 0.18 | 11 | 0.3 |
| | 3rd step | $SiH_4$/He = 1 | $SiH_4$ = 200 | | 0.18 | 11 | 15 |
| Amorphous layer (II) | 4th step | $SiH_4$/He = 0.5<br>$SiF_4$/He = 0.5<br>$C_2H_4$ | $SiH_4 + SiF_4$ = 150 | $SiH_4:SiF_4:C_2H_4$ = 3:3:4 | 0.3 | 3 | 1.5 |

The resulting toner image was once cleaned with a rubber blade, and the above mentioned image forming and cleaning steps were repeated. Even when repeated 100,000 times or more, any degradation of image was not observed.

EXAMPLE 132

By using the production apparatus in FIG. 8, layer formation was effected on an Al support under the following conditions. The other conditions were the same as those in Example 129.

TABLE 131

| Constituting layer | Layer preparation step | Used gas | Flow rate (SCCM) | Flow rate ratio | Discharge power (W/cm$^2$) | Layer deposition rate (Å/sec) | Layer thickness (μ) |
|---|---|---|---|---|---|---|---|
| Interface layer | 1st step | $SiH_4$/He = 1<br>$NH_3$ | $SiH_4$ = 10 | $NH_3/SiH_4$ = 30 | 0.18 | 5 | 0.05 |
| Amorphous layer (I) | 2nd step | $SiH_4$/He = 1<br>$PH_3$/He = $10^{-2}$<br>NO | $SiH_4$ = 200 | $PH_3/SiH_4 = 1.0 \times 10^{-3}$<br>$NO/SiH_4 = 2 \times 10^{-2}$ | 0.18 | 11 | 0.2 |
| | 3rd step | $SiH_4$/He = 1 | $SiH_4$ = 200 | | 0.18 | 11 | 15 |
| Amorphous layer (II) | 4th step | $SiH_4$/He = 0.5<br>$SiF_4$/He = 0.5<br>$C_2H_4$ | $SiH_4 + SiF_4$ = 15 | $SiH_4:SiF_4:C_2H_4$ = 0.3:0.1:9.6 | 0.3 | 1.5 | 0.3 |

EXAMPLE 133

By repeating the procedures in Example 132 except that, upon producing the second amorphous layer (II), the flow rate ratio of $SiH_4:SiF_4:C_2H_4$ was changed to change the content ratio of Si atom to carbon atom in the layer (II), image forming members were produced, and subjected to the image forming, developing and cleaning steps as in Example 129 about 50,000 times to evaluate the images. The results are shown in Table 133.

TABLE 133

| $SiH_4:SiF_4:C_2H_4$ | 5:4:1 | 3:3.5:3.5 | 2:2:6 | 1:1:8 | 0.6:0.4:9 | 0.2:0.3:9.5 | 0.2:0.15:9.65 | 0.1:0.1:9.8 |
|---|---|---|---|---|---|---|---|---|
| Si:C (Content ratio) | 9:1 | 7:3 | 5.5:4:5 | 4:6 | 3:7 | 2:8 | 1.2:8.8 | 0.8:9.2 |
| Image quality | Δ | ○ | ◎ | ◎ | ◎ | ◎ | ○ | X |

◎: Very good
○: Good
Δ: Practically usable
X: Defective images were formed.

EXAMPLE 134

By repeating the procedures in Example 129 except that the thickness of the second layer (II) was changed, image forming members were produced, and subjected to the image forming, developing and cleaning steps as in Example 129. The results are as shown below.

TABLE 134

| Thickness of amorphous layer (II) (μ) | Result |
|---|---|
| 0.001 | Defective images were liable to be formed. |
| 0.02 | When repeated 20,000 times, no defective image was formed. |
| 0.05 | Stable when repeated 50,000 times or more. |
| 1 | Stable when repeated 200,000 times or more. |

EXAMPLE 135

By repeating the procedures in Example 129 except that the formation of the interface layer and the amorphous layer (I) was changed as in Table 135, an image forming member was produced and evaluated as in Example 129. The result was good.

TABLE 135

| Constituting layer | Layer preparation step | Used gas | Flow rate (SCCM) | Flow rate ratio | Layer thickness (μ) |
|---|---|---|---|---|---|
| Interface layer | 1st step | $SiH_4/He = 1$<br>$NH_3$ | $SiH_4 = 10$ | $SiH_4:NH_3 = 1:30$ | 0.05 |
| Amorphous layer (I) | 2nd step | $SiH_4/He = 1$<br>$PH_3/He = 10^{-3}$<br>NO | $SiH_4 = 200$ | $SiH_4:PH_3 = 1:1.0 \times 10^{-3}$<br>$SiH_4:NO = 1:0.03$ | 0.3 |
| Interface layer | 3rd step | $SiH_4/He = 1$<br>$NH_3$ | $SiH_4 = 10$ | $SiH_4:NH_3 = 1:30$ | 0.05 |
| Amorphous layer (II) | 4th step | $SiH_4/He = 1$ | $SiH_4 = 200$ | | 15 |

EXAMPLE 136

By repeating the procedures in Example 129 except that the formation of the interface layer and the amorphous layer (I) was changed as in Table 136 below, an image forming member was produced and evaluated as in Example 129. A good result was obtained.

TABLE 136

| Constituting layer | Layer preparation step | Used gas | Flow rate (SCCM) | Flow rate ratio | Layer thickness (μ) |
|---|---|---|---|---|---|
| Interface layer | 1st step | $SiH_4/He = 1$<br>$SiF_4/He = 1$<br>$NH_3$ | $SiH_4 = 8$ | $SiH_4:SiF_4 = 8:2$<br>$(SiH_4 + SiF_4):NH_3 = 1:30$ | 0.05 |
| Amorphous layer (I) | 2nd step | $SiH_4/He = 1$<br>$SiF_4/He = 1$<br>$PH_3/He = 10^{-2}$<br>NO | $SiH_4 = 120$ | $SiH_4:SiF_4 = 8:2$<br>$(SiH_4 = SiF_4):PH_3 = 1:1.0 \times 10^{-3}$<br>$(SiH_4:SiF_4):NO = 1:0.03$ | 0.3 |
| | 3rd step | $SiH_4/He = 1$<br>$SiF_4/He = 1$ | | $SiH_4:SiF_4 = 8:2$ | 15 |

EXAMPLE 137

By using a production apparatus in FIG. 7 and repeating the procedures in Example 129 except that the conditions in Table 137 were employed, layer formation was effected on an Al support.

The resulting electrophotographic image forming member was evaluated as in Example 131. A good result was obtained.

TABLE 137

| Constituting layer | Layer preparation step | Used gas | Flow rate (SCCM) | Flow rate ratio | Discharge power (W/cm²) | Layer deposition rate (Å/sec) | Layer thickness (μ) |
|---|---|---|---|---|---|---|---|
| Interface layer | 1st step | $SiH_4/He = 1$<br>$NH_3$ | $SiH_4 = 10$ | $NH_3/SiH_4 = 30$ | 0.18 | 5 | 0.05 |
| Amorphous layer (I) | 2nd step | $SiH_4/He = 1$<br>$PH_3/He = 10^{-2}$<br>NO | $SiH_4 = 200$ | $PH_3/SiH_4 = 1.0 \times 10^{-3}$<br>$NO/SiH_4 = 1.5 \times 10^{-2}$ | 0.18 | 11 | 0.3 |
| | 3rd step | $SiH_4/He = 1$<br>NO | $SiH_4 = 200$ | $NO/SiH_4 = 1.5 \times 10^{-2}$ | 0.18 | 11 | 0.1 |
| | 4th step | $SiH_4/He = 1$ | $SiH_4 = 200$ | | 0.18 | 11 | 15 |
| Amorphous layer (II) | 5th step | $SiH_4/He = 0.5$<br>$SiF_4/He = 0.5$<br>$C_2H_4$ | $(SiH_4 + SiF_4) = 15$ | $SiH_4:SiF_4:C_2H_4 = 0.3:0.1:9.6$ | 0.3 | 1.5 | 0.3 |

EXAMPLE 138

By using the production apparatus in FIG. 7, layer formation was effected on an Al support under the following Table 138.

The other conditions were the same as those in Example 129.

The resulting image forming member was evaluated as in Example 132. The image was of high quality and the durability was excellent.

TABLE 138

| Constituting layer | Layer preparation step | Used gas | Flow rate (SCCM) | Flow rate ratio | Discharge power ($W/cm^2$) | Layer deposition rate (Å/sec) | Layer thickness (μ) |
|---|---|---|---|---|---|---|---|
| Interface layer | 1st step | $SiH_4/He = 1$<br>$NH_3$ | $SiH_4 = 10$ | $NH_3/SiH_4 = 3$ | 0.18 | 5 | 0.05 |
| Amorphous layer (I) | 2nd step | $SiH_4/He = 1$<br>$PH_3/He = 10^{-2}$<br>NO | $SiH_4 = 200$ | $PH_3/SiH_4 = 5 \times 10^{-4}$<br>$NO/SiH_4 = 10^{-1}$ | 0.18 | 11 | 0.2 |
| | 3rd step | $SiH_4/He = 1$<br>$PH_3/He = 10^{-2}$ | $SiH_4 = 200$ | $PH_3/SiH_4 = 5 \times 10^{-4}$ | 0.18 | 11 | 0.3 |
| | 4th step | $SiH_4/He = 1$ | $SiH_4 = 200$ | | 0.18 | 11 | 15 |
| Amorphous layer (II) | 5th step | $SiH_4/He = 0.5$<br>$SiF_4/He = 0.5$<br>$C_2H_4$ | $SiH_4 + SiF_4 = 150$ | $SiH_4:SiF_4:C_2H_4 = 3:3:4$ | 0.3 | 3 | 1.5 |

EXAMPLE 139

By repeating the procedures in Example 132 except that the amorphous layer (II) was produced by sputtering under the following conditions, an image forming member was produced and evaluated as in Example 132. A good result was obtained.

TABLE 139

| | Used gas | Flow rate (SCCM) | Target area ratio Si wafer:Graphite | Discharge power ($W/cm^2$) | Layer thickness (μ) |
|---|---|---|---|---|---|
| Amorphous layer (II) | Ar<br>$SiF_4/He = 0.5$ | $Ar = 200$<br>$SiF_4 = 100$ | 2.5:7.5 | 0.3 | 1 |

EXAMPLE 140

By repeating the procedures in Example 137 except that the layer forming conditions in the third and the fourth layer preparation steps were those in Table 140, electrophotographic image forming members were produced and evaluated as in Example 129. The image quality and the durability were good.

TABLE 140

| Condition | Used gas | Flow rate (SCCM) | Flow rate ratio | Layer thickness (μ) |
|---|---|---|---|---|
| 1 | $SiH_4/He = 1$<br>$B_2H_6/He = 10^{-2}$ | $SiH_4 = 200$ | $B_2H_6/SiH_4 = 2 \times 10^{-5}$ | 15 |
| 2 | $SiH_4/He = 1$<br>$B_2H_6/He = 10^{-2}$<br>NO | $SiH_4 = 200$ | $B_2H_6/SiH_4 = 1 \times 10^{-5}$<br>$NO/SiH_4 = 1.5 \times 10^{-2}$ | 15 |
| 3 | $Si_2H_6/He = 1$<br>$B_2H_6/He = 10^{-2}$ | $Si_2H_6 = 170$ | $B_2H_6/Si_2H_6 = 3 \times 10^{-4}$ | 10 |
| 4 | $SiH_4/He = 1$<br>$SiF_4/He = 1$<br>$B_2H_6/He = 10^{-2}$ | $(SiH_4 + SiF_4) = 100$ | $SiH_4:SiF_4 = 8:2$<br>$B_2H_6/(SiH_4 + SiF_4) = 2 \times 10^{-5}$<br>$2 \times 10^{-5}$ | 15 |
| 5 | $SiH_4/He = 1$<br>NO | $SiH_4 = 200$ | $NO/SiH_4 = 1.5 \times 10^{-2}$ | 15 |

We claim:

1. A photoconductive member comprising a support for a photoconductive member and an amorphous layer exhibiting photoconductivity and comprising an amorphous material comprising silicon atoms as a matrix and at least one member selected from the group consisting of hydrogen atoms and halogen atoms as a constituting atom, characterized in that the amorphous layer has a first layer region containing oxygen atoms and a second layer region containing an atom of Group III or an atom of Group V of the Periodic Table and existing interiorly at the support side, and the first layer region and the second layer region share in common at least a portion of said mutual region, and there is the relation:

$$t_B/(T+t_B) \leqq 0.4$$

where $t_B$ is the thickness of the second layer region and T is a difference between the thickness of the amorphous layer and the thickness of the second layer region $t_B$.

2. A photoconductive member according to claim 1 in which an amorphous layer composed of an amorphous material containing silicon atoms and carbon atoms as constituting atom overlies the amorphous layer exhibiting photoconductivity.

3. A photoconductive member according to claim 2 in which the amorphous material containing carbon atoms contains hydrogen atoms.

4. A photoconductive member according to claim 2 in which the amorphous material containing carbon atoms contains halogen atoms.

5. A photoconductive member according to claim 2 in which the amorphous material containing carbon atoms contains hydrogen atoms and halogen atoms.

6. A photoconductive member according to claim 1 in which an interface layer composed of an amorphous material containing silicon atoms and nitrogen atoms as constituting atom is present.

7. A photoconductive member according to claim 6 in which the interface layer is disposed between the support and the amorphous layer exhibiting photoconductivity.

8. A photoconductive member according to claim 6 in which the interface layer is present in the amorphous layer exhibiting photoconductivity as a part of said amorphous layer.

9. A photoconductive member according to claim 1 in which the first layer region is localized at the support side.

10. A photoconductive member according to claim 1 in which the first layer region occupies the whole layer region of the amorphous layer exhibiting photoconductivity.

11. A photoconductive member according to claim 1 in which the second layer region contains an atom of Group V of the Periodic Table and a layer region on or above the second layer region contains an atom of Group III of the Periodic Table.

12. A photoconductive member according to claim 1 in which the second layer region contains an atom of Group III of the Periodic Table.

13. A photoconductive member according to claim 12 in which the content of the atom of Group III of the Periodic Table in the second layer region is $30-5\times10^4$ atomic ppm.

14. A photoconductive member according to claim 1 in which the second layer region contains an atom of Group V of the Periodic Table.

15. A photoconductive member according to claim 14 in which the content of the atom of Group V of the Periodic Table in the second layer region is $30-5\times10^4$ atomic ppm.

16. The photoconductive member according to claim 1 in which the content of hydrogen atoms in the amorphous layer is 1–40 atomic %.

17. The photoconductive member according to claim 1 in which the content of halogen atoms in the amorphous layer is 1–40 atomic %.

18. The photoconductive member according to claim 1 in which the total content of hydrogen atoms and halogen atoms is 1–40 atomic %.

19. The photoconductive member according to claim 1 in which the atom of Group III of the Periodic Table is selected from the group consisting of B, Al, Ga, In and Tl.

20. The photoconductive member according to claim 1 in which the atom of Group V of the Periodic Table is selected from the group consisting of P, As, Sb and Bi.

21. The photoconductive member according to claim 1 in which the content of oxygen atoms in the first layer region is 0.001–50 atomic %.

22. The photoconductive member according to claim 1 in which the content of oxygen atoms in the first layer region is 30 or less atomic %.

23. The photoconductive member according to claim 1 in which $t_O$ is 30 Å–5μ.

24. The photoconductive member according to claim 1 in which (T+T) is 1–100μ.

25. The photoconductive member according to claim 1 in which the thickness of the first layer region $t_O$ satisfies the relation:

$$t_O \leqq t_B.$$

26. The photoconductive member according to claim 1 in which the thickness of the first layer region $t_O$ satisfies the relation:

$$t_B < t_O.$$

27. The photoconductive member according to claim 25 in which $t_O$ is 10 Å–10μ.

28. The photoconductive member according to claim 26 in which $t_O$ is 10 Å–10μ.

29. The photoconductive member according to claim 1 in which the thickness of the first layer region $t_O$ is 10 Å–10μ.

30. The photoconductive member according to claim 11 in which the content of the atom of Group III of the Periodic Table in the layer region on or above the second layer region is 0.001–1000 atomic ppm.

31. The photoconductive member according to claim 1 in which the first layer region is localized at a support side in the amorphous layer.

32. The photoconductive member according to claim 1 in which the support is formed into an endless belt.

33. The photoconductive member according to claim 1 in which the support is formed into a cylinder.

34. The photoconductive member according to claim 2 in which the amorphous material containing silicon atoms and carbon atoms is selected from the group consisting of amorphous materials whose compositions are expressed by the formulae as shown below:

| | |
|---|---|
| (1) $Si_aC_{1-a}$ | $0.1 \leqq a \leqq 0.99999$ |
| (2) $(Si_bC_{1-b})_cH_{1-c}$ | $0.1 \leqq b \leqq 0.99999$ |
| | $0.6 \leqq c \leqq 0.99$ |
| (3) $(Si_dC_{1-d})_e(X,H)_{1-e}$ | $0.1 \leqq d \leqq 0.99999$ |
| | $0.8 \leqq e \leqq 0.99$ |

35. The photoconductive member according to claim 2, in which the thickness of the amorphous layer composed of an amorphous material containing silicon atoms and carbon atoms is 0.003–30μ.

36. The photoconductive member according to claim 6 in which the amorphous material containing silicon atoms and nitrogen atoms is selected from the group consisting of amorphous materials whose compositions are expressed by the formulae as shown below:

| | |
|---|---|
| (1) $a - Si_aN_{1-a}$ | $0.4 \leqq a \leqq 0.99999$ |
| (2) $a - (Si_bN_{1-b})_cH_{1-c}$ | $0.43 \leqq b \leqq 0.99999$<br>$0.65 \leqq c \leqq 0.98$ |
| (3) $a - (Si_dN_{1-d})_e(H,X)_{1-e}$ | $0.43 \leqq d \leqq 0.99999$<br>$0.8 \leqq e \leqq 0.99$ |

37. The photoconductive member according to claim 6 in which the thickness of the interface layer is 30 Å–2μ.

* * * * *